US012371969B2

(12) United States Patent
Mberia et al.

(10) Patent No.: US 12,371,969 B2
(45) Date of Patent: Jul. 29, 2025

(54) DOWNHOLE FLOW CONTROLLER

(71) Applicant: NCS MULTISTAGE INC., Calgary (CA)

(72) Inventors: Stanley Mberia, Calgary (CA); Doug Brunskill, Calgary (CA)

(73) Assignee: NCS MULTISTAGE INC., Calgary (CA)

( * ) Notice: Subject to any disclaimer, the term of this patent is extended or adjusted under 35 U.S.C. 154(b) by 0 days.

(21) Appl. No.: 18/514,906

(22) Filed: Nov. 20, 2023

(65) Prior Publication Data

US 2025/0163775 A1 May 22, 2025

Related U.S. Application Data

(63) Continuation of application No. 17/437,325, filed as application No. PCT/CA2020/050298 on Mar. 6, 2020, now Pat. No. 11,867,025.

(Continued)

(51) Int. Cl.
*E21B 34/06* (2006.01)
*E21B 43/08* (2006.01)

(52) U.S. Cl.
CPC ..... *E21B 34/063* (2013.01); *E21B 43/08* (2013.01); *E21B 2200/06* (2020.05); *E21B 2200/08* (2020.05)

(58) Field of Classification Search
CPC ..... E21B 34/14; E21B 34/063; E21B 43/08; E21B 43/103; E21B 43/38; E21B 2200/06
See application file for complete search history.

(56) References Cited

U.S. PATENT DOCUMENTS 3,768,556 A * 10/1973 Baker ..... E21B 33/146 166/318
3,811,500 A * 5/1974 Morrisett ..... E21B 34/14 166/153

(Continued)

FOREIGN PATENT DOCUMENTS

WO 2018098592 A1 6/2018
WO 2018161558 A1 9/2018

OTHER PUBLICATIONS

International Search Report for International PCT Application No. PCT/CA2020/050298 dated May 1, 2020, 6 pages.

*Primary Examiner* — Steven A MacDonald
(74) *Attorney, Agent, or Firm* — Nolte Lackenbach Siegel

(57) ABSTRACT

A flow control apparatus for producing hydrocarbon material from a subterranean formation is disclosed. The apparatus includes a housing that defines a housing passage, and a flow communicator that extends through the housing for effecting fluid communication between the housing passage and the subterranean formation. The apparatus includes a flow controller within the housing for modulating flow communication between the housing passage and the subterranean formation via the flow communicator. The flow controller includes a filter medium-defining counterpart and a shroud-defining counterpart, and the filter medium-defining counterpart has a filter medium. The flow controller is configurable for disposition relative to the flow communicator to open, close, or screen the flow communicator. While the filter medium and the flow communicator are not aligned, the housing and shroud-defining counterpart shields the filter medium from the housing passage and the external environment.

19 Claims, 41 Drawing Sheets

Related U.S. Application Data

(60) Provisional application No. 62/946,155, filed on Dec. 10, 2019, provisional application No. 62/815,595, filed on Mar. 8, 2019.

(56) References Cited

U.S. PATENT DOCUMENTS 4,429,747 A * 2/1984 Williamson, Jr. ..... E21B 34/14 166/321
4,945,995 A * 8/1990 Tholance ..... E21B 43/14 166/321
6,293,342 B1 * 9/2001 McGarian ..... E21B 21/10 166/317
6,422,317 B1 * 7/2002 Williamson, Jr. ..... E21B 34/14 166/373
7,703,510 B2 * 4/2010 Xu ..... E21B 34/142 166/308.1
8,776,884 B2 * 7/2014 Xu ..... E21B 21/10 166/305.1
9,428,991 B1 8/2016 Abi Aad
9,574,421 B1 * 2/2017 Saraya ..... E21B 34/142
9,850,742 B2 * 12/2017 Beck ..... E21B 34/14
10,260,314 B2 * 4/2019 Saraya ..... E21B 34/102
10,400,555 B2 * 9/2019 Saraya ..... E21B 34/102
10,662,739 B2 * 5/2020 Saraya ..... E21B 34/142
11,319,776 B2 * 5/2022 Saraya ..... E21B 34/142
11,352,853 B2 * 6/2022 Maddux ..... E21B 34/063
11,459,855 B2 * 10/2022 Saraya ..... E21B 34/142
2007/0261862 A1 * 11/2007 Murray ..... E21B 34/063 166/386
2007/0272411 A1 11/2007 De Cardenas
2008/0302533 A1 12/2008 Richard
2009/0014185 A1 * 1/2009 Franco ..... E21B 34/10 166/373
2009/0044944 A1 * 2/2009 Murray ..... E21B 43/12 166/308.1
2009/0056934 A1 * 3/2009 Xu ..... E21B 43/26 166/194
2009/0084553 A1 * 4/2009 Rytlewski ..... E21B 43/08 166/305.1
2009/0095486 A1 * 4/2009 Williamson, Jr. ..... E21B 34/10 166/373
2009/0139717 A1 6/2009 Richard
2010/0224371 A1 * 9/2010 Swan ..... E21B 34/10 166/373
2011/0284232 A1 * 11/2011 Huang ..... E21B 34/06 977/775
2012/0012322 A1 * 1/2012 Korkmaz ..... E21B 43/26 166/308.1
2012/0048556 A1 * 3/2012 O'Connell ..... F16K 17/406 166/308.1
2012/0132426 A1 * 5/2012 Xu ..... E21B 34/063 166/305.1
2012/0279723 A1 * 11/2012 Hofman ..... E21B 34/063 166/373
2013/0056206 A1 * 3/2013 Jackson ..... E21B 34/102 166/373
2013/0319687 A1 12/2013 Huh
2014/0076578 A1 * 3/2014 Hofman ..... E21B 34/10 166/373
2015/0021026 A1 * 1/2015 Giroux ..... E21B 34/063 166/177.4
2015/0053408 A1 * 2/2015 Purkis ..... E21B 34/14 166/308.1
2015/0122489 A1 * 5/2015 Wood ..... E21B 34/12 166/381
2015/0122493 A1 * 5/2015 Wood ..... E21B 43/26 166/279
2015/0233208 A1 * 8/2015 Muscroft ..... E21B 34/063 166/321
2015/0233210 A1 * 8/2015 Beck ..... E21B 34/102 166/373
2016/0273319 A1 9/2016 Werries
2017/0370185 A1 * 12/2017 Saraya ..... E21B 43/14
2018/0298728 A1 * 10/2018 Saraya ..... E21B 34/142
2018/0328140 A1 * 11/2018 Schmidt ..... E21B 21/103
2019/0071953 A1 * 3/2019 Saraya ..... E21B 43/26
2019/0178053 A1 * 6/2019 Saraya ..... E21B 34/10
2019/0203566 A1 * 7/2019 Saraya ..... E21B 43/08
2020/0399985 A1 * 12/2020 Saraya ..... E21B 34/063
2021/0189835 A1 * 6/2021 Maddux ..... E21B 34/14

* cited by examiner

DOWNHOLE FLOW CONTROLLER

CROSS-REFERENCE TO RELATED APPLICATIONS

The present application is a continuation to U.S. application Ser. No. 17/437,325 filed Sep. 8, 2021, the contents of all of which are incorporated by reference herein in their entirety. U.S. application Ser. No. 17/437,325 is a Section 371 nationalization of International Application PCT/CA2020/050298, filed Mar. 6, 2020, which claimed the benefit of priority to U.S. Provisional Patent Application No. 62/815,595, filed on Mar. 8, 2019, and also claimed the benefit of priority to U.S. Provisional Patent Application No. 62/946,155, filed on Dec. 10, 2019. The contents of the above-reference provisional applications are hereby expressly incorporate into the present application by reference in their entirety.

FIELD

The present disclosure relates to apparatuses, systems and methods for producing hydrocarbon material from a subterranean formation.

BACKGROUND

Production wells may be drilled into oil-bearing zones of a subterranean formation to produce hydrocarbon material. A production system, such as one having a port and a sleeve that opens and closes the port, may be used to stimulate the subterranean formation, and to produce the hydrocarbon material. The production system may inject stimulant into the subterranean formation via the port, and produce hydrocarbon material from the stimulated subterranean formation via the same port. When producing the hydrocarbon material, a screen may be positioned over the port to filter materials from entering the production well. The sleeve may include the screen, such that the sleeve may be displaced to position the screen over the port.

Various systems have been developed to screen the port during the production of hydrocarbon material. Unfortunately, existing systems do not naturally shroud the screen during installation, such that while underdoing a cementing operation, the screen may be exposed to cement and may be rendered inoperable. Accordingly, existing systems require additional screen protection. Further, if materials are trapped in the screen, it may affect displacement of the sleeve on which the screen is installed. In addition, if materials are trapped in the screen, after production of hydrocarbon materials, the sleeve of the existing systems may be difficult to manipulate.

SUMMARY

In one aspect, there is provided a flow control apparatus comprising: a housing including a housing passage and a flow communicator for effecting flow communication between an environment external to the housing and the housing passage; a flow controller, for controlling flow communication, via the flow communicator, between the housing passage and the external environment, including: a filter medium-defining counterpart; and a shroud-defining counterpart; wherein: the filter medium-defining counterpart and the shroud-defining counterpart are co-operatively configured for being disposed in a releasably coupled configuration, wherein, in the releasably coupled configuration, the filter medium-defining counterpart is displaceable with the shroud-defining counterpart; the housing and the flow controller are co-operatively configured such that, while the filter medium-defining counterpart and the shroud-defining counterpart are co-operating to define the releasably coupled configuration, and a force is being applied to the shroud-defining counterpart with effect that the shroud-defining counterpart is being displaced through the housing passage and the filter medium-defining counterpart is being displaced with the filter medium-defining counterpart: the filter medium-defining counterpart becomes retained relative to the housing, with effect that: the filter medium-defining counterpart is released from the shroud-defining counterpart such that the filter medium-defining counterpart and the shroud-defining counterpart become independently displaceable relative to one another; and the filter medium-defining counterpart is disposed relative to the flow communicator with effect that a flowpath becomes defined, via the flow communicator, between the external environment and the filter medium-defining counterpart.

In another aspect, there is provided a flow control apparatus, configurable in at least a closed configuration and a production configuration, comprising: a housing including a housing passage and a flow communicator for effecting flow communication between an environment external to the housing and the housing passage; a flow controller for controlling flow communication, via the flow communicator, between the housing passage and the external environment, including: a filter medium-defining counterpart defining a filter medium; and a shroud-defining counterpart defining a shroud; wherein: while the flow control apparatus is disposed in the closed configuration, the flow communicator and the flow controller are co-operatively disposed such that the flow communicator is disposed in a closed condition, and the filter medium-defining counterpart and the shroud-defining counterpart are co-operatively disposed such that the shroud shields the filter medium from material within the housing passage; and while the flow control apparatus is disposed in the production configuration, the flow communicator and the flow controller are co-operatively disposed such that flow communication, via the filter medium, is effected between the external environment and the housing passage.

In another aspect, there is provided a flow control apparatus comprising: a housing including a housing passage and a flow communicator for effecting flow communication between an environment external to the housing and the housing passage; a flow controller, disposed within the housing passage, for controlling flow communication, via the flow communicator, between the housing passage and the external environment, including: a filter medium-defining counterpart; a shroud-defining counterpart; and a coupling effector, extending from the filter medium-defining counterpart, and biased in an outwardly direction; wherein: the housing defines a coupling-stimulating profile; the shroud-defining counterpart defines a coupling profile; the housing, the filter medium-defining counterpart, and the shroud-defining counterpart, are co-operatively configured such that, while the coupling-stimulating profile is disposed in alignment with the coupling effector, the coupling-stimulating profile urges the coupling effector in an inwardly direction with effect that the coupling effector interacts with the coupling-profile.

In another aspect, there is provided a flow control apparatus, configurable in at least a closed flow communicator configuration and a production configuration, comprising: a housing including a housing passage and a flow communicator for effecting flow communication between an environment external to the housing and the housing passage; a flow controller for controlling flow communication, via the flow communicator, between the housing passage and the external environment, including: a filter medium-defining counterpart defining a filter medium; and a shroud-defining counterpart defining a shroud; wherein: while the flow control apparatus is disposed in the closed flow communicator configuration, the flow communicator and the flow controller are co-operatively disposed such that the flow communicator is disposed in a closed condition, and the filter medium-defining counterpart and the shroud-defining counterpart are co-operatively disposed such that the shroud shields the filter medium from material within the housing and such that the housing shields the filter medium from the external environment; and while the flow control apparatus is disposed in the production configuration, the flow communicator and the flow controller are co-operatively disposed such that flow communication, via the filter medium, is effected between the external environment and the housing passage.

In another aspect, there is provided a flow control apparatus comprising: a housing including a housing passage and a flow communicator for effecting flow communication between an environment external to the housing and the housing passage; a flow controller, for controlling flow communication, via the flow communicator, between the housing passage and the external environment, including: a flow communicator-occluding counterpart including degradable material; and a filter medium-defining counterpart including a filter medium; wherein: the flow communicator-occluding counterpart is occluding the flow communicator such that the flow communicator is disposed in a closed condition; degradable material is responsive to communication with a degradation promotion agent; while the degradable material is disposed in communication with a degradation promotion agent, degradation of the degradable material is effected, such that the flow communicator becomes disposed in the open condition; the filter medium counterpart is disposed relative to the flow communicator such that there is an absence of alignment between the filter medium and the flow communicator; the filter medium counterpart is displaceable relative to the flow communicator, with effect that the filter medium is aligned with the flow communicator; and while the flow communicator is disposed in the open condition, and the filter medium is aligned with the flow communicator, the filter medium is disposed for filtering solid material from fluid material that is being conducted, via the flow communicator, from the environment external to the housing to the housing passage.

In another aspect, there is provided a flow control apparatus comprising: a housing including a housing passage and a flow communicator for effecting flow communication between an environment external to the housing and the housing passage; a flow controller, for controlling flow communication, via the flow communicator, between the housing passage and the external environment, including: a flow communicator occluding counterpart including an occluding portion; a filter medium-defining counterpart including a filter medium; a driving counterpart; wherein: the occluding portion is occluding the flow communicator such that the flow communicator is disposed in the closed condition; viscous fluid is disposed within a space defined between the flow communicator occluding counterpart and the filter medium-defining counterpart; the flow communicator occluding counterpart is displaceable with the driving counterpart in a first direction; the driving counterpart defines a throughbore; in response to displacement of the driving counterpart relative to the flow communicator: (i) the flow communicator occluding counterpart is displaced with the driving counterpart such that displacement of the viscous fluid is urged remotely from the space via the throughbore; and (ii) the driving counterpart becomes disposed relative to the filter medium-defining counterpart such that the filter medium-defining counterpart is displaceable, relative to the flow communicator, in a second direction that is opposite to the first direction; and while the displaceability of the filter medium-defining counterpart with the driving counterpart is established, in response to displacement of the driving counterpart, relative to the flow communicator, in the second direction, the filter medium of the filter medium-defining counterpart becomes disposed in alignment with the flow communicator; and the shroud-defining counterpart are co-operatively configured for being disposed in a releasably coupled configuration, wherein, in the releasably coupled configuration, the filter medium-defining counterpart is translatable with the shroud-defining counterpart; the housing and the flow controller are co-operatively configured such that, while the filter medium-defining counterpart and the shroud-defining counterpart are co-operating to define the releasably coupled configuration, and a force is being applied to the shroud-defining counterpart with effect that the shroud-defining counterpart is being displaced through the housing passage and the filter medium-defining counterpart is being displaced with the filter medium-defining counterpart: the filter medium-defining counterpart becomes retained relative to the housing, with effect that: the filter medium-defining counterpart is released from the shroud-defining counterpart such that the filter medium-defining counterpart and the shroud-defining counterpart become independently displaceable relative to one another; and the filter medium-defining counterpart is disposed relative to the flow communicator with effect that a flowpath becomes defined, via the flow communicator, between the external environment and the filter medium.

Other aspects will be apparent from the description and drawings provided herein.

BRIEF DESCRIPTION OF DRAWINGS

In the figures, which illustrate example embodiments.

DETAILED DESCRIPTION

Figure 1:
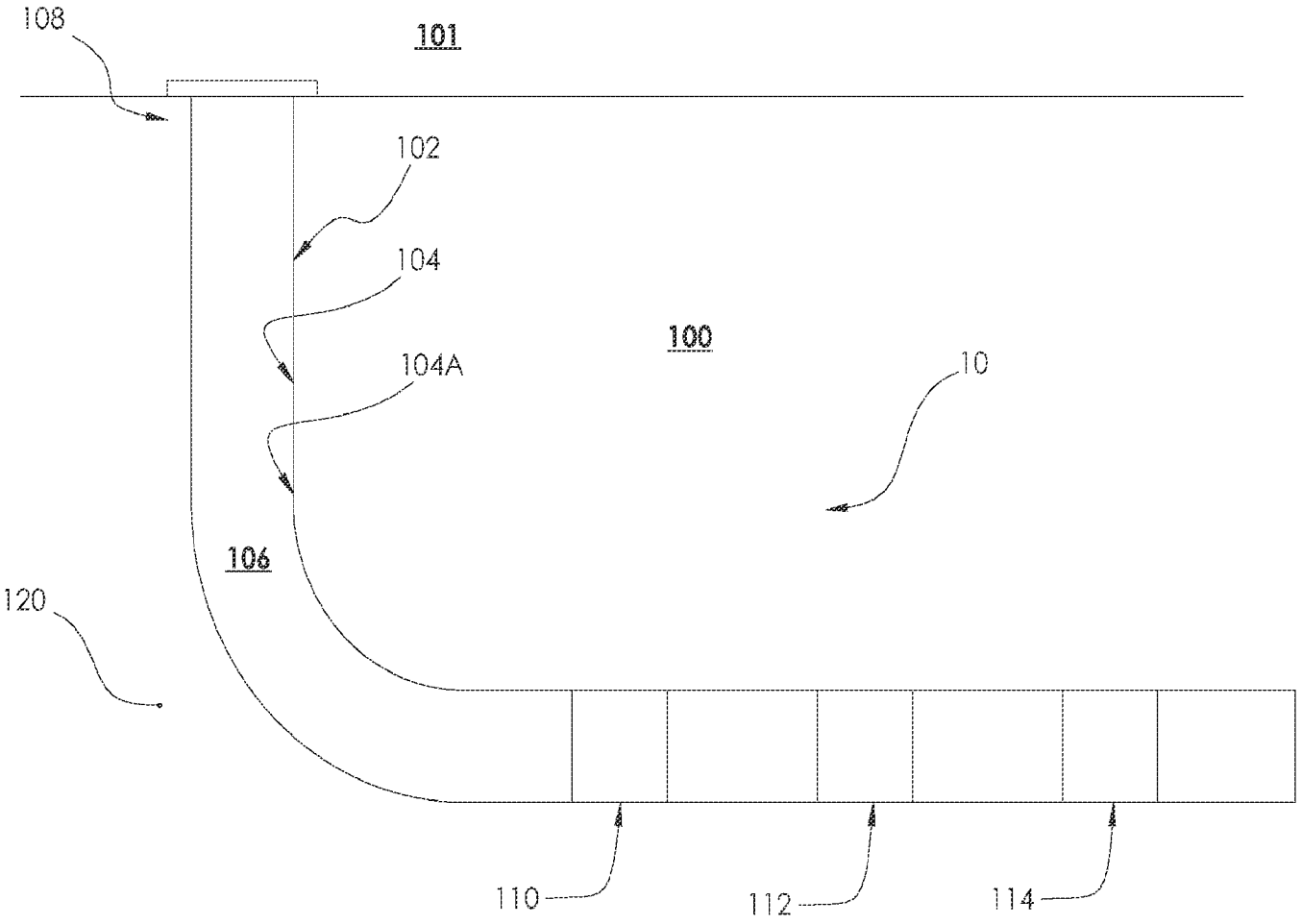
FIG. 1 is a schematic of a system for effecting production of hydrocarbon material from a subterranean formation.

As used herein, the terms "up", "upward", "upper", or "uphole", refer to positions or directions in closer proximity to the surface and further away from the bottom of a wellbore, when measured along the longitudinal axis of the wellbore. The terms "down", "downward", "lower", or "downhole" refer to positions or directions further away from the surface and in closer proximity to the bottom of the wellbore, when measured along the longitudinal axis of the wellbore.

A flow control apparatus 200 for producing hydrocarbon material from a subterranean formation 100 is disclosed. The flow control apparatus 200 includes a housing 202. The housing 202 defines a fluid passage 224. A flow communicator 210 (such as, for example, in the form of one or more ports) extends through the housing 202 for effecting flow communication between the fluid passage 224 and the subterranean formation 100. The flow control apparatus 200 further includes a flow controller 250 disposed within the housing 202. The flow controller 250 is configured for modulating flow communication, between the housing passage 224 and the subterranean formation 100, which is effectible via the flow communicator 210.

In some embodiments, for example, the flow controller 250 includes a filter medium-defining part 251. The filter medium-defining part 251 includes a filter medium 302.

In some embodiments, for example, the filter medium 302 functions to prevent passage of oversize solid particulate matter from a first side of the filter medium-defining counterpart 300 to a second opposite side of the filter medium-defining counterpart 300. Relatedly, the filter medium 302 functions to prevent passage of oversize solid particulate matter from the subterranean formation 100 and into the housing passage 224 via the flow communicator 210. In some embodiments, for example, the oversize solid particulate matter, whose passage is prevented, is +100 mesh proppant. This is to mitigate plugging of the flow control apparatus 200 or the wellbore 102 during production of hydrocarbon materials. In this respect, the filter medium-defining part 251 functions as a debris retention device.

Figure 7:
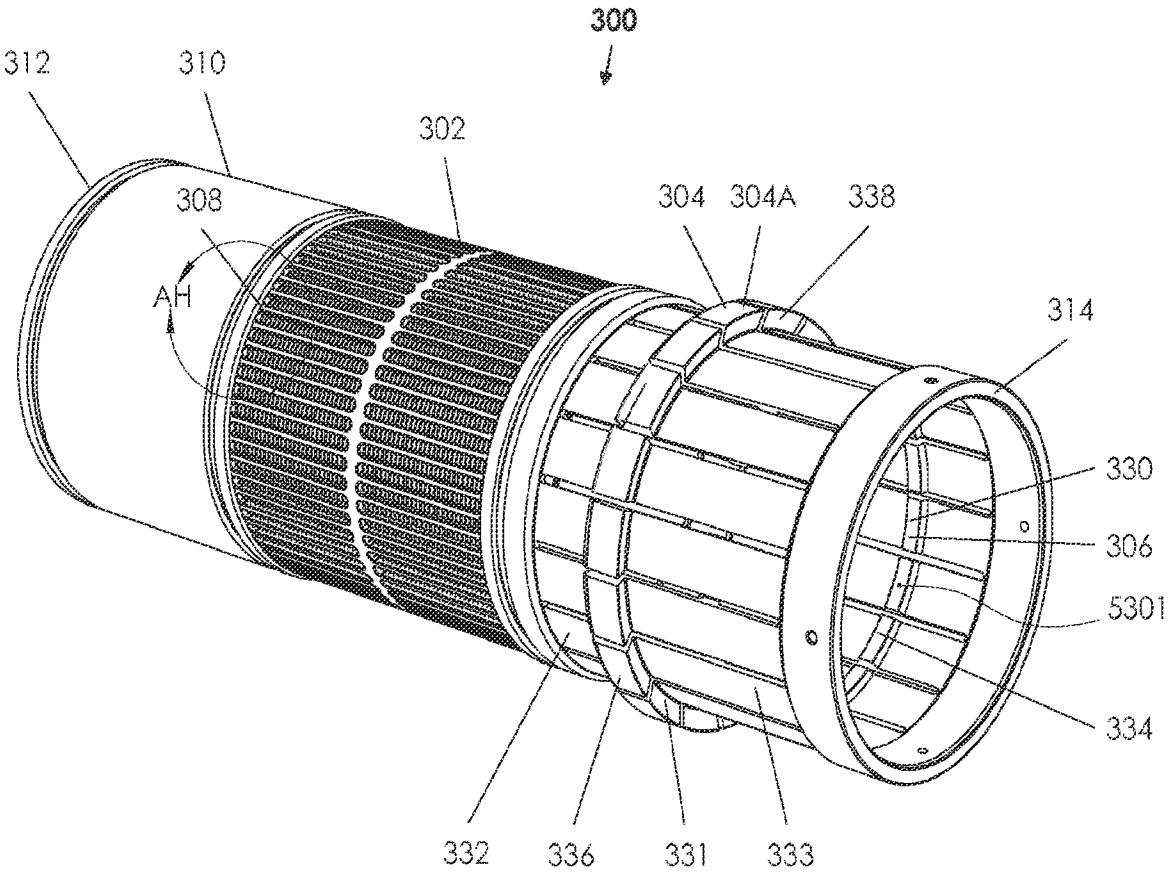
FIG. 7 is a perspective view of the filter medium-defining counterpart of FIG. 5.

In some embodiments, for example, the filter medium 302 is defined by slots formed in the filter medium-defining counterpart 300 by milling. As depicted in FIG. 7, an example filter medium 302 is formed by milling a number of slots along the circumferential surface of the filter medium-defining counterpart 300. As depicted in FIG. 7, in some embodiments, the filter medium 302 is continuous about the entire circumference of a portion of the filter medium-defining counterpart 300. In some embodiments, for example, the filter medium 302 is not continuous about the entire circumference of a portion of the filter medium-defining counterpart 300. In some embodiments, for example, the filter medium 302 is staggered circumferentially about a portion of the filter medium-defining counterpart 300.

In some embodiments, for example, the filter medium 302 is defined by a screen (such as, for example, a sand screen). In some of these embodiments, for example, the screen is wrapped about a perforated section of a base pipe (such as, a base pipe that is defined by the filter medium-defining counterpart 300), the perforated section defining a plurality of apertures. In some embodiments, for example, the screen is a sand screen.

In some embodiments, the filter medium 302 is in the form of a porous material that is integrated within an aperture of the filter medium-defining counterpart 300.

Figure 8:
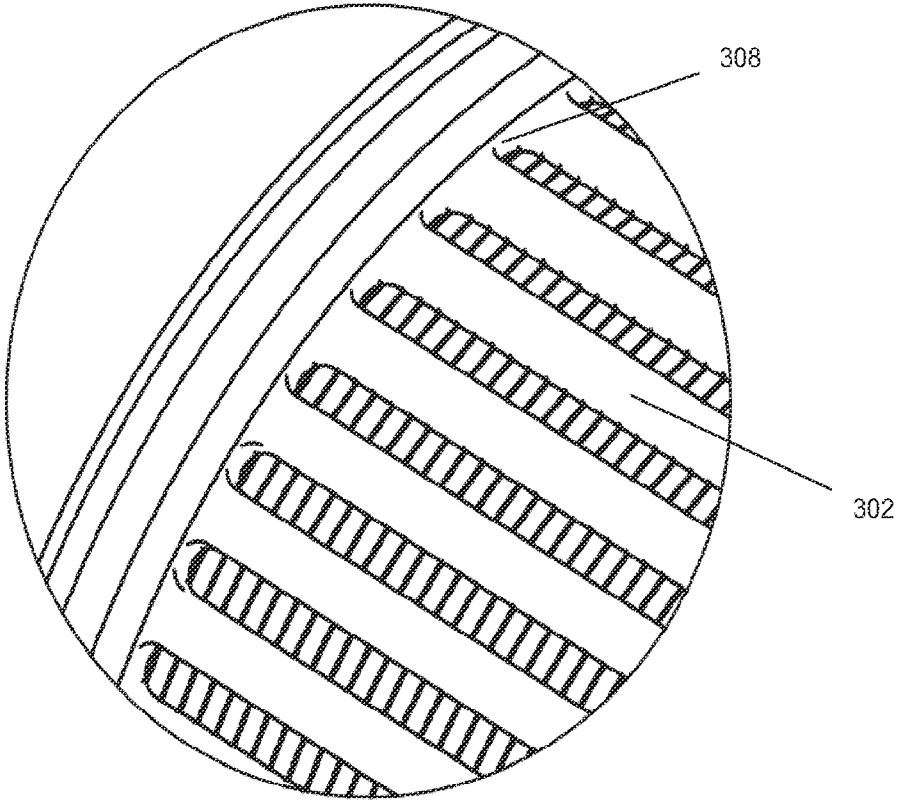
FIG. 8 is an enlarged view of the portion of the filter medium-defining counterpart of FIG. 7, the portion identified by window AH shown in FIG. 7.

In some embodiments, for example, the filter medium 302 is manufactured by machining of the filter medium-defining counterpart 300. In such embodiments, a threading with an inverted V edge 308 is machined onto an inner surface of the filter medium 302, and longitudinal slots are machined along the length of the outer surface, as depicted in FIGS. 7 and 8. In some embodiments, for example, the inverted V edge 308 mitigates trapping of particles that flow through the filter medium 302, and reduces clogging of the filter medium 302. In some embodiments, for example, the threading with the inverted V edge 308 and the longitudinal slots are co operatively configured to provide structural support to the filter medium 302.

Figure 18:
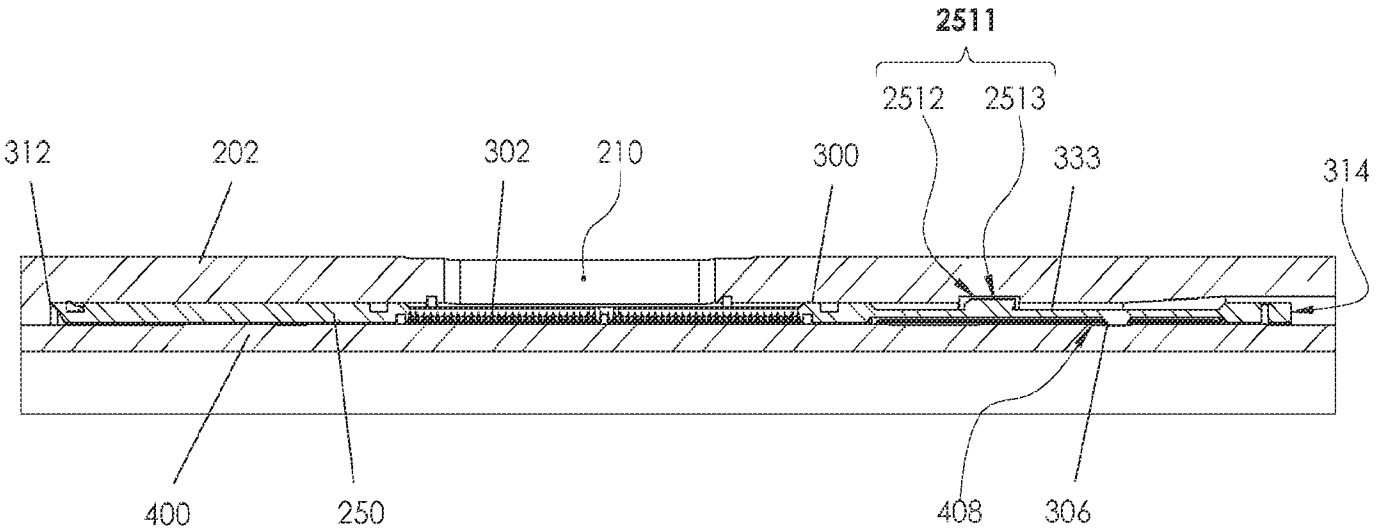
FIG. 18 is an enlarged view of the portion of the flow control apparatus of FIG. 17, the portion identified by window T shown in FIG. 15.

Referring to FIG. 18, in some embodiments, for example, a filter medium-positioning system 2511 is provided for effecting retention of the filter medium-defining part 251, relative to the housing 202, for effecting filtering of solids, from hydrocarbon material being produced from the subterranean formation 100, by the filtering medium 302. The filter medium-positioning system 2511 includes a first positioning system counterpart 2512 and a second positioning system counterpart 2513. In some embodiments, for example, the first positioning system counterpart 2512 is a filter medium-defining part-positioning profile 236 defined by the housing 202, and the second positioning system counterpart 2513 is a retainable profile engager 304 defined by the filter medium-defining part 251. Correspondingly, the retainable profile engager 304 is configured for becoming disposed within the filter medium-defining part-retaining profile 236 for effecting retention of the filter medium-defining part 251 relative to the housing 202. The flow communicator 210, the filter medium 302, the filter medium-defining part-retaining profile 236, and the retainable profile engager 304 are co-operatively configured such that, while the filter medium-defining part 251 is being displaced relative to the filter medium-defining part-retaining profile 236 (for example, along an axis that is parallel to the axis 226), in response to alignment of the retainable profile engager 304 within the filter medium-defining part-retaining profile 236, the retainable profile engager 304 becomes disposed within the filter medium-defining part-retaining profile 236, with effect that the filtering medium 302 becomes disposed relative to the flow communicator 210 (for example, the filtering medium 302 becomes disposed in alignment with the flow communicator 210), such that retention of the filtering medium 302, relative to the flow communicator 210, is effected, and flow communication, between the subterranean formation 100 and the housing passage 224, becomes established via the flow communicator 210, and hydrocarbon material, that is conductible via the flow communicator 210, from the subterranean formation to the housing passage 224 is filterable by the filter medium 302 (i.e. the production configuration (see FIGS. 21 and 26) is obtained).

Figure 19:
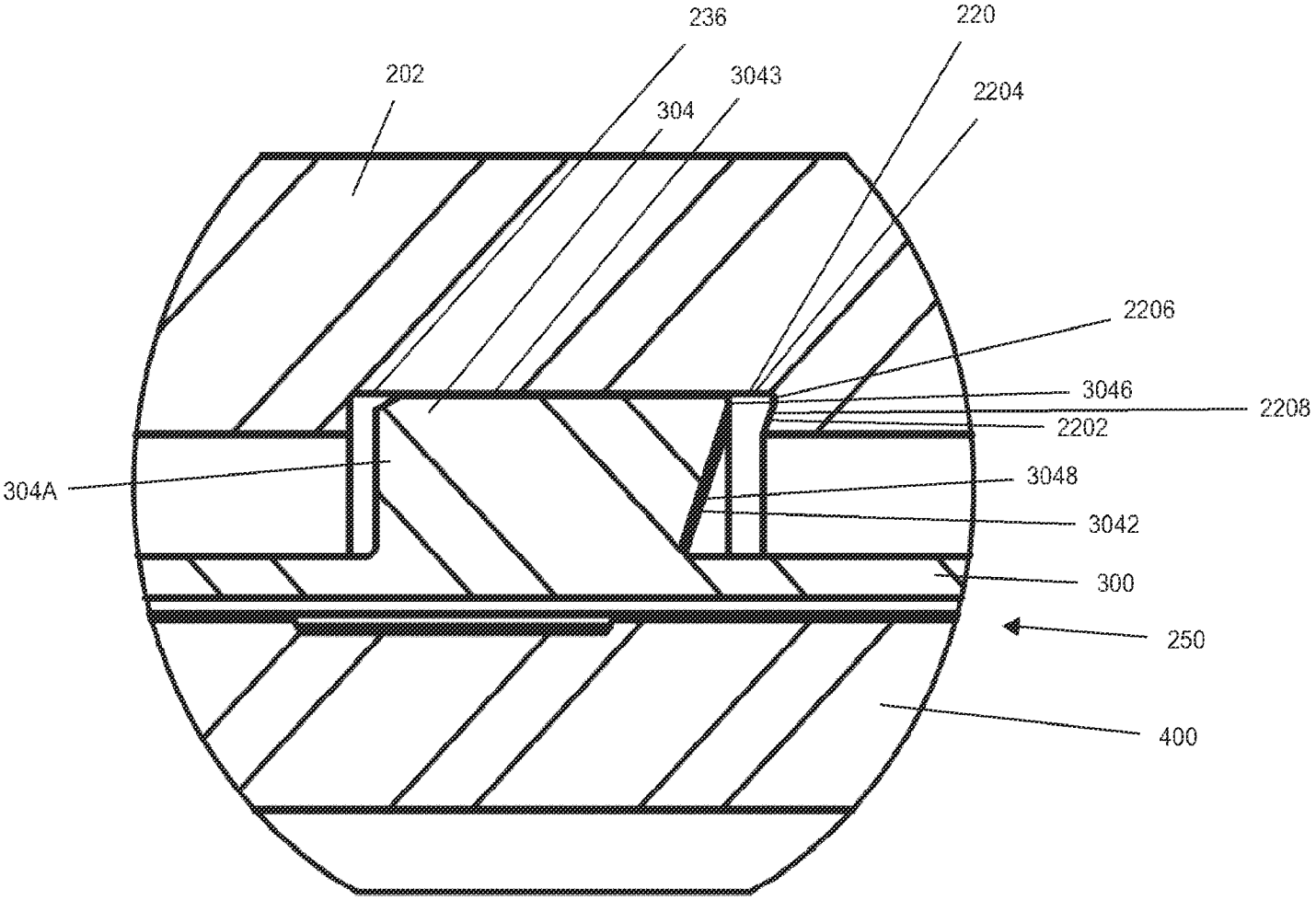
FIG. 19 is an enlarged view of the portion of the flow control apparatus of FIG. 18, the portion identified by window U shown in FIG. 18.
Figure 20:
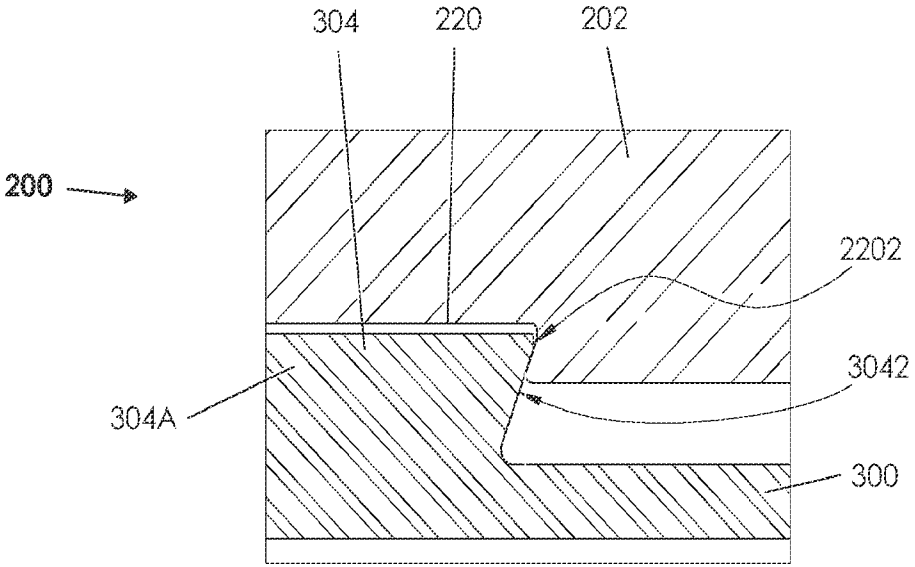
FIG. 20 is a schematic of the filter medium-defining counterpart retained relative to the housing.
Figure 22:
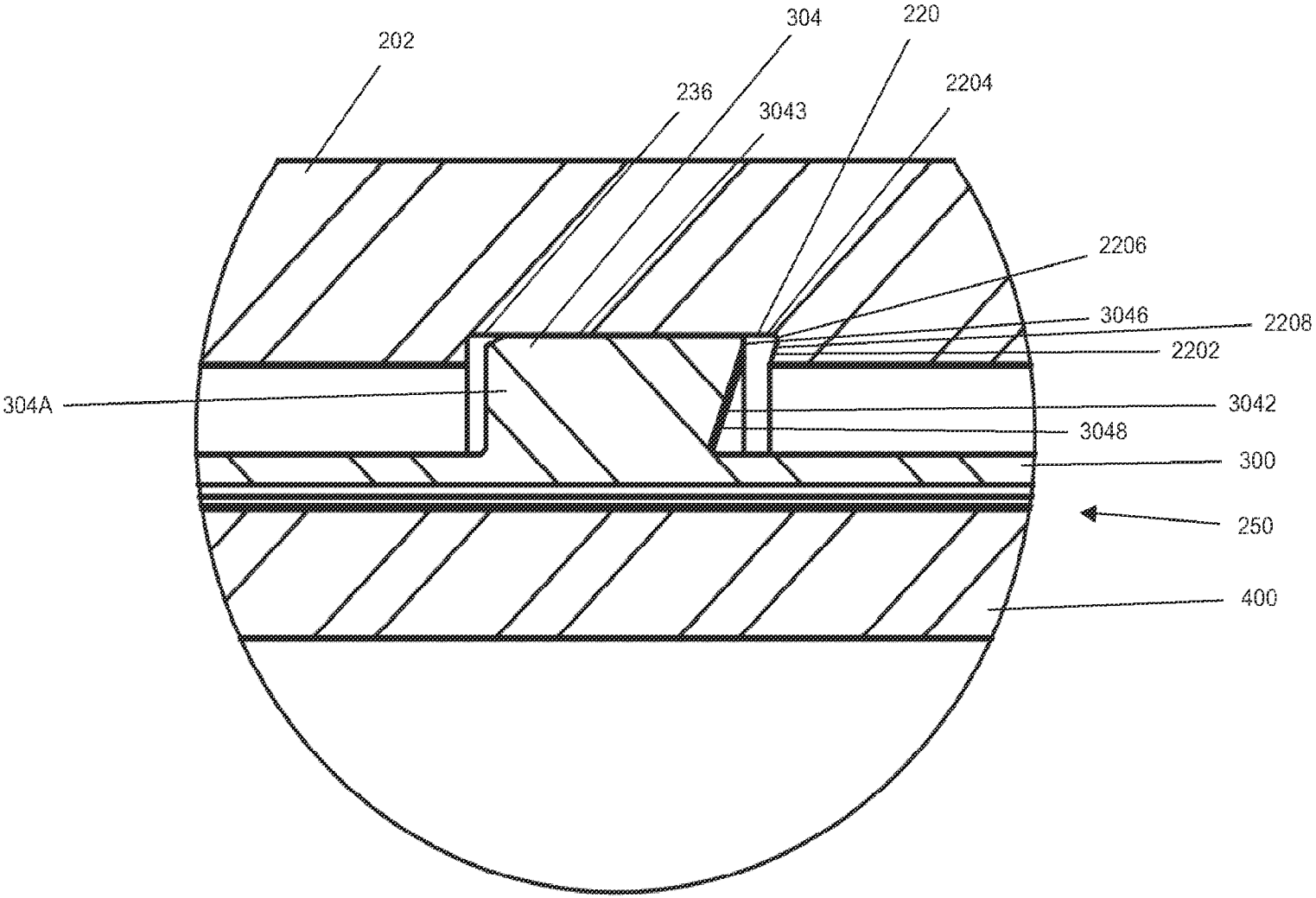
FIG. 22 is an enlarged view of the portion of the flow control apparatus of FIG. 21, the portion identified by window Z shown in FIG. 21.

In some embodiments, for example, the filter medium-defining part-retaining profile 236 defines a filter medium-defining part-retaining profile-defined recess 220 extending into the passage-defining surface 232 of the housing 202, and the disposition of the retainable profile engager 304 within the filter medium-defining part-retaining profile 236 includes disposition of the retainable profile engager 304 within the filter medium-defining part-retaining profile-defined recess 220. Referring to FIGS. 19, 20, and 22, in some embodiments, for example, the recess 220 has a surface 2202 that is tapered or angled in a direction that is opposite the first direction. In some embodiments, for example, as depicted in FIG. 19, the surface 2202 is angled in a direction towards an uphole end 200A of the flow control apparatus 200. In some embodiments, the surface 2202 is complementary with a surface of the retainable profile engager 304, such as a surface 3042, as depicted in FIGS. 19 and 22, wherein the surface 2202 and a surface of the retainable profile engager 304 are co operatively configured such that, in response to the receiving of the retainable profile engager 304 within the recess 220, the retention of the retainable profile engager 304 is effectible upon engagement of the surface 2202 and the surface of the retainable profile engager 304, As depicted in FIGS. 19, 20, and 22, the surface 2202 is angled with respect to the axis 226. In some embodiments, for example, the surface 2202 is disposed relative to a surface of the retainable profile engager 304, such as in abutting engagement with the surface of the retainable profile engager 304, to resist release of the retainable profile engager 304 from the recess 220 in response to a force being applied in the first direction (e.g. the downhole direction). In some embodiments, for example, the angles defined between the surfaces 2202 and 3042 relative to the central longitudinal axis 226 of the housing 202 and the central longitudinal axis 316 of the filter medium-defining part 251, respectively, are based on, among other considerations, the amount of force to be applied to the filter medium-defining part 251 to displace the filter medium-defining part 251, the amount of force to be applied to the filter medium-defining part 251 to release the filter medium-defining part 251 from retention, the amount of displacement of the filter medium-defining part 251, and the amount of force to be resisted to maintain retention of the filter medium-defining part 251 and the housing 202 by the disposition of the retainable profile engager 304 within the filter medium-defining part-retaining profile 236, during operation of the flow control apparatus 200. In some embodiments, for example, the surfaces 2202 and 3042 define angles of 70° relative to the central longitudinal axis 226 of the housing 202 and the central longitudinal axis 316 of the filter medium-defining part 251, respectively. In some embodiments, for example, the surfaces 2202 and 3042 define angles of greater than 70° relative to the central longitudinal axis 226 of the housing 202 and the central longitudinal axis 316 of the filter medium-defining part 251, respectively. In some embodiments, for example, the surfaces 2202 and 3042 define angles of less than 70° relative to the central longitudinal axis 226 of the housing 202 and the central longitudinal axis 316 of the filter medium-defining part 251, respectively.

In some embodiments, for example, the surface 2202 is an angled surface relative to a surface 2204 of the filter medium-defining part-retaining profile-defined recess 220, and the entire surface 2202 is angled relative to the surface 2204. Where the surface 2202 and the surface 2204 meet, a knife edge may be defined. Similarly, the surface 3042 is an angled surface relative to a surface 3043 of the of the retainable profile engager 304, and the entire surface 3042 is angled relative to the surface 3043. Where the surface 3042 and the surface 3043 meet, a knife edge may be defined. In some embodiments, for example, upon engagement of the retainable profile engager 304 and the filter medium-defining part-retaining profile-defined recess 220, mushroom damage is present on the knife edge defined between the surface 2202 and the surface 2204 and the knife edge defined between the surface 3042 and 3043. In some embodiments, for example, as depicted in FIG. 19 and FIG. 22, the surface 2202 has an angled portion 2208 and a perpendicular portion 2206, where the perpendicular portion 2206 of the surface 2202 is perpendicular, or substantially perpendicular, relative to the central longitudinal axis 226 of the housing 202. In such embodiments, the perpendicular portion 2206 is disposed between the surface 2204 and the angled portion 2208 of the surface 2202, such that the knife edge is absent or reduced at the joining of the surface 2202 and the surface 2204. Similarly, the surface 3042 has an angled portion 3048 and a perpendicular portion 3046, where the perpendicular portion 3046 of the surface 3042 is perpendicular, or substantially perpendicular, relative to the central longitudinal axis 316 of the filter medium-defining part 251, corresponds with the perpendicular portion 2206 of the surface 2202. In such embodiments, the perpendicular portion 3046 is disposed between the surface 3043 and the angled portion 3048 of the surface 3042, such that the knife edge is absent or reduced at the joining of the surface 3042 and the surface 3043. In such embodiments where the surface 2202 and the surface 3042 each has a perpendicular portion, the perpendicular portions 2206 and 3046 of the surface 2202 and the surface 3042 are co operatively configured to reduce or mitigate mushroom damage upon engagement of the retainable profile engager 304 and the filter medium-defining part-retaining profile-defined recess 220.

In some embodiments, for example, the retainable profile engager 304 includes one or more retainable engager members 304A extending in an outwardly (e.g. radially outwardly) direction relative to a central longitudinal axis 316 of the filter medium-defining part 251, as depicted in FIGS. 4, 5, 19, 20, and 22. In some embodiments, for example, each one of the one or more retainable engager members 304A, independently, extends from a respective one of the collet springs 332, such that, for each one of the one or more retainable engager members 304A, there is associated a corresponding coupling stimulating profile engager 336 and a corresponding shroud-defining counterpart engager 306. In some embodiments, for example, each one of the one or more retainable engager members 304A, independently, is stiffer than the respective collet spring 332 from which it extends. In some embodiments, for example, for each one of the one or more engager members 304A, independently, the retainable engager 304 is defined by the same protuberance 338 which defines the corresponding coupling stimulating profile engager member 336.

In some embodiments, for example, the disposition of the engager members 304A within the filter medium-defining part-retaining profile 236 is established in response to alignment between the engager members 304A and the filter medium-defining part-retaining profile 236. In response to the alignment, for each one of the engager members 304A, the material bias of the respective collet spring 332 urges the engager member 304A into disposition within the filter medium-defining part-retaining profile 236, as depicted in FIGS. 19 and 22.

Figure 21:
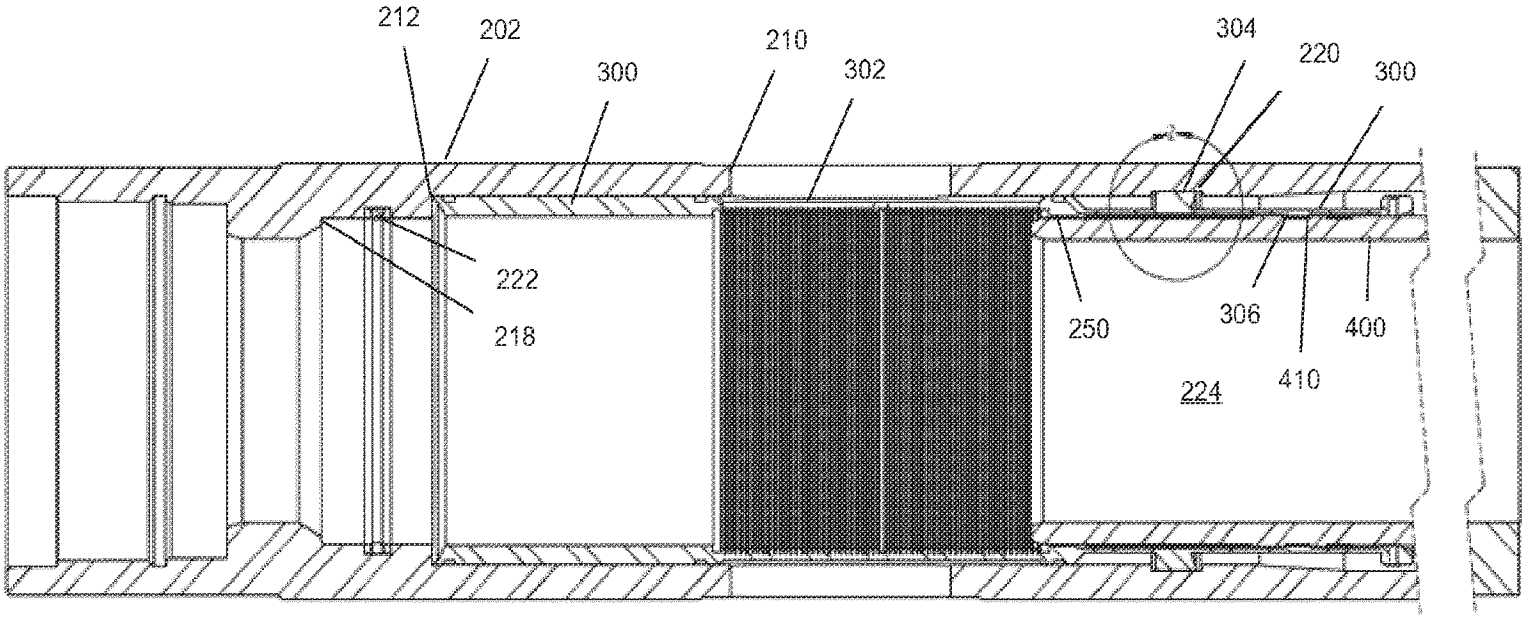
FIG. 21 a cross-sectional view of the flow control apparatus of FIG. 2, illustrating the apparatus in a production configuration.
Figure 23:
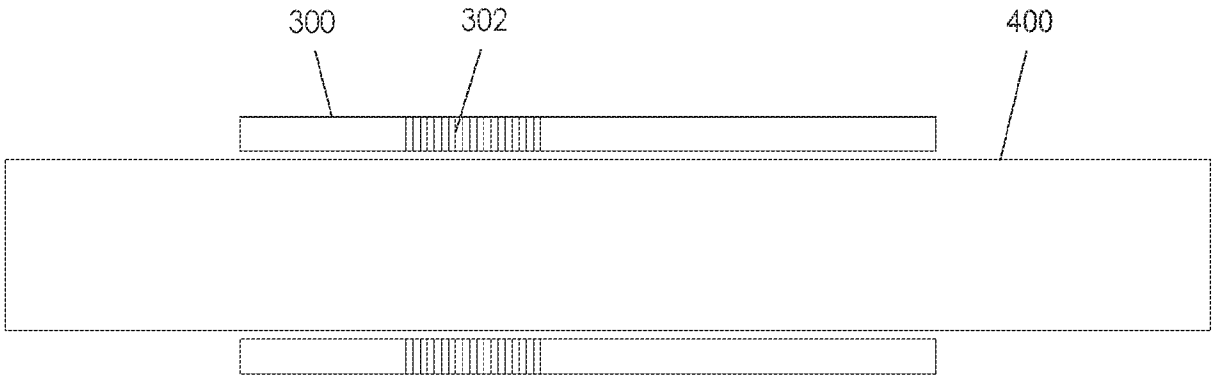
FIG. 23 is a schematic of the filter medium-defining counterpart and the shroud-defining counterpart when the flow control apparatus is in the installation configuration.
Figure 25:
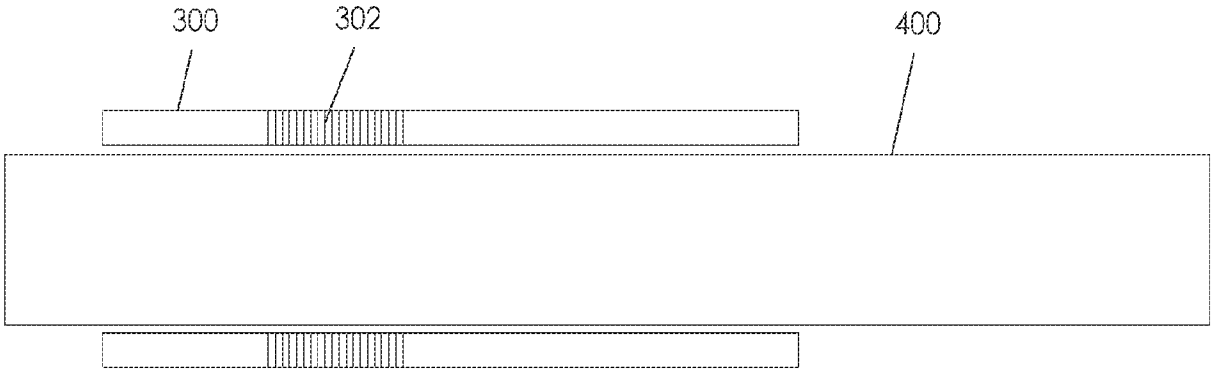
FIG. 25 is a schematic of the filter medium-defining counterpart and the shroud-defining counterpart when the flow control apparatus is in the closed configuration.
Figure 26:
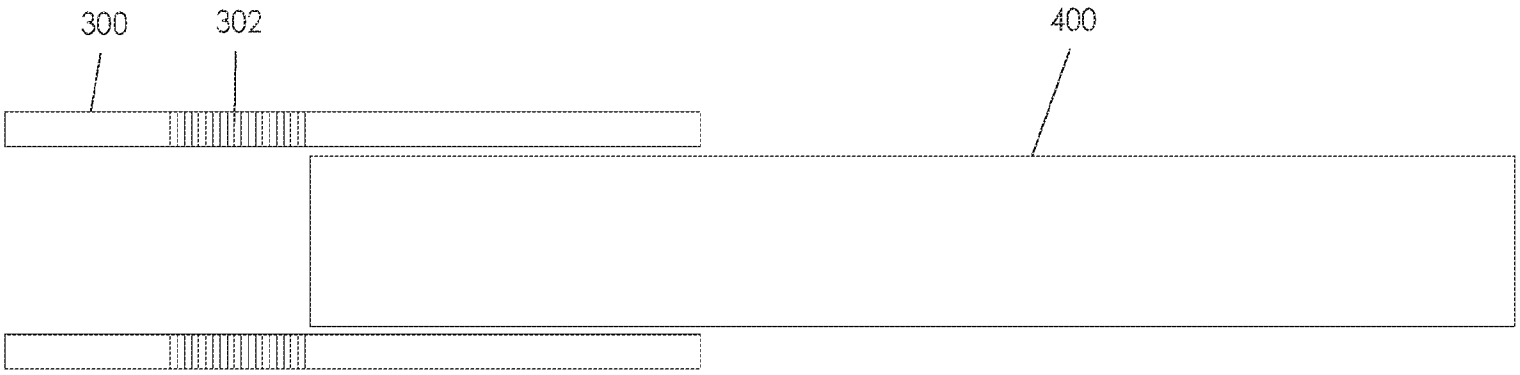
FIG. 26 is a schematic of the filter medium-defining counterpart and the shroud-defining counterpart when the flow control apparatus is in the production configuration.

The flow control apparatus 200 is configurable in an installation configuration (see FIGS. 2 and 23), an open configuration (see FIGS. 15 and 24), a closed configuration (see FIGS. 17 and 25), and a production configuration (see FIGS. 21 and 26).

In the installation configuration, the flow controller 250 is disposed relative to the flow communicator 210 such that the flow communicator 210 is disposed in a closed condition. In some embodiments, for example, disposition of the flow communicator 210 in the closed condition is with effect that there is an absence of flow communication, via the flow communicator 210, between the housing passage 224 and the subterranean formation 100. In some embodiments, for example, in the closed condition, flow communication between the housing passage 224 and the environment external to the housing 202 (for example, the subterranean formation 100), via the flow communicator 210, is sealed.

When it is desired to inject treatment material into the subterranean formation 100 via the flow communicator 210 of the flow control apparatus 200, the flow controller 250 is manipulated such that the flow control apparatus 200 becomes disposed in the open configuration. In the open configuration, the flow controller 250 is disposed relative to the flow communicator 210 such that there is flow communication between the housing passage 224 and the subterranean formation 100 via the flow communicator 210, such that treatment material, including solids (e.g. proppant) is injectable via the opened flow communicator 210 for stimulating production of hydrocarbon material from the subterranean formation 100. In this respect, while the flow control apparatus 200 is disposed in the open configuration, the filter medium 302 is disposed relative to the flow communicator 210 (for example, there is an absence of alignment between the filter medium 302 and the flow communicator 210) such that, while the treatment material is being injected into the subterranean formation via the flow communicator 210, there is an absence of filtering, by the filter medium 302, of solid material from the fluid material being conducted between the fluid passage 224 and the subterranean formation via the flow communicator 210.

After sufficient treatment material has been injected into the subterranean formation 100, and it is desired to stimulate another zone within the subterranean formation 100 via another flow control apparatus 200, the flow controller 250 is manipulated such that the flow control apparatus 200 becomes disposed in the closed configuration. Similar to the installation configuration, in the closed configuration, the flow communicator 210 is disposed in the closed condition. In some embodiments, for example, disposition of the flow communicator 210 in the closed condition is with effect that the flow controller 250 is disposed relative to the flow communicator 210 such that there is an absence of flow communication, via the flow communicator 210, between the housing passage 224 and the subterranean formation 100.

When it is desired to receive production of hydrocarbon material via the flow communicator 210, the flow controller 250 is manipulated such that the flow control apparatus 200 becomes disposed in the production configuration. While the flow control apparatus 200 is disposed in the production configuration, the filter medium 302 is disposed relative to the flow communicator 210 (such as, for example, in alignment with the flow communicator 210) with effect that, while hydrocarbon material is being conducted from the subterranean formation 100 to the fluid passage 224 via the flow communicator 210, solid material is being filtered by the filter medium 302, from the fluid material being conducted from the subterranean formation 100 to the housing passage 224 via the flow communicator 210.

Referring to FIGS. 2, 29, 31, and 32, in some embodiments, for example, the flow controller 250 includes a filter medium-defining counterpart 300, and the filter medium-defining counterpart 300 is defined by the filter medium-defining part 251. The flow controller 250 also includes a shroud-defining counterpart 400. The filter medium-defining counterpart 300 and the shroud-defining counterpart 400 are positionable relative to one another such that the apparatus 200 is configurable in a plurality of configurations, as described above.

The filter medium-defining counterpart 300 defines a filter medium-defining counterpart flow regulator 300A (see FIGS. 5, 29, 31, and 32) and, co-operatively, the shroud-defining counterpart 400 defines a shroud-defining counterpart flow regulator 400A (see FIGS. 12, 29, 31, and 32). The filter medium-defining counterpart flow regulator 300A includes the filter medium 302.

Figure 3:
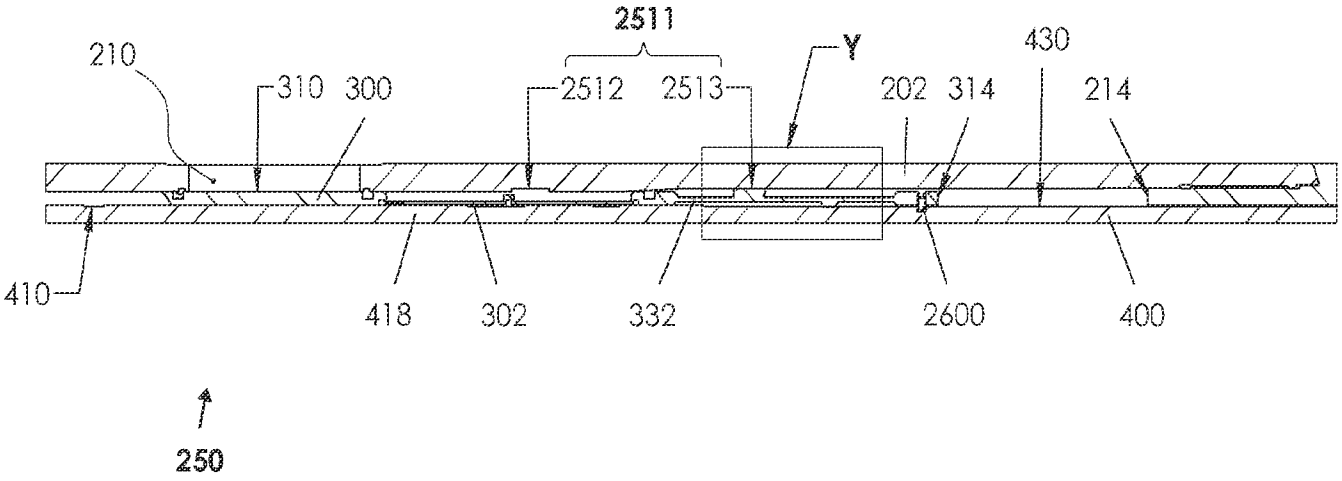
FIG. 3 is an enlarged view of the portion of the flow control apparatus of FIG. 2, the portion identified by window P shown in FIG. 2.

Referring to FIG. 3, in some embodiments, for example, the filter medium-defining counterpart flow regulator 300A includes an occluding portion 310 for occluding the flow communicator 210. The flow communicator 210 is disposed in the closed condition while the flow communicator 210 is occluded by the occluding portion 310.

Figure 2:
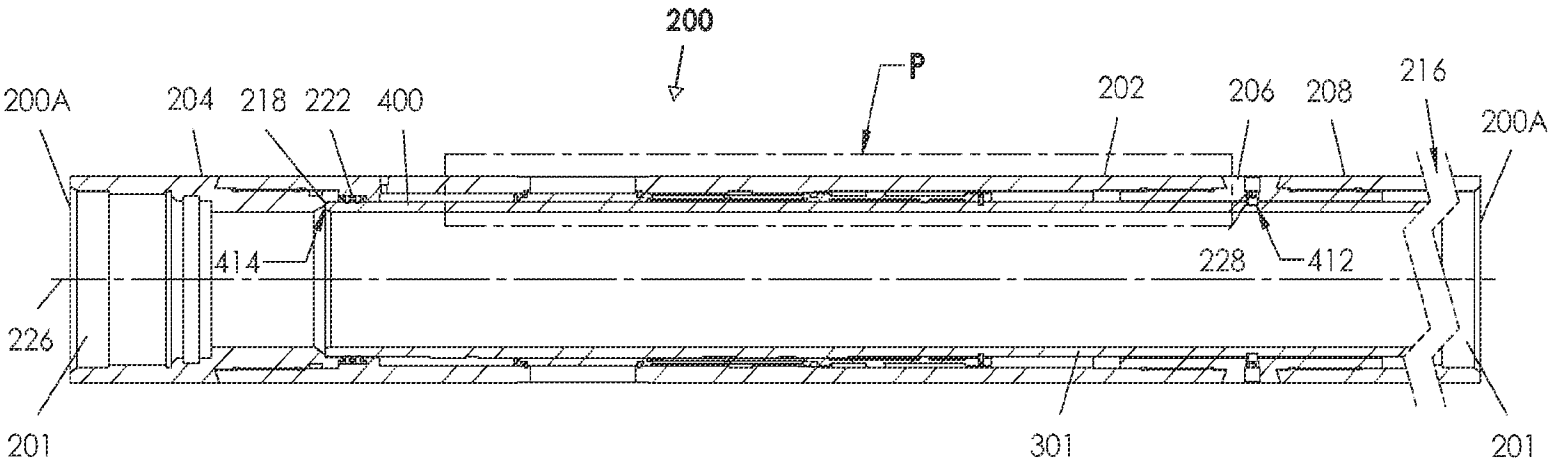
FIG. 2 is a cross-sectional view of an embodiment of a flow control apparatus for use within the system of FIG. 1, illustrating the apparatus in an installation configuration.

In those embodiments where flow communication between the housing passage 224 via the flow communicator 210, is sealed in the closed condition, in some of these embodiments, for example, sealed interfaces are defined. In some embodiments, in co-operation with the occluding portion 310, the sealed interfaces prevent flow communication between the flow communicator 210 and the housing passage 224. In some embodiments, the sealed interfaces are established by the disposition of the flow controller 250 relative to the housing 202. In this respect, in some embodiments, for example, the sealed interfaces are established by a sealed engagement of the shroud-defining counterpart 400 relative to the housing 202. In some embodiments, an uphole-disposed sealed interface is defined by an uphole-disposed sealing member 222 that is sealingly disposed between the shroud-defining counterpart 400 and the housing 202 at the uphole end of the flow controller 250, as depicted in FIG. 2. In some embodiments, the housing 202, for example, the top sub 204, defines a recess to receive the uphole-disposed sealing member 222. In some embodiments, a downhole-disposed sealed interface is defined by a downhole-disposed sealing member 222 that is sealingly disposed between the shroud-defining counterpart 400 and the housing 202 at the downhole end of the flow controller 250. In some embodiments, the downhole-disposed sealing member 222 is received in a recess defined by the housing 202, for example, the outer barrel 206 or the bottom sub 208.

In some embodiments, for example, the shroud-defining counterpart flow regulator 400A is positionable relative to the filter medium 302, for modulating flow communication via the filter medium 302. In some embodiments, for example, the shroud-defining counterpart flow regulator 400A defines a shroud 418 for shielding of the filter medium 302 from the housing passage 224. In some embodiments, for example, the shielding prevents communication between the housing passage 224 and the filter medium 302. In some embodiments, for example, the shielding, from the housing passage 224, is effected by occlusion of the filter medium 302 by the shroud 418. In some embodiments, for example, the occluding is effected while the shroud 418 is aligned with the filter medium 302. In some embodiments, for example, the occluding is effected while the shroud 418 is positioned opposite to the filter medium 302.

While the flow control apparatus 200 is disposed in the installation configuration (see FIGS. 2 and 23), the occluding portion 310 effects occluding of the flow communicator 210, such that the flow communicator 210 is disposed in the closed condition, as depicted in FIGS. 2 and 3. In some embodiments, for example, the occluding is effected while the occluding portion is aligned with the flow communicator 210. In some embodiments, for example, the occluding is effected while the occluding portion 310 is positioned opposite to the flow communicator 210. In some embodiments, for example, the occluding portion 310 is positioned at an uphole end of the filter medium-defining counterpart 300, and positioned uphole relative to the filter medium 302. By occluding the flow communicator 210 with the occluding portion 310, debris or materials may be prevented from entering the displacement pathway of the filter medium-defining counterpart 300, which may mitigate clogging of the filter medium 302 or interfering with displacement of the filter medium-defining counterpart 300.

Also, while the flow control apparatus 200 is disposed in the installation configuration, the shroud-defining counterpart 400 is disposed relative to the filter medium-defining counterpart 300 such that the shielding of the filter medium 302 from the housing passage 224 is effected by the shroud 418. Further, the filter medium-defining counterpart 300 is disposed relative to the housing 202 such that there is shielding of the filter medium 302 from the external environment by the housing 202. In some embodiments, for example, the shielding from the external environment is effected by occlusion of the filter medium 302 by the housing 202. In some embodiments, for example, there is an absence of alignment between any portion of the filter medium 302 and the flow communicator 210. The shielding of the filter medium 302 by the shroud 418, the housing 202, or both the shroud 418 and the housing 202, amongst other things, mitigates ingress of cement and other debris material during cementing or other operations. Also, such occlusion may mitigate erosion of the filter medium 302 caused by, for example, treatment material, including solids (e.g. proppant), that is being injected into the subterranean formation 100 via a flow control apparatus 200 that is disposed further downhole.

In some embodiments, for example, in the installation configuration, as depicted in FIG. 2: (i) the shroud-defining counterpart 400 is disposed relative to the filter medium-defining counterpart 300 such that there is shielding of the filter medium 302 from the housing passage 224 by the shroud 418 of the shroud-defining counterpart 400, (ii) the filter medium-defining counterpart 300 is disposed relative to the housing 202 such that there is shielding of the filter medium 302 from the external environment by the housing 202, and (iii) the occluding portion 310 of the filter medium-defining counterpart 300 is occluding the flow communicator 210 and preventing debris or materials from entering the displacement pathway of the filter medium-defining counterpart 300. In such embodiments, for example, the filter medium 302 is shielded from the housing passage 224, the external environment, and the space defined between the housing 202 and the flow controller 250 such that the filter medium 302 is unclogged, or substantially unclogged and free, or substantially free, of debris, and the filter medium-defining counterpart 300 may be displaced through a clean, or substantially clean, displacement pathway during operation of the flow control apparatus 200.

In some embodiments, for example, the housing 202 and the flow controller 250 are co-operatively configured such that, in the installation configuration, the retainable profile engager 304 of the filter medium-defining counterpart 300 is disposed downhole relative to the filter medium-defining counterpart-retaining profile-defined recess 220 (see FIGS. 2 and 3). In some embodiments, for example, this configuration enables the flow control apparatus 200 to change configuration from the installation configuration to the open configuration, while avoiding retention of the filter medium-defining counterpart 300 to the housing 202 by disposition of the retainable profile engager 304 within the filter medium-defining counterpart-retaining profile-defined recess 220 (which would occur upon alignment between the engager 304 and the recess 220), but, subsequently, when changing configuration from the closed configuration to the production configuration, enables such retention, with effect that a production configuration is obtainable, as is further described below.

In the open configuration (see FIGS. 15 and 24), the shroud-defining counterpart 400 is disposed relative to the filter medium-defining counterpart 300 such that there is shielding of the filter medium 302 from the housing passage 224 by the shroud-defining counterpart 400, such as by the shroud 418. In some embodiments, for example, the shielding is effected by occlusion of the filter medium 302 by the shroud-defining counterpart 400. In some embodiments, for example, while the flow control apparatus 200 is in the open configuration, the filter medium-defining counterpart 300 is disposed relative to the housing 202 such that there is shielding of the filter medium 302 from the external environment by the housing 202. In some embodiments, for example, the shielding is effected by occlusion of the filter medium 302 by the housing 202. The shielding of the filter medium 302 by the shroud-defining counterpart 400, the housing 202, or both the shroud-defining counterpart 400 and the housing 202, amongst other things, mitigates erosion of the filter medium 302 caused by treatment material that is being injected into the subterranean formation 100 via the opened flow communicator 210.

In the closed configuration (see FIGS. 17 and 25), the shroud-defining counterpart 400 is disposed relative to the filter medium-defining counterpart 300 such that there is shielding of the filter medium 302 from the housing passage 224 by the shroud-defining counterpart 400, such as by the shroud 418. In some embodiments, for example, the shielding is effected by occlusion of the filter medium 302 by the shroud-defining counterpart 400. The shielding of the filter medium 302 by the shroud-defining counterpart 400, amongst other things, mitigates erosion of the filter medium 302 caused by treatment material, including solids (e.g. proppant), that is being injected into the subterranean formation 100 via a flow control apparatus 200 that is disposed further downhole.

In the production configuration (see FIGS. 21 and 26), the filter medium-defining counterpart 300 and the shroud-defining counterpart 400 are co-operatively disposed relative to the flow communicator 210 such that flow communication is effected, via the flow communicator 210, between the housing passage 224 and the subterranean formation 100 for receiving production of hydrocarbon material from the subterranean formation 100, while the filter medium 302 (of the filter medium-defining counterpart) is disposed (such as, for example, in alignment with the flow communicator 210) for filtering solids from hydrocarbon material that is being flowed, or for controlling solid particle ingress into the wellbore during production of hydrocarbons, via the flow communicator 210, from the subterranean formation 100 to the housing passage 224.

The filter medium-defining counterpart 300 and the shroud-defining counterpart 400 are co-operatively configured for releasable coupling relative to one another. In this respect, the filter medium-defining counterpart 300 and the shroud-defining counterpart 400 are configured for becoming coupled to one another such that a coupled configuration is obtained, and, in this coupling configuration, the filter medium-defining counterpart 300 and the shroud-defining counterpart 400 are disposed for release from such coupling, in response to application of a sufficient actuating force, such that an uncoupled configuration is obtained. In some embodiments, for example, in the uncoupled configuration, the filter medium-defining counterpart 300 and the shroud-defining counterpart 400 are configured for coupling, once again, in the same or other coupling configuration, as will be explained further below. By coupling the filter medium-defining counterpart 300 and the shroud-defining counterpart 400, and then releasing the inner and filter medium-defining counterparts 300, 400 from such coupling relationships, the shroud-defining counterpart flow regulator 400A is positionable in different positions relative to the filter medium-defining counterpart flow regulator 300A for controlling flow between the filter medium-defining counterpart flow regulator 300A and the housing passage 224, and thereby enabling the flow control apparatus 200 to assume the different configurations described above.

The releasable coupling is with effect that the filter medium-defining counterpart 300 is translatable with the shroud-defining counterpart 400. In some embodiments, for example, the releasable coupling is with effect that the filter medium-defining counterpart 300 is translatable with the shroud-defining counterpart 400 along an axis that is parallel to the central longitudinal axis 226 of the housing 224. In some embodiments, for example, the releasable coupling is with effect that the filter medium-defining counterpart 300 is translatable with the shroud-defining counterpart 400 in response to a force being applied to the shroud-defining counterpart 400 in a direction that is parallel to the central longitudinal axis 415 of the shroud-defining counterpart 400.

Referring to FIGS. 5, 7, 9, 11, and 14A the releasable coupling of the filter medium-defining counterpart 300 and the shroud-defining counterpart 400 is effected by a coupling system 5300. In some embodiments, for example, the coupling system 5300 includes a first coupling system counterpart 5301 and a second coupling system counterpart 5302. The releasable coupling of the filter medium-defining counterpart 300 to the shroud-defining counterpart 400 is effected by releasable coupling of the first coupling system counterpart 5301 and a second coupling system counterpart 5302.

In some embodiments, for example, the first coupling system 5300 counterpart 5301 is an shroud-defining counterpart engager 330 (of the filter medium-defining counterpart 300) and the second coupling system 5300 counterpart is a filter medium-defining counterpart-coupling profile 402, and the releasable coupling is effected by disposition of the shroud-defining counterpart engager 330 relative to an filter medium-defining counterpart-coupling profile 402. The relative disposition is with effect that the shroud-defining counterpart 400 is disposed for transmitting a force (such as, for example, in response to a force that is applied to the shroud-defining counterpart 400 in a direction that is parallel to the axis 415) to the filter medium-defining counterpart such that the filter medium-defining counterpart 300 is translatable with the shroud-defining counterpart 400. In some embodiments, for example, the disposition of the shroud-defining counterpart engager 330, relative to the filter medium-defining counterpart-coupling profile 402, which effects the releasable coupling, includes a co-operative disposition between the shroud-defining counterpart engager 330 and the filter medium-defining counterpart-coupling profile 402 with effect that the shroud-defining counterpart engager 330 is opposing the displacement of filter medium-defining counterpart-coupling profile 402, relative to the flow communicator 210. In some embodiments, for example, the opposed displacement is a displacement that is in response to an application of a force to the shroud-defining counterpart 400 that is in a direction that is parallel to the axis 415. In some embodiments, for example, the opposed displacement is a displacement that is along an axis that is parallel to the axis 226.

Referring to FIGS. 2, 4, 12, 13, and 14, in some embodiments, for example, the filter medium-defining counterpart-coupling profile 402 is defined within an outwardly-facing surface 430 of the shroud-defining counterpart 400, the outwardly-facing surface 430 being disposed opposite to the filter medium-defining counterpart 300.

Figure 4:
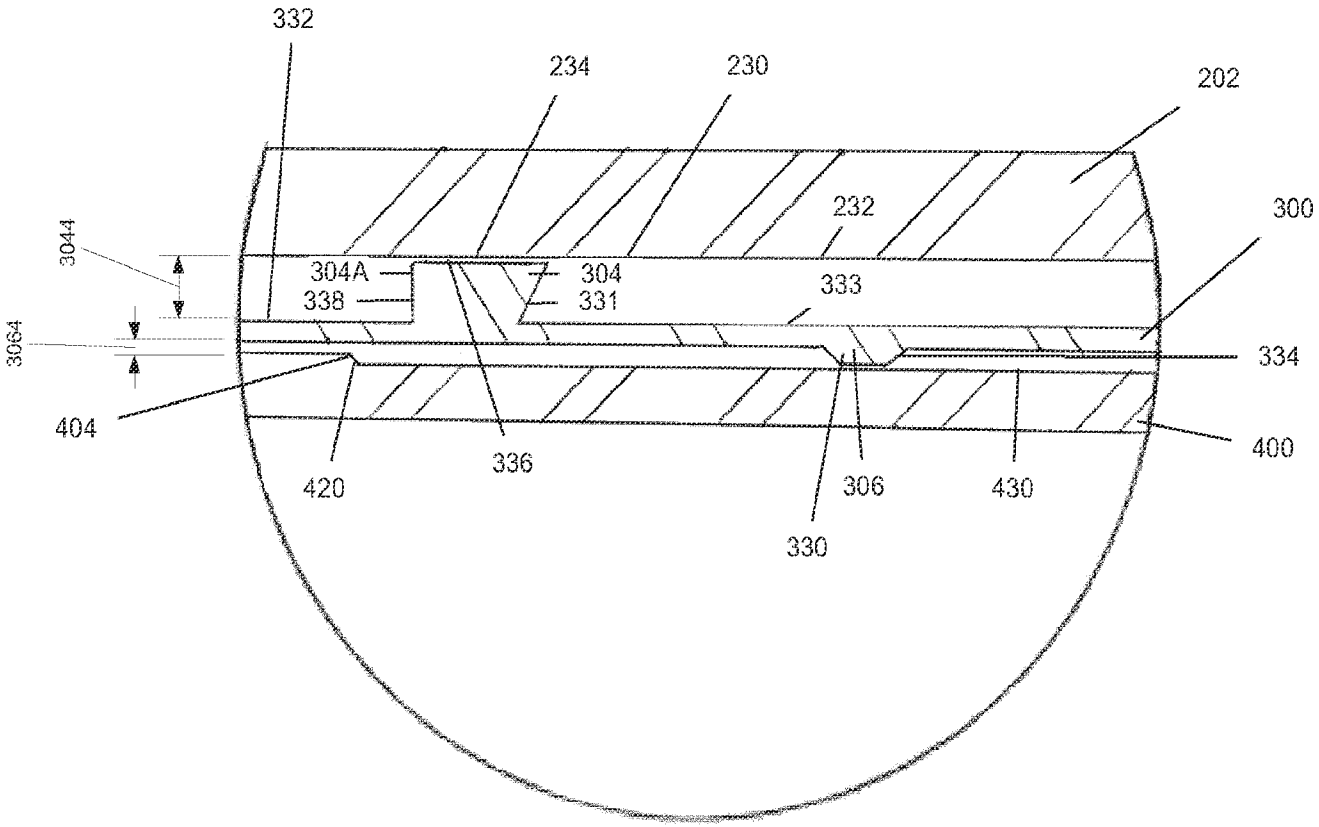
FIG. 4 is an enlarged view of the portion of the flow control apparatus of FIG. 2, the portion identified by window Y shown in FIG. 2.

In some embodiments, for example, the housing 202, the filter medium-defining counterpart 300, and the shroud-defining counterpart 400 are co-operatively configured such that, while the shroud-defining counterpart engager 330 of the filter medium-defining counterpart 300 is aligned with the filter medium-defining counterpart-coupling profile 402 of the shroud-defining counterpart 400, urging of the co-operative disposition between the shroud-defining counterpart engager 330 and the filter medium-defining counterpart-coupling profile 402 (as will be explained below) is effected. In some embodiments, for example, the urging, of the co-operative disposition between the shroud-defining counterpart engager 330 and the filter medium-defining counterpart-coupling profile 402, that is effected while the shroud-defining counterpart engager 330 of the filter medium-defining counterpart is aligned with the filter medium-defining counterpart-coupling profile 402 of the shroud-defining counterpart 400, is with effect that the shroud-defining counterpart engager 330 is deflected in the inwardly (e.g. radially inwardly) direction, relative to a central longitudinal axis 316 of the filter medium-defining counterpart 300. In some embodiments, for example, the deflection of the shroud-defining counterpart engager 330 of the filter medium-defining counterpart 300, in the inwardly (e.g. radially inwardly) direction, relative to the axis 316, effects deflection of a resilient portion 333 of the filter medium-defining counterpart 300 so as to facilitate the deflection, as depicted in FIGS. 4 and 7. In some embodiments, for example, the urging overcomes a material bias in the outwardly direction.

In some embodiments, for example, the shroud-defining counterpart engager 330 is defined by one or more shroud-defining counterpart engager members 306, as depicted in FIG. 4. In some embodiments, for example, each one of the one or more shroud-defining counterpart engager members 306, independently, is defined by a protuberance 334. Referring to FIG. 4 and FIG. 7, in some embodiments, for example, the one or more shroud-defining counterpart engager members 306 are defined by a plurality of protuberances 334 that are disposed circumferentially about the central longitudinal axis 316 of the filter medium-defining counterpart 300.

Figure 12:
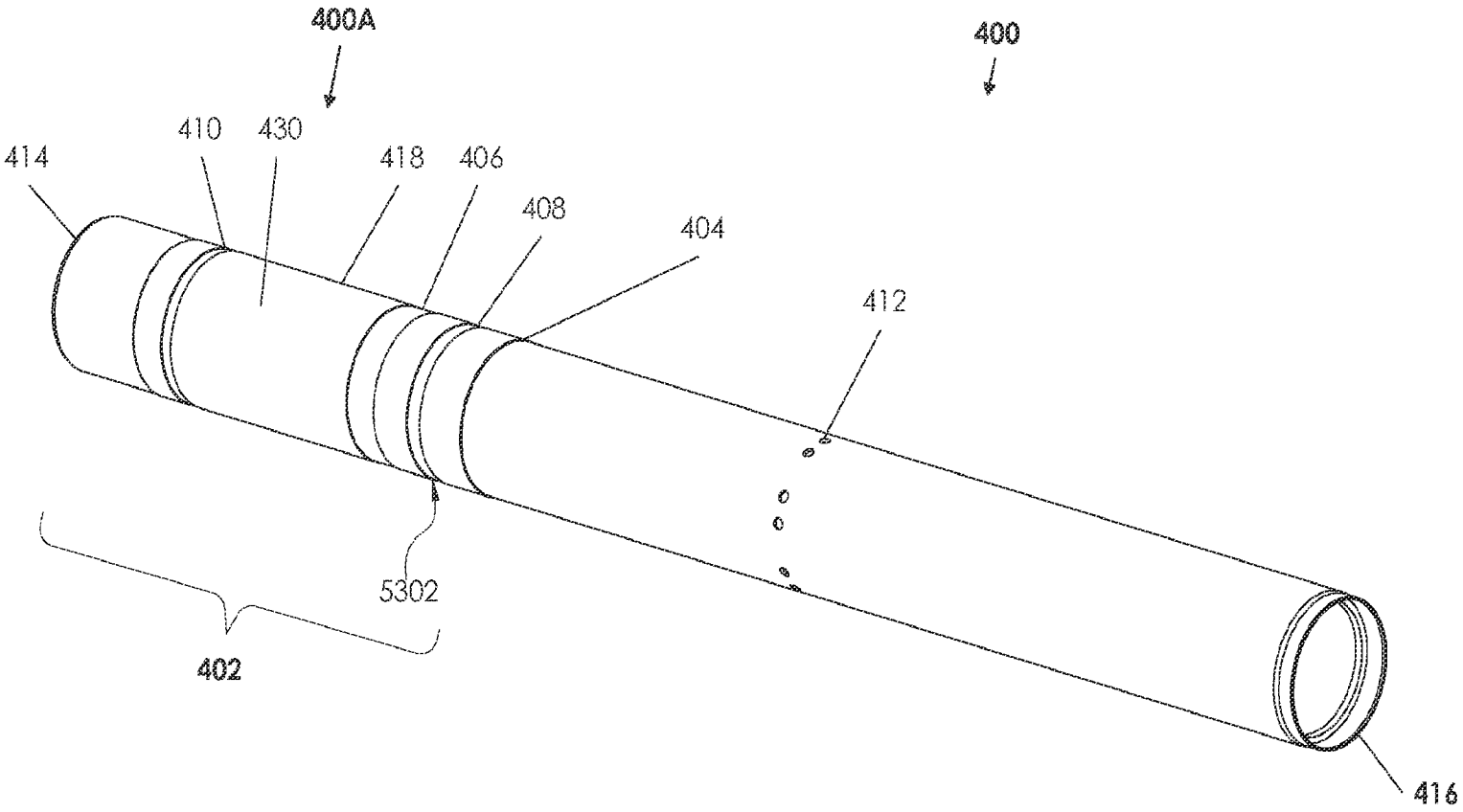
FIG. 12 is a perspective view of an embodiment of a shroud-defining counterpart of the flow control apparatus of FIG. 2.

In some embodiments, for example, the filter medium-defining counterpart-coupling profile 402 includes a plurality of longitudinally spaced-apart profile features 404, 406, 408, 410 defined within the outwardly-facing surface 430, as depicted in FIG. 12. Each one of the profile features, independently, is disposed for becoming co-operatively disposed with the shroud-defining counterpart engager 330 for effecting the coupling of the filter medium-defining counterpart 300 to the shroud-defining counterpart 400 at a different position along an axis that is parallel to the central longitudinal axis of the shroud-defining counterpart 400. An exemplary profile feature is a recess. In the illustrated embodiments, each one of the profile features 406, 408, 410, independently, is defined by a recess.

Figure 9:
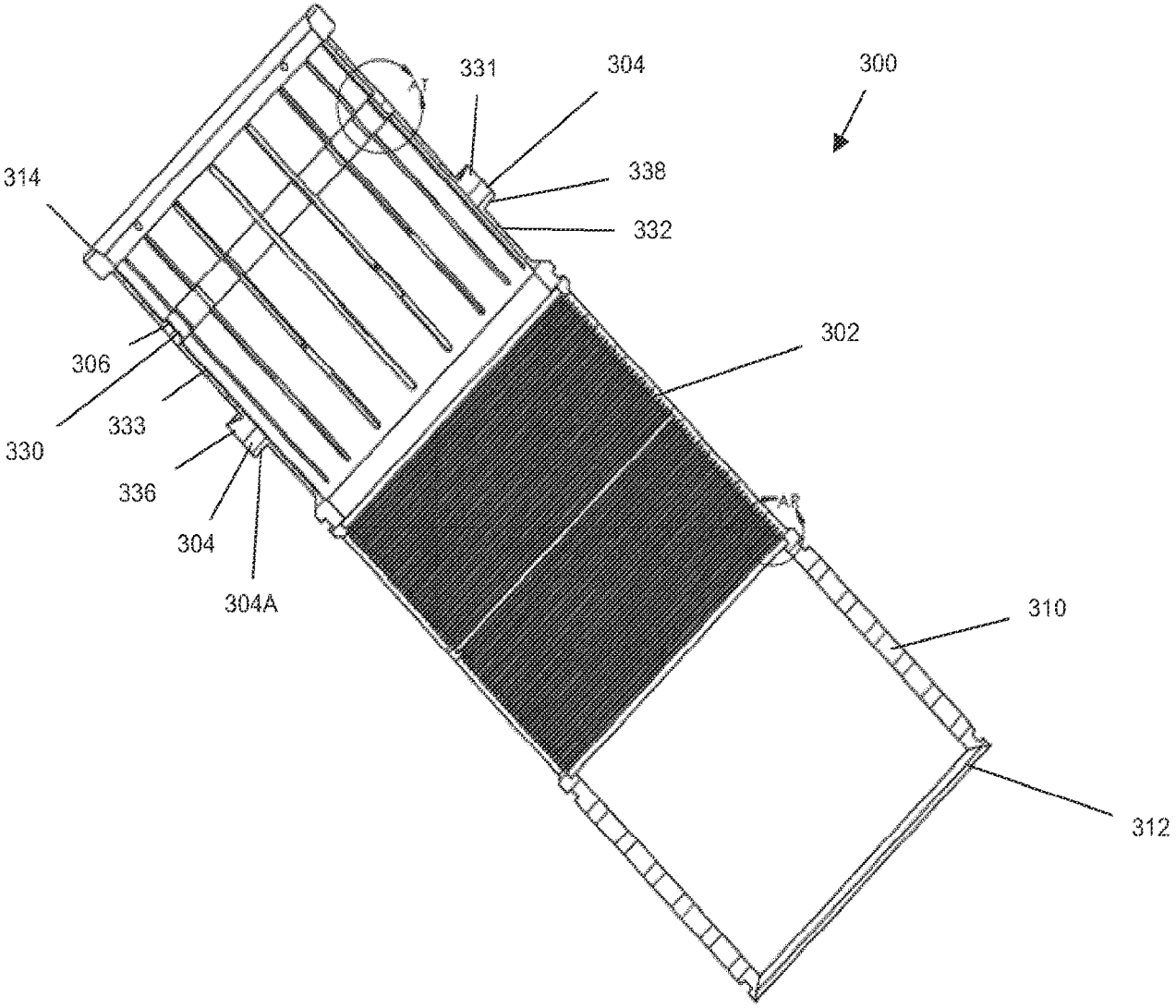
FIG. 9 is another cross-sectional view of the filter medium-defining counterpart of FIG. 5.
Figure 10:
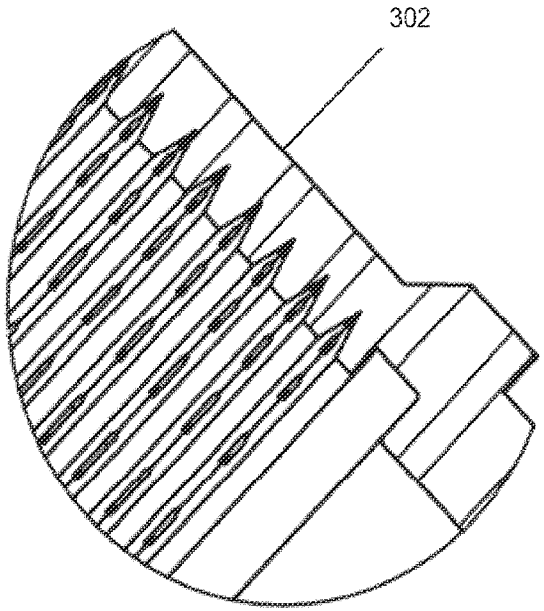
FIG. 10 is an enlarged view of the portion of the filter medium-defining counterpart of FIG. 9, the portion identified by window AR shown in FIG. 9.
Figure 11:
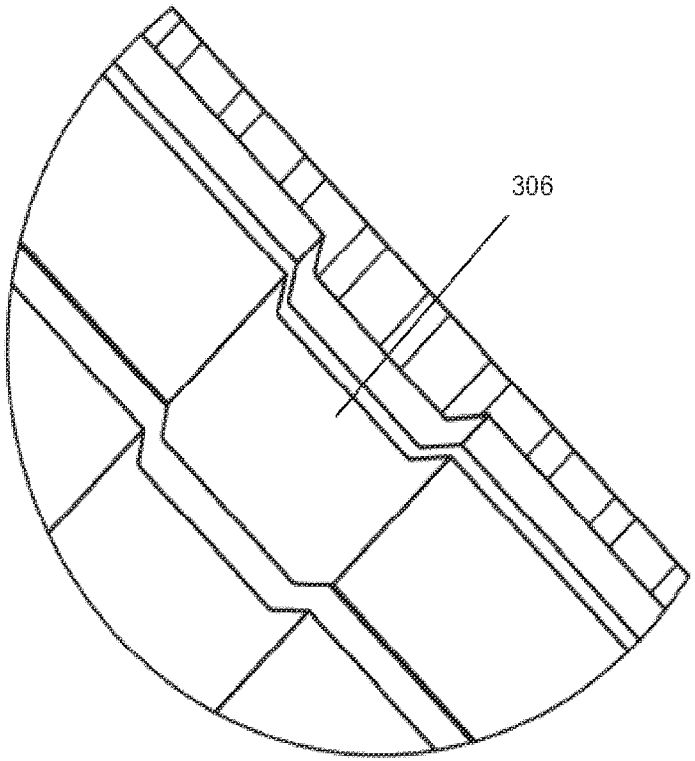
FIG. 11 is an enlarged view of the portion of the filter medium-defining counterpart of FIG. 9, the portion identified by window AT shown in FIG. 9.

As depicted in FIG. 4, the housing 202 defines a filter medium-defining counterpart-engaging profile 230 that is configured to engage the filter medium-defining counterpart 300. The filter medium-defining counterpart-engaging profile 230 is defined on a passage-defining surface 232 of the housing 202 that is disposed opposite to the filter medium-defining counterpart 300. The filter medium-defining counterpart-engaging profile 230 includes a coupling-stimulating profile 234. Correspondingly, as depicted in FIGS. 3, 4, and 7, the filter medium-defining counterpart 300 includes a coupling-stimulating profile engager 331 for engaging the filter medium-defining counterpart-engaging profile 230. The engagement of the coupling-stimulating profile engager 331 to the filter medium-defining counterpart-engaging profile 230 is for effecting the urging of the co-operative disposition between the shroud-defining counterpart engager 330 and the filter medium-defining counterpart-coupling profile 402, as described above. In some embodiments, for example, the coupling-stimulating profile engager 331 includes one or more coupling-stimulating profile engager members 336, as depicted in FIGS. 4, 7, and 9. Each one of the one or more coupling-stimulating profile engager members 336, independently, is configured for engaging the coupling-stimulating profile 234, while the shroud-defining counterpart engager 330 of the filter medium-defining counterpart 300 is disposed in alignment with the filter medium-defining counterpart-coupling profile 402 of the shroud-defining counterpart 400, with effect that the urging, of the co-operative disposition between the shroud-defining counterpart engager 330 and the filter medium-defining counterpart-coupling profile 402, is effected. In some embodiments, for example, each one of the one or more coupling-stimulating profile engager members 336, independently, is defined by a protuberance 338, as depicted in FIGS. 4, 7, and 9, and the protuberance 338 extends outwardly (such as, for example, radially outwardly relative to the axis 316).

In this respect, the housing 202, the filter medium-defining counterpart 300, and the shroud-defining counterpart 400 are co-operatively configured such that, while: (i) the one or more coupling-stimulating profile engager members 336 of the filter medium-defining counterpart 300 are engaging the coupling-stimulating profile 234 of the housing 202, and (ii) the shroud-defining counterpart engager 330 of the filter medium-defining counterpart 300 is aligned with the filter medium-defining counterpart-coupling profile 402 of the shroud-defining counterpart 400, the urging, of the co-operative disposition between the shroud-defining counterpart engager 330 and the filter medium-defining counterpart-coupling profile 402, is effected.

In some embodiments, for example, the urging, of the co-operative disposition between the shroud-defining counterpart engager 330 of the filter medium-defining counterpart 300 and the filter medium-defining counterpart-coupling profile 402 of the shroud-defining counterpart 400, that is effected while the shroud-defining counterpart engager 330 of the filter medium-defining counterpart 300 is aligned with the filter medium-defining counterpart-coupling profile 402 of the shroud-defining counterpart 400, is effected while the releasable coupling of the filter medium-defining counterpart 300 and the shroud-defining counterpart 400 is being effected, and the urging is with effect that defeating of the releasable coupling is resisted (for example, for each one of the one or more shroud-defining counterpart engager members 306 of the filter medium-defining counterpart 300, independently, deflection of the shroud-defining counterpart engager 306 in the outwardly (e.g. radially outwardly) direction, relative to the axis 316, such that the shroud-defining counterpart engager 336 is displaced from the profile 402, is resisted).

In some embodiments, for example, the housing 202, the filter medium-defining counterpart 300, and the shroud-defining counterpart 400 are co-operatively configured such that, while the releasable coupling of the filter medium-defining counterpart 300 and the shroud-defining counterpart 400 is being effected, defeating of the releasable coupling is effected in response to deflection of the shroud-defining counterpart engager 330 of the filter medium-defining counterpart 300 in the outwardly (e.g. radially outwardly) direction, relative to the axis 316 (such as, for example, for each one of the one or more shroud-defining counterpart engager members 306 of the filter medium-defining counterpart 300, independently, deflection of the shroud-defining counterpart engager 330 in the outwardly (e.g. radially outwardly) direction, relative to the axis 316, such that the shroud-defining counterpart engager 330 is displaced from the profile 402). In some embodiments, for example, the deflection of the shroud-defining counterpart engager 330 of the filter medium-defining counterpart 300, in the outwardly (e.g. radially outwardly) direction, relative to the axis 316, effects deflection of the resilient portion 333 of the filter medium-defining counterpart 300 so as to facilitate the deflection.

In some embodiments, for example, the resilient portion 333 of the filter medium-defining counterpart 300 is defined by collet springs 332 (such as, for example, beam springs) that are separated by slots, as depicted in FIG. 4 and FIG. 7. In some embodiments, the collet springs 332 are configured for a limited amount of displacement in response to a force applied to the collet springs. Because of their resiliency, the collet springs 332 are able to be displaced, and then return to its original shape.

Each one of the one or more shroud-defining counterpart engager members 306 (for example, the one or more protuberances 334), independently, extends from a respective one of the collet springs 332. In some embodiments, for example, each one of the one or more shroud-defining counterpart engager members 306 of the filter medium-defining counterpart 300, independently, is stiffer than the respective collet spring 332 from which it extends. Also, each one of the one or more coupling stimulating profile engager members 336 (for example, the one or more protuberances 338) of the filter medium-defining counterpart 300, independently, extends from a respective one of the collet springs 332, such that, for each one of the one or more shroud-defining counterpart engager members 306, there is associated a corresponding coupling stimulating profile engager 336. In some embodiments, for example, each one of the one or more coupling stimulating profile engager members 336, independently, is stiffer than the respective collet spring 332 from which it extends.

In some embodiments, for example, for each one of the one or more coupling-stimulating profile engager members 336, independently, the coupling-stimulating profile engager protuberance 338 has a length 3044 that is greater than the length 3064 of the corresponding shroud-defining counterpart engager protuberance 334. In other words, as depicted in FIG. 4, the coupling-stimulating profile engager protuberance extends radially farther from the surface on which it begins to extend, relative to the shroud-defining counterpart engager protuberance. In some embodiments, the length 3044 of the coupling-stimulating profile engager protuberance 338 is greater than the radial length of the annulus defined between the housing 202 and the filter medium-defining counterpart 300, as depicted in FIG. 4.

Figure 14:
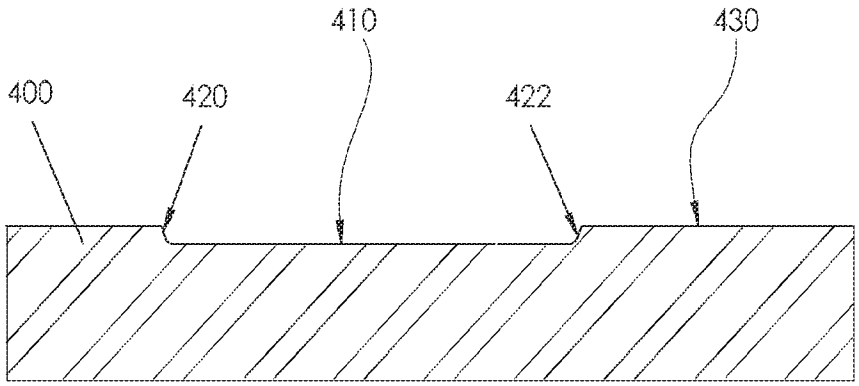
FIG. 14 is an enlarged view of the portion of the shroud-defining counterpart of FIG. 13, the portion identified by window AU shown in FIG. 13.
Figure 14A:
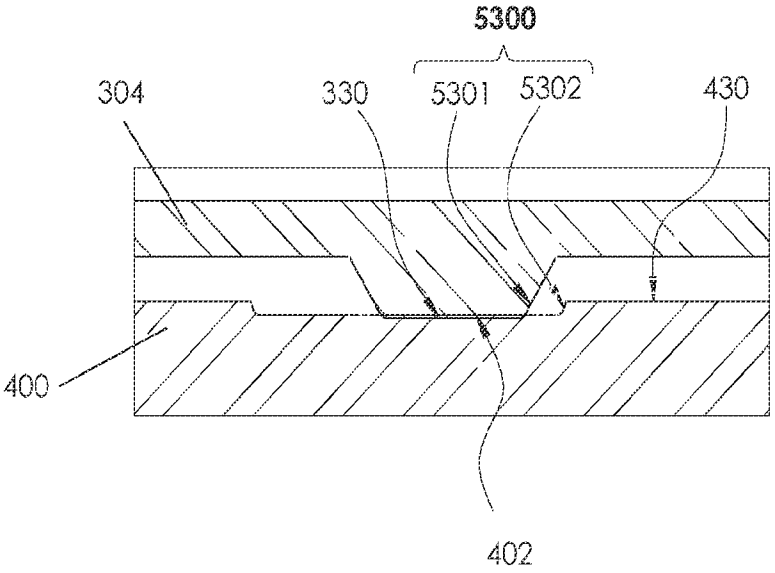
FIG. 14A is an enlarged view of the shroud-defining counterpart portion illustrated in FIG. 14, having received a shroud-defining counterpart engager of the filter medium-defining counterpart of the flow control apparatus of FIG. 2, and thereby illustrating releasable coupling of the first coupling system counterpart and the second coupling system counterpart of the coupling system.

In some embodiments, for example, the filter medium-defining counterpart-coupling profile 402 of the shroud-defining counterpart 400 is configured for encouraging the defeating of the co-operative disposition (which is effecting the releasable coupling) between the filter medium-defining counterpart-coupling profile 402 and the filter medium-defining counterpart 300, in co-operation with the selective application of a suitable force urging such defeating. In some embodiments, for example, where the filter medium-defining counterpart coupling profile 402 is defined by a recess, the profile 402 has one or more surfaces 420 and 422 that are configured to promote the defeating of the interaction between the filter medium-defining counterpart 300 and the shroud-defining counterpart 400, as depicted in FIG. 14. In some embodiments, for example, the surface 420 and the surface 422 are positioned in opposition of each other. When the flow control apparatus 200 is disposed downhole for hydrocarbon material production, the surface 420 is positioned uphole relative to the surface 422, such that the surface 420 is an uphole surface 420 and the surface 422 is a downhole surface 422. In some embodiments, for example, the one or more surfaces 420 and 422 are tapered, chamfered, bevelled, or angled. While the co-operative disposition between the one or more shroud-defining counterpart engager members 306 and the filter medium-defining counterpart-coupling profile 402 is established, in response to relative movement between the shroud-defining counterpart 400 and the filter medium-defining counterpart 300, the one or more surfaces 420 or 422 applies a force to the one or more shroud-defining counterpart engager members 306 that urges displacement of the filter medium-defining counterpart 300 to promote the defeating of the co-operative disposition between the filter medium-defining counterpart 300 and the shroud-defining counterpart 400. In some of these embodiments, for example, the defeating is effected in response to displacement of the shroud-defining counterpart 400, relative to the filter medium-defining counterpart 300, along an axis that is parallel to the axis 226. In some embodiments, based on the taper, chamber, bevel, or angle of the one or more surfaces 420 and 422, the force applied to the one or more shroud-defining counterpart engager members 306 has an outward (e.g. radially outward) component, such that the filter medium-defining counterpart 300 is encouraged to be displaced, relative to the shroud-defining counterpart 400, in an outwardly (e.g. radially outward) direction while travelling along the one of the surfaces 420 or 422. In some embodiments, for example, the defeating of the coupling between the filter medium-defining counterpart 300 and the shroud-defining counterpart 400 includes a deflection of the shroud-defining counterpart engager 306 in the outwardly (e.g. radially outwardly) direction, relative to the axis 316. In some embodiments, for example, the angles defined between the surfaces 420 and 422 relative to the central longitudinal axis 415 of the shroud-defining counterpart 400 are based on, among other considerations, the amount of force to be applied to the shroud-defining counterpart 400 to displace the shroud-defining counterpart 400, the amount of force to be applied to the shroud-defining counterpart 400 to release the shroud-defining counterpart 400 and the filter medium-defining counterpart 300 from retention, and the amount of displacement of the shroud-defining counterpart 400, during operation of the flow control apparatus 200. In some embodiments, for example, the surfaces 420 and 422 define angles between 45° and 73° relative to the central longitudinal axis 415 of the shroud-defining counterpart 400. In some embodiments, for example, the surfaces 420 and 422 define angles that are less than 45° to the central longitudinal axis 415 of the shroud-defining counterpart 400. In some embodiments, for example, the surfaces 420 and 422 define angles that are greater than 73° to the central longitudinal axis 415 of the shroud-defining counterpart 400.

In those embodiments where the flow controller 250 includes a filter medium-defining counterpart 300 and a shroud-defining counterpart 400, in addition to effecting retention of the filter medium-defining counterpart 300, the filter medium-positioning system 2511 functions to, in parallel, defeat the releasable coupling of the filter medium-defining counterpart 300 and the shroud-defining counterparts 300, 400.

In this respect, the flow communicator 210, the filter medium 302, the filter medium-defining counterpart-retaining profile 236, and the retainable profile engager 304 are co-operatively configured such that, while: (i) the filter medium-defining counterpart 300 and the shroud-defining counterpart 400 are releasably coupled to one another, and (ii) a force is being applied to the shroud-defining counterpart 400 (for example, in a direction that is parallel to the axis 415), urging displacement of the shroud-defining counterpart 400 relative to the filter medium-defining counterpart-retaining profile 236 (for example, along an axis that is parallel to the axis 226), with effect that the filter medium-defining counterpart 300 translates with the shroud-defining counterpart 400, in response to alignment of the retainable profile engager 304 within the filter medium-defining part-retaining profile 236, the retainable profile engager 304 becomes disposed within the filter medium-defining part-retaining profile 236, with effect that the filtering medium 302 becomes disposed relative to the flow communicator 210 (for example, the filtering medium 302 becomes disposed in alignment with the flow communicator 210), such that: (I) retention of the filtering medium 302, relative to the flow communicator 210, is effected, and flow communication, between the subterranean formation 100 and the housing passage 224, becomes established via the flow communicator 210, and hydrocarbon material, that is conductible via the flow communicator 210, from the subterranean formation to the housing passage 224 is filterable by the filter medium 302, and (ii) the coupling between the filter medium-defining counterpart 300 and the shroud-defining counterpart 400 is defeated (i.e. the shroud-defining counterpart 400 becomes released from coupling to the filter medium-defining counterpart 300) with effect that the shroud-defining counterpart 400 becomes displaceable relative to the filter medium-defining counterpart 300.

In some embodiments, for example, the filter medium-defining counterpart-engaging profile 230 further includes the filter medium-defining counterpart-retaining profile 236, as depicted in FIGS. 2, 3, 19, and 22.

Figure 17:
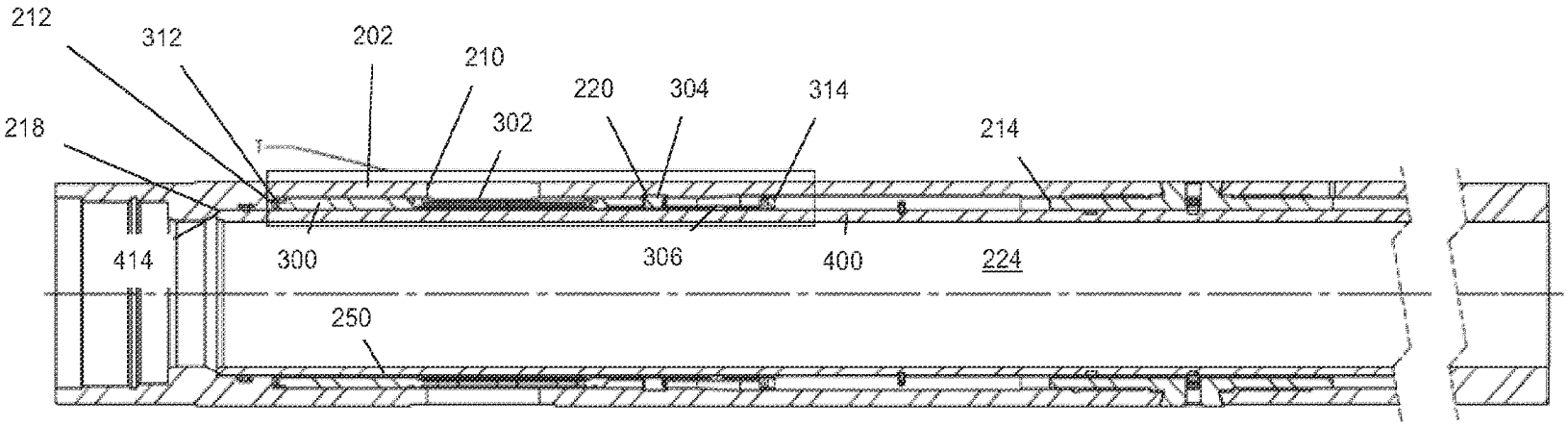
FIG. 17 is a cross-sectional view of the flow control apparatus of FIG. 2, illustrating the apparatus in a closed configuration.

The profile 236 is operative to facilitate this screened flow communication by retaining the filter medium-defining counterpart 300 while the above-described force is being applied to the shroud-defining counterpart 400, and is operative to do so while the flow control apparatus 200 is disposed in the closed configuration (see FIGS. 17 and 25).

Referring to FIG. 1, there is provided a wellbore material transfer system 10 for conducting material from the surface 101 to a subterranean formation 100 via a wellbore 102 of a well 120, from the subterranean formation 100 to the surface 10 via the wellbore 102, or between the surface 10 and the subterranean formation 100 via the wellbore 102. In some embodiments, for example, the subterranean formation 100 is a reservoir that contains hydrocarbon material.

The wellbore 102 can be straight, curved, or branched. The wellbore 102 can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

In one aspect, there is provided a process for stimulating hydrocarbon production from the subterranean formation 100. The process includes, amongst other things, conducting treatment material from the surface 10 to the subterranean formation 100 via the wellbore 102.

In some embodiments, for example, the conducting (such as, for example, by flowing) treatment material to the subterranean formation 100 via the wellbore 102 is for effecting selective stimulation of the subterranean formation 100, such as a subterranean formation 100 including a hydrocarbon material-containing reservoir. The stimulation is effected by supplying the treatment material to the subterranean formation 100. In some embodiments, for example, the treatment material includes a liquid, such as a liquid including water. In some embodiments, for example, the liquid includes water and chemical additives. In other embodiments, for example, the stimulation material is a slurry including water and solid particulate matter, such as proppant. In some embodiments, for example the treatment material includes chemical additives. Exemplary chemical additives include acids, sodium chloride, polyacrylamide, ethylene glycol, borate salts, sodium and potassium carbonates, glutaraldehyde, guar gum and other water-soluble gels, citric acid, and isopropanol. In some embodiments, for example, the treatment material is supplied to effect hydraulic fracturing of the reservoir.

In some embodiments, for example, the conducting of fluid, to and from the wellhead, is effected by a wellbore string 104. The wellbore string 104 may include pipe, casing, or liner, and may also include various forms of tubular segments. The wellbore string 104 includes a wellbore string passage 106.

In some embodiments, for example, the wellbore 102 includes a cased-hole completion, in which case, the wellbore string 104 includes a casing 104A.

A cased-hole completion involves running casing down into the wellbore 102 through the production zone. The casing 104A at least contributes to the stabilization of the subterranean formation 100 after the wellbore 102 has been completed, by at least contributing to the prevention of the collapse of the subterranean formation 100 that is defining the wellbore 102. In some embodiments, for example, the casing 104A includes one or more successively deployed concentric casing strings, each one of which is positioned within the wellbore 102, having one end extending from the wellhead 108. In this respect, the casing strings are typically run back up to the surface. In some embodiments, for example, each casing string includes a plurality of jointed segments of pipe. The jointed segments of pipe typically have threaded connections.

The annular region between the deployed casing 104A and the subterranean formation 100 may be filled with zonal isolation material (e.g. cement) for effecting zonal isolation. The zonal isolation material is disposed between the casing 104A and the subterranean formation 100 for the purpose of effecting isolation of one or more zones of the subterranean formation from fluids disposed in another zone of the subterranean formation. Such fluids include formation fluid being produced from another zone of the subterranean formation 100 (in some embodiments, for example, such formation fluid being flowed through a production string disposed within and extending through the casing 104A to the surface), or injected stimulation material. In this respect, in some embodiments, for example, the zonal isolation material is provided for effecting sealing of flow communication between one or more zones of the subterranean formation and one or more others zones of the subterranean formation via space between the casing 104A and the subterranean formation 100. By effecting the sealing of such flow communication, isolation of one or more zones of the subterranean formation 100, from another subterranean zone (such as a producing formation) via the zonal isolation material is achieved. Such isolation is desirable, for example, for mitigating contamination of a water table within the subterranean formation by the formation fluids (e.g. oil, gas, salt water, or combinations thereof) being produced, or the above-described injected fluids.

In some embodiments, for example, the zonal isolation material is disposed as a sheath within an annular region between the casing 104A and the subterranean formation 100. In some embodiments, for example, the zonal isolation material is bonded to both of the casing 104A and the subterranean formation 100. In some embodiments, for example, the zonal isolation material also provides one or more of the following functions: (a) strengthens and reinforces the structural integrity of the wellbore, (b) prevents produced formation fluids of one zone from being diluted by water from other zones, (c) mitigates corrosion of the casing 104A, and (d) at least contributes to the support of the casing 104A. The zonal isolation material is introduced to an annular region between the casing 104A and the subterranean formation 100 after the subject casing 104A has been run into the wellbore 102. In some embodiments, for example, the zonal isolation material includes cement. In this respect, in some embodiments, the completion is a cemented completion. However, it is understood that, in other embodiments, for example, the casing is uncemented.

In some embodiments, for example, the conduction of fluids between the surface 10 and the subterranean formation 100 is effected via the passage 106 of the wellbore string 104.

In some embodiments, for example, the conducting of the treatment material to the subterranean formation 100 from the surface 10 via the wellbore 102, or of hydrocarbon material from the subterranean formation 100 to the surface 10 via the wellbore 102, is effected via one or more flow communication stations (three flow communication stations 110, 112, 114 are illustrated) that are disposed at the interface between the subterranean formation 100 and the wellbore 102. Successive flow communication stations 110, 112, 114 may be spaced from each other along the wellbore 102 such that each one of the flow communication stations 110, 112, 114, independently, is positioned adjacent a zone or interval of the subterranean formation 100 for effecting flow communication between the wellbore 102 and the zone (or interval).

For effecting the flow communication, each one of the flow communication stations 110, 112, 114 includes a flow communicator 210 through which the conducting of the material is effected. In some embodiments, for example, the flow communicator is disposed within a sub that has been integrated within the wellbore string 104, and is pre-existing, in that the flow communicator 210 exists before the sub, along with the wellbore string 104, has been installed downhole within the wellbore 102.

Figure 27:
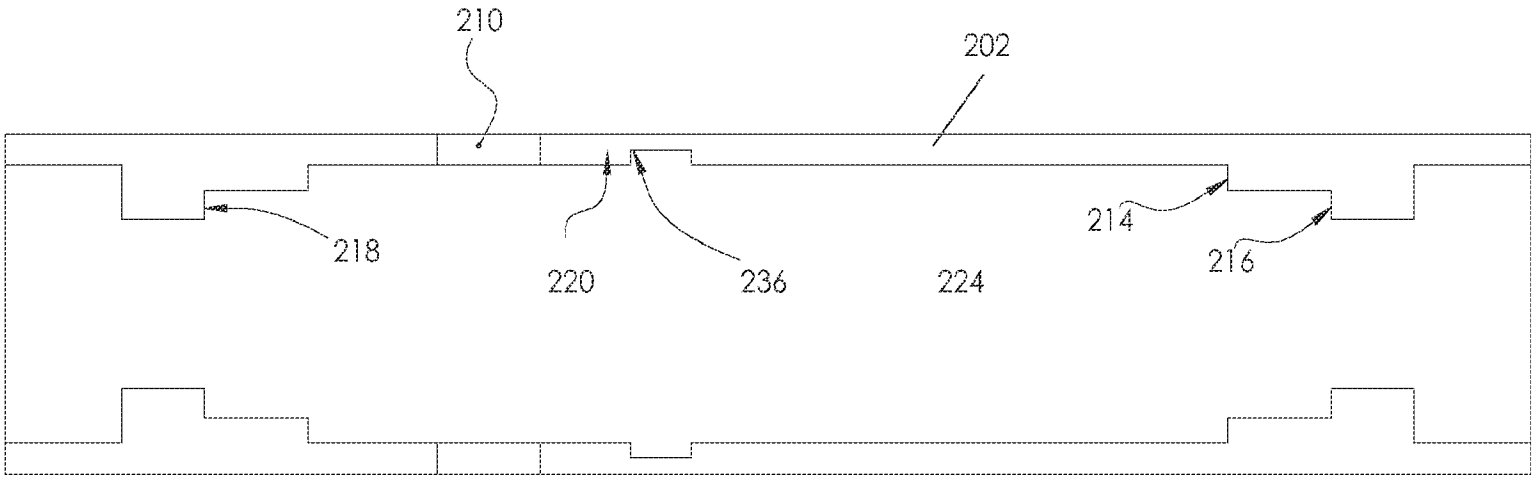
FIG. 27 is a schematic of the housing of the flow control apparatus.

Each one of the flow communication stations 110, 112, 114, independently, includes a flow control apparatus 200, as depicted in FIG. 2. The flow control apparatus 200 includes a housing 202, as depicted in FIG. 2 and FIG. 27. The housing 202 includes a housing passage 224. In some embodiments, for example, the housing 202 includes an uphole opening 201 at an uphole end 200A of the apparatus 200, and a downhole opening 203 at a downhole end 200B of the apparatus 200, and the housing passage 224 extends between the uphole opening 201 and the downhole opening 203. The flow control apparatus 200 is configured for integration within the wellbore string 104 such that the wellbore string passage 106 includes the passage 224. The integration may be effected, for example, by way of threading or welding. In some embodiments, for example, the integration is by threaded coupling, and, in this respect, in some embodiments, for example, each one of the uphole and downhole ends 200A and 200B, independently, is configured for such threaded coupling to other portions of the wellbore string 104.

Referring to FIGS. 2 and 3, the flow control apparatus 200 includes the flow communicator 210, and the flow communicator 210 extends through the housing 202. In this regard, the housing 202 defines the flow communicator 210. In some embodiments, the flow communicator 210 is defined by one or more ports. Material may be conducted through the flow communicator 210, such as from the housing passage 224 to an environment external to the flow control apparatus 200, such as the subterranean formation 100, or from the external environment, such as the subterranean formation 100, to the housing passage 224.

As depicted in FIG. 2, the housing passage 224 defines an axis 226 that extends longitudinally through the center of the housing passage 224, such that the axis 226 is a central longitudinal axis of the housing passage 224. In some embodiments, while the flow control apparatus 200 is disposed downhole for hydrocarbon material production and integrated within the wellbore string 104, the axis 226 is parallel (and, in some embodiments, for example, coincident), with the central longitudinal axis of the wellbore string passage 106.

As depicted in FIG. 2, the flow control apparatus 200 includes the flow controller 250 for controlling flow communication between the housing passage 224 and the flow communicator 210. The flow controller 250 is received within the housing 202 and is displaceable within the housing passage 224 relative to the flow communicator 210. In some embodiments, the flow controller 250 is configured for controlling conducting of material, such as, for example, flow of material, via the flow communicator 210, between the passage 224 and an environment external to the flow control apparatus 200, such as, for example, the subterranean formation 100. In this respect, the flow controller 250 is configured for controlling the conducting of material (such as, for example, material flow) through the flow communicator 210.

Figure 13:
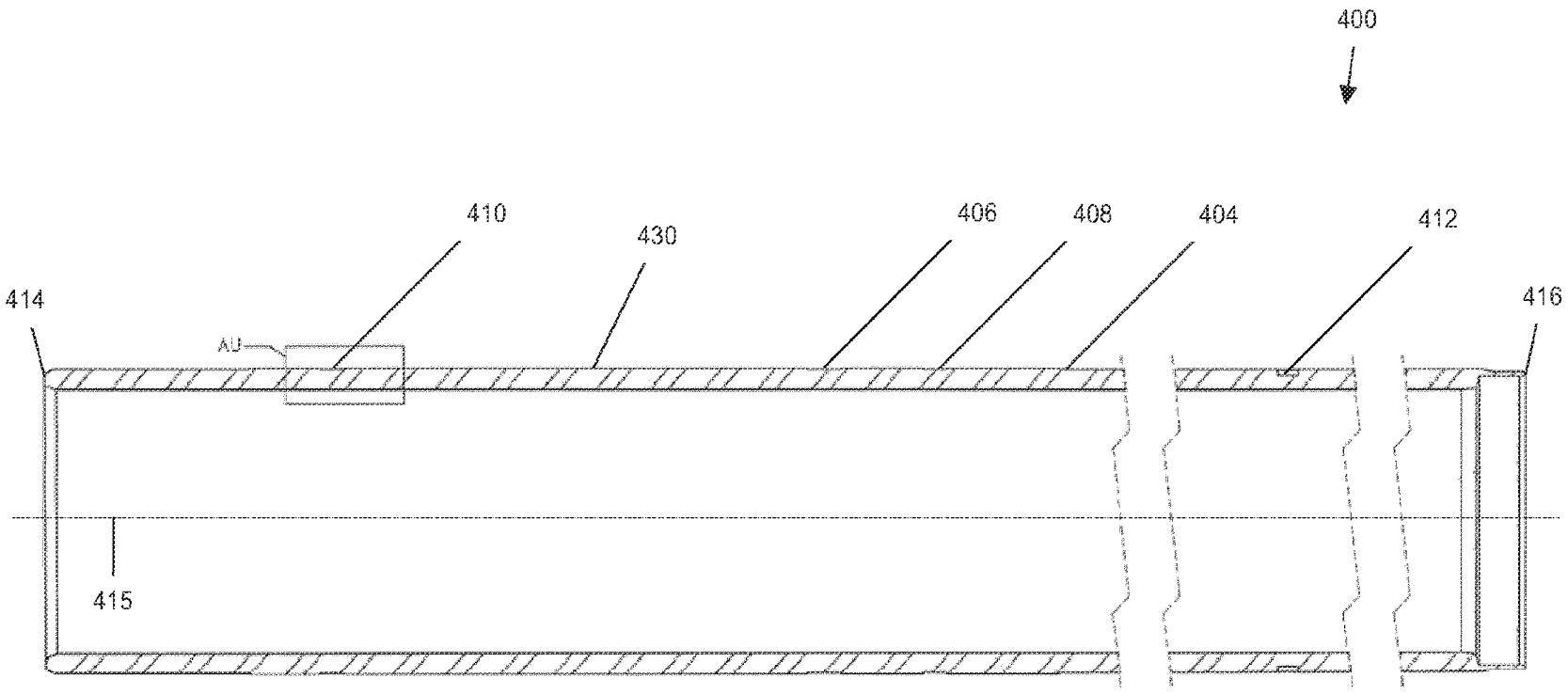
FIG. 13 is a cross-sectional view of the shroud-defining counterpart of FIG. 12.

In those embodiments where the flow controller 250 includes a filter medium-defining counterpart 300 and the shroud-defining counterpart 400, in some of these embodiments, for example, each one of the filter medium-defining counterpart 300 and the shroud-defining counterpart 400, independently, is in the form of a sliding sleeve, and the sliding sleeve 401 of the shroud-defining counterpart 400 is nested within the sliding sleeve 301 of the filter medium-defining counterpart 300. In some embodiments, for example, the sliding sleeves 301, 401 are concentric. In some embodiments, for example, the housing 202 and the sliding sleeves 301, 401 are concentric. In some embodiments, for example, the sliding sleeve 301 includes a central longitudinal axis 316, and the sliding sleeve 401 includes a central longitudinal axis 415, as depicted in FIG. 13, and in some of these embodiments, for example, the axis 316 is coincident with the axis 415. In this respect, in some embodiments, to accommodate the sleeves 301, 401, the housing 202 has a cylindrical, or generally cylindrical shape, having a circular, or generally circular axial cross-section, such that the flow control apparatus 200 has a cylindrical, or generally cylindrical shape. Also in this respect, the shroud 418 is defined by a circumferential portion of the shroud-defining counterpart 400.

As discussed above, the flow control apparatus 200 is configurable for disposition in an installation configuration (see FIGS. 2 to 4), an open configuration (see FIGS. 15 and 16), a closed configuration (see FIGS. 17 to 20), and a production configuration (see FIGS. 21 and 22).

In some embodiments, for example, while the apparatus 200 is disposed in the installation configuration, the occluding portion 310 of the sliding sleeve 301 effects occluding of the flow communicator 210, such that the flow communicator 210 is disposed in the closed condition as described above. The sliding sleeve 301 and the sliding sleeve 401 are coupled together in a first coupled configuration by one or more frangible interlocking members 2600 (e.g. one or more shear pins), as depicted in FIG. 3. Such coupling relationship enables translation of the sliding sleeve 301 with the sliding sleeve 401, in response to application of a force to the sliding sleeve 401 via a shifting tool (such as, for example, a force from fluid within the wellbore string passage that is transmitted to the sliding sleeve 401 by the shifting tool). In this respect, in some embodiments, for example, while the flow control apparatus 200 is disposed in the installation configuration, the sliding sleeve 401 is disposed for engagement with a shifting tool, with effect that the sliding sleeve 401 becomes translatable with the shifting tool. An exemplary shifting tool, for use to manipulate the sliding sleeve 401, including effecting its displacement for effecting a change in configuration of the flow control apparatus 200 from the installation configuration to the open configuration, is the SHIFT FRAC CLOSE™ tool available from NCS Multistage Inc.

In some embodiments, for example, in the installation configuration, the flow controller 250 is releasably retained relative to the housing 202 by one or more frangible interlocking members 228 (e.g. one or more shear pins). Referring to FIG. 2, the one or more frangible interlocking members 228 extend through receiving apertures 412 defined within the sliding sleeve 401 (which is coupled to the filter medium-defining counterpart 100, as above-described). Co-operatively, the coupling of the sliding sleeve 301 to the sliding sleeve 401 effects releasable retention of the sliding sleeve 301 to the housing 202 by the one or more frangible interlocking members 228 via the sliding sleeve 401. In some of these embodiments, the releasable retention of the flow controller 250 is for preventing inadvertent displacement of the flow controller 250 while the apparatus is being run in hole within the wellbore 102. In some embodiments, for example, the frangible interlocking member 228 is a shear pin. The releasable retention is configured such that mechanical fracture of the one or more frangible interlocking members 228 is effectible in response to application of a sufficient force to the sliding sleeve 401 (such as, for example, by a shifting tool, see below), with effect that the sliding sleeve 401 becomes released from retention relative to the housing 202. In some embodiments, for example, the direction of the applied force is in the first direction (e.g. the downhole direction), such that, after the release from the retention, continued application of force in the first direction effects a change in configuration of the flow control apparatus 200 from the installation configuration to the open configuration.

Figure 24:
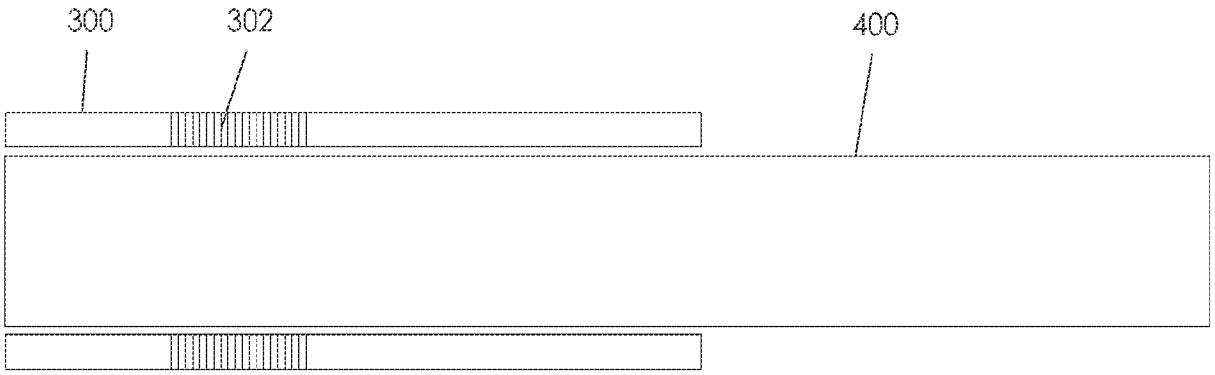
FIG. 24 is a schematic of the filter medium-defining counterpart and the shroud-defining counterpart when the flow control apparatus is in the open configuration.

To transition the flow control apparatus 200 from the installation configuration (see FIG. 2) to the open configuration (see FIG. 15), the disposition of the flow controller 250, relative to the flow communicator 210, is changed, with effect that the condition of the flow communicator 210 is changed from the closed condition to an open condition. While the flow communicator 210 is disposed in the open condition, fluid communication between the housing passage 224 and the external environment, for example, the subterranean formation 100 is present via the flow communicator 210. In some embodiments, for example, in the open condition, there is an absence of occlusion of the flow communicator 210 by the flow controller 250. In some embodiments, for example, in the open condition, there is an absence of occlusion of any portion of the flow communicator 210 by the flow controller 250. An example embodiment of the relative disposition of the sliding sleeve 301 and the sliding sleeve 401, in the open configuration, is depicted in FIG. 24.

In some embodiments, for example, the change in disposition of the flow controller 250 includes displacement of the occluding portion 310 of the sliding sleeve 301, relative to the flow communicator 210, with effect that the flow communicator 210 becomes disposed in the open condition. Because the sliding sleeve 301 and the sliding sleeve 401 are coupled together. In the first coupled configuration, the sliding sleeve 301 is translatable with the sliding sleeve 401 while the sliding sleeve 401 is being displaced, relative to the flow communicator 210, in the first direction (e.g. the downhole direction).

In this respect, while the flow control apparatus 200 is disposed in the installation configuration, in response to application of a force to the sliding sleeve 401 via the shifting tool in a first direction (for example, the downhole direction), an opening displacement of the sliding sleeve 401, relative to the flow communicator 210, is effected in the first direction, and the sliding sleeve 301, being coupled to the sliding sleeve 401, translates with the sliding sleeve 401. As a result, the flow controller 300 is sufficiently displaced in the first direction such that the flow communicator 210 becomes disposed in the open condition. In some embodiments, for example, the first direction is parallel to a longitudinal axis 226 of the housing passage 224. Where, in the installation configuration, the sliding sleeve 401 is releasably retained to the housing 202 by one or more frangible interlocking members 228, prior to the above-described translation, the retention, by the one or more frangible interlocking members 228, of the sliding sleeve 401 relative to the housing 202 is defeated (e.g. the frangible interlocking members 228 are fractured) in response to the applied force, and upon the defeating of the retention, the translation of the flow controller 250, with the shifting tool, is effected. In parallel, there is an absence of defeating of the releasably coupled relationship, between the sliding sleeve 301 and the sliding sleeve 401, being effected by the one or more frangible interlocking members 2600.

The flow control apparatus 300 is further configured such that, after the opening of the flow communicator 210, the flow controller 250 becomes disposed for manipulation, in response to a force applied by the shifting tool in the second direction, to effect re-closing of the flow communicator 210. To enable this, the housing 202 defines stops 214, 216, as depicted in FIGS. 2 and 27, for limiting (e.g. preventing) displacement of the sliding sleeve 301 and the sliding sleeve 401, respectively, relative to the flow communicator 210, in the first direction, and thereby defining the open configuration of the flow control apparatus 200.

The stop 214 is configured for becoming disposed in abutting engagement with an end surface 314 of the sliding sleeve 301 for limiting (e.g. preventing) displacement of the sliding sleeve 301, relative to the flow communicator 210, in the first direction. The stop 214, the flow controller 250, and the flow communicator 210 are co-operatively configured such that, while the end surface 314 of the sliding sleeve 301 is disposed in abutting engagement with the stop 214, the flow communicator 210 is disposed in the open condition.

In this respect, in some embodiments, for example, the stop 214, the flow controller 250, and the flow communicator 210 are further co-operatively configured such that, while the opening displacement is being effected, in response to disposition of the sliding sleeve 301 in an abutting engagement with the stop 214:

(i) displacement of the sliding sleeve 301, relative to the stop 214, in the first direction (e.g. the downhole direction) becomes prevented; and (ii) the coupling between the sliding sleeve 301 and the sliding sleeve 401 is defeated such that the flow controller 250 becomes disposed in a first uncoupled configuration, and the sliding sleeve 401 becomes displaceable relative to the sliding sleeve 301; and (iii) the sliding sleeve 401 is displaced, relative to the sliding sleeve 301 (which is now disposed in abutting engagement with the stop 214), in the first direction.

In some embodiments, for example, the defeating of the coupling between the sliding sleeve 301 and the sliding sleeve 401 includes fracturing of the one or more frangible Interlocking members 2600.

After the sliding sleeve 301 and the sliding sleeve 401 have become uncoupled, in response to the further displacement of the sliding sleeve 401, relative to the sliding sleeve 301, in the first direction (e.g. the downhole direction), the sliding sleeve 301 and the sliding sleeve 401 become releasably coupled, once again, in a second coupled configuration. The second coupled configuration is established in response to disposition of the shroud-defining counterpart engager 330 within the open configuration profile feature 406 (i.e. the recess 406), as depicted in FIG. 12. In this respect, the releasable coupling of the sliding sleeve 301 and the sliding sleeve 401, in the second coupled configuration, is established by the coupling system 5300.

In the second coupled configuration, the sliding sleeve 301 becomes translatable with the sliding sleeve 401 while the sliding sleeve 401 is being displaced, relative to the flow communicator 210, in the second direction (e.g. the uphole direction), as is described below.

Figure 15:
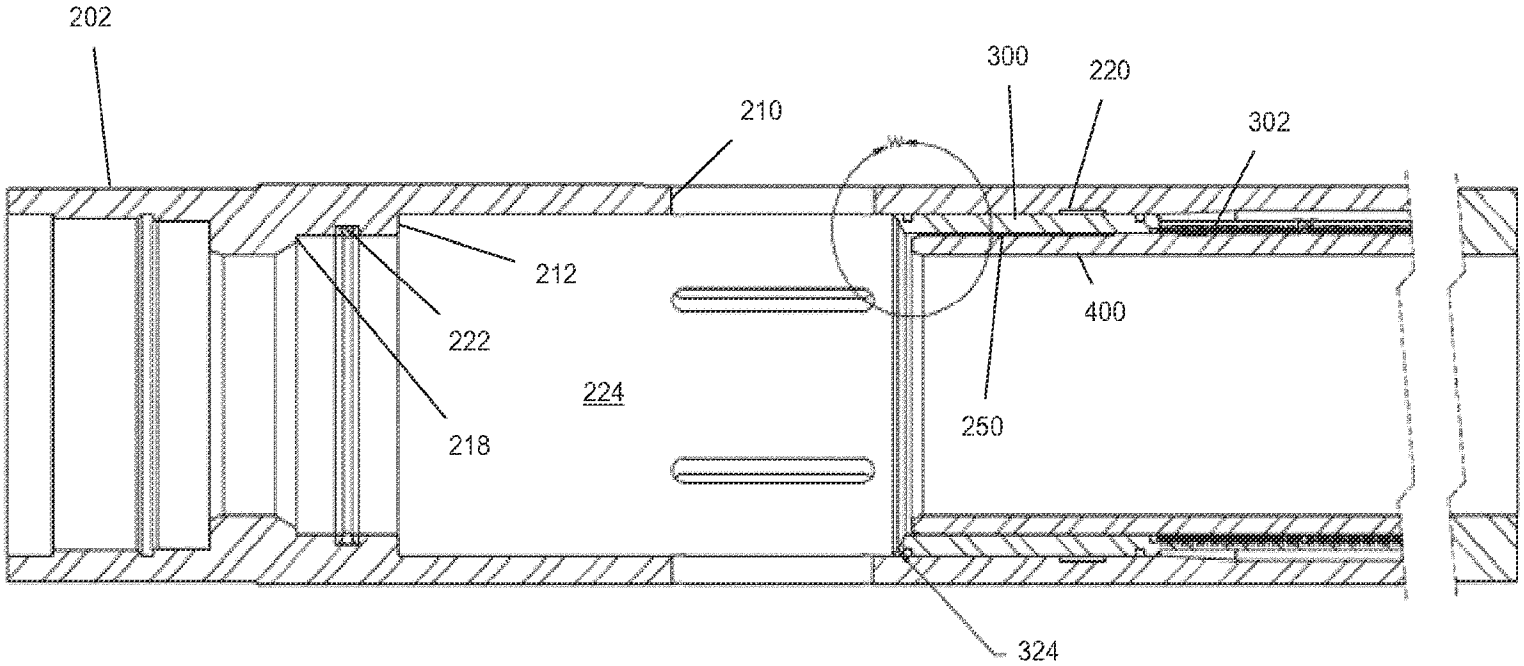
FIG. 15 is a cross-sectional view of the flow control apparatus of FIG. 2, illustrating the apparatus in an open configuration.

In this respect, in some embodiments, for example, while: (i) the flow controller 250 is disposed in the first uncoupled configuration, and the sliding sleeve 301 is disposed in abutting engagement with the stop 214 such that displacement of the sliding sleeve 301, relative to the stop 214, in the first direction (e.g. the downhole direction) is being prevented, (ii) the opening displacement of the sliding sleeve 401, relative to the flow communicator 210, continues to be being urged (e.g. by the shifting tool) in the first direction (e.g. the downhole direction):

the sliding sleeve 401 is displaced, relative to the sliding sleeve 301, in the first direction with effect that the coupling-stimulating profile 234 (of the filter medium-defining counterpart-engaging profile 230 defined on the passage-defining surface of the housing 202) becomes aligned with the coupling-stimulating profile engager 331 (that is extending from the sliding sleeve 301), such that the coupling-stimulating profile 234 urges displacement of the coupling-stimulating profile engager 331, with effect that the shroud-defining counterpart engager 330 become disposed within the open configuration profile feature 406 of the filter medium-defining counterpart-coupling profile 402, such that the sliding sleeve 301 becomes releasably coupled to the sliding sleeve 401, and such that the second coupled configuration is obtained, as depicted in FIG. 15.

The stop 216 is provided for becoming disposed in abutting engagement with an end surface 416 of the sliding sleeve 401 for limiting (e.g. preventing) displacement of the sliding sleeve 401, relative to the flow communicator 210, in the first direction, upon the second coupled configuration having been obtained. In this respect, the sliding sleeve 301, the sliding sleeve 401, and the stop 216 are co-operatively configured such that the abutting engagement of the sliding sleeve 401 with the stop 216 is effected upon the establishment of the second coupled configuration. The abutting engagement of the sliding sleeve 401 with the stop 216 defines the establishment of the open configuration of the flow control apparatus 200.

In some embodiments, for example, while the flow control apparatus 200 is disposed in the open configuration, the occluding of the filter medium 302 is being effected by the shroud 418, in a manner similar to that described above with respect to the installation configuration. In some embodiments, for example, while the flow control apparatus 200 is disposed in the open configuration, the sliding sleeve 301 and sliding sleeve 401 are co-operatively disposed such that the shroud 418 shields the filter medium 302 from material within the housing passage 224. In some embodiments, for example, the shielding is effected by occlusion of the filter medium 302 by the sliding sleeve 401, such as the shroud 418.

In some embodiments, for example, while the flow control apparatus 200 is disposed in the open configuration, the flow communicator 210 and the flow controller 250 are co-operatively disposed such that the housing 202 shields the filter medium 302 from the external environment, such as the subterranean formation 100. In some embodiments, for example, the shielding is effected by occlusion of the filter medium 302 by the housing 202.

In some embodiments, for example, while the flow control apparatus 200 is disposed in the open configuration, there is an absence of alignment between any portion of the filter medium 302 and the flow communicator 210, as depicted in FIG. 15.

In some embodiments, for example, while the flow control apparatus 200 is disposed in the open configuration, the housing 202 and the flow controller 250 are co-operatively configured such that the flow controller 250 is releasably retained, relative to the housing 202, for preventing inadvertent closing of the flow communicator 210, which may, for example, interfere with a stimulation operation. In this respect, the sliding sleeve 401 is retained to the housing 202 with a collet retainer, in a similar way to that described in U.S. patent application Ser. No. 14/830,531. In parallel, by virtue of the releasable coupling of the sliding sleeve 301 to the sliding sleeve 401 in the second coupled configuration, the sliding sleeve 301 is also retained to the housing 202.

During the change in configuration of the flow control apparatus 200 from the installation configuration to the open configuration, in addition to effecting opening of the flow communicator 210, the sliding sleeve 301 is re-positioned relative to the sliding sleeve 401 such that the condition of the flow controller 250 changes from the first coupled configuration to the second coupled configuration. In changing the configuration of the flow controller 250 from the first coupled configuration to the second coupled configuration, the retainable profile engager 304 becomes disposed closer to a first end of the sliding sleeve 401 (for example, as depicted in FIG. 15, uphole end of the sliding sleeve 401). This facilitates disposition of the flow control apparatus 200 in the production configuration, as is further explained below.

Figure 16:
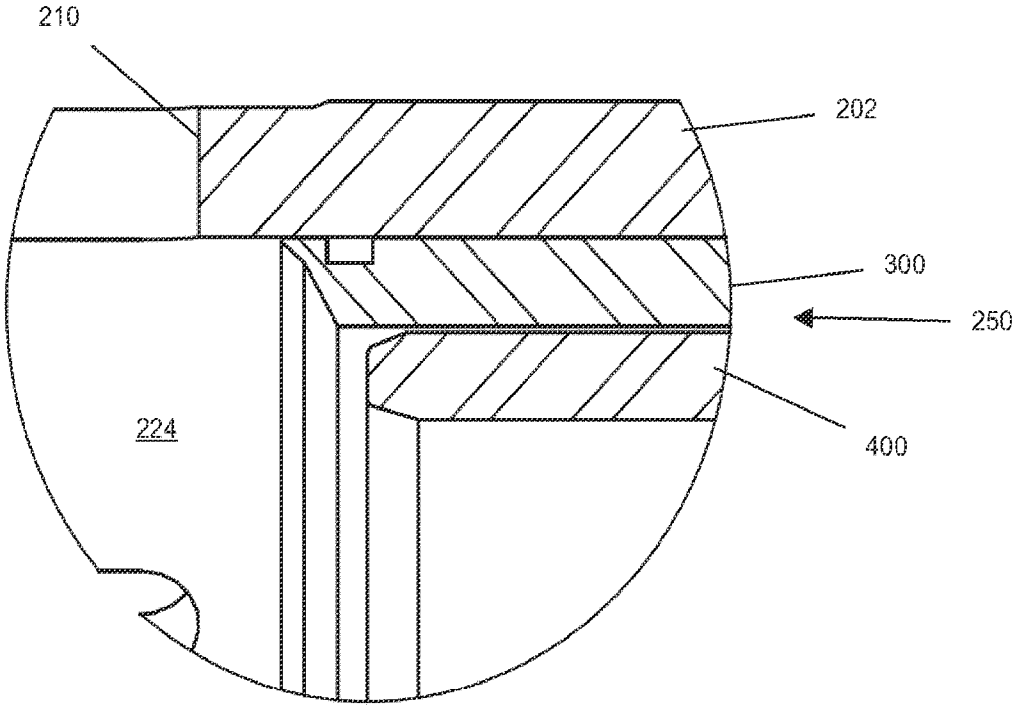
FIG. 16 is an enlarged view of the portion of the flow control apparatus of FIG. 15, the portion identified by window W shown in FIG. 15.

While the sliding sleeve 401 is disposed in an abutting engagement with the stop 216, the flow communicator 210 is disposed in the open condition, and the flow control apparatus 200 is disposed in the open configuration, as depicted in FIG. 15 and FIG. 16. Accordingly, the subterranean formation 100 may now be stimulated (for production of hydrocarbon material) by flowing treatment material from the surface 10 to the subterranean formation 100 via the flow communicator 210.

After the stimulation, it is desirable to effect closing of the flow communicator 210 and, in this respect, effect a change in configuration of the flow control apparatus 200 from the open configuration (see FIG. 15) to the closed configuration (see FIG. 17). In effecting a change in the configuration of the flow control apparatus 200 from the open configuration to the closed configuration, the disposition of the flow controller 250, relative to the flow communicator 210, is changed, with effect that the condition of the flow communicator 210 is changed from the open condition to the closed condition. An example embodiment of the relative disposition of the sliding sleeve 301 and the sliding sleeve 401, in the closed configuration, is depicted in FIG. 25.

In some embodiments, for example, while the flow control apparatus 200 is disposed in the closed configuration, the sliding sleeve 301 and sliding sleeve 401 are co-operatively disposed such that the shroud 418 shields the filter medium 302 from material within the housing passage 224. In some embodiments, for example, the shielding is effected by occlusion of the filter medium 302 by the sliding sleeve 401, such as the shroud 418.

As described above, in the closed configuration, the sliding sleeve 301 and the sliding sleeve 401 are coupled in a second coupled configuration, and in the second coupled configuration, the sliding sleeve 301 is translatable with the sliding sleeve 401 while the sliding sleeve 401 is being displaced, relative to the flow communicator 210, in the second direction (e.g. the uphole direction).

In this respect, while the flow control apparatus 200 is disposed in the open configuration, to effect a change in disposition of the flow communicator 210 from the open condition to the closed condition, a closing displacement of the sliding sleeve 401, relative to the flow communicator 210, is effected (such as, for example, a shifting tool) in the second direction (e.g. the uphole direction). In some embodiments, for example, the second direction is parallel to a central longitudinal axis 226 of the housing passage 224. Since, in the open configuration, the sliding sleeve 301 is releasably coupled to the sliding sleeve 401 in the second coupled configuration, the sliding sleeve 301 is translatable with the sliding sleeve 401 in the second direction (e.g. the uphole direction) and, therefore, translates with the sliding sleeve 401 in response to the closing displacement of the sliding sleeve 401, with effect that the flow communicator 210 becomes disposed in the closed condition. In some embodiments, for example, the closing displacement also effects releasing of the flow controller 250 from the retention by the collet retainer (see above).

In some embodiments, for example, while the flow control apparatus 200 is disposed in the open configuration, the sliding sleeve 401 is disposed for engagement with a shifting tool (such as, for example, the same shifting tool used to effect the opening displacement), with effect that the sliding sleeve 401 becomes translatable with the shifting tool, and translates with the shifting tool, in response to application of a force (such as, for example, a pulling up force exerted via coiled tubing) to the shifting tool in the second direction (e.g. the uphole direction).

Figure 5:
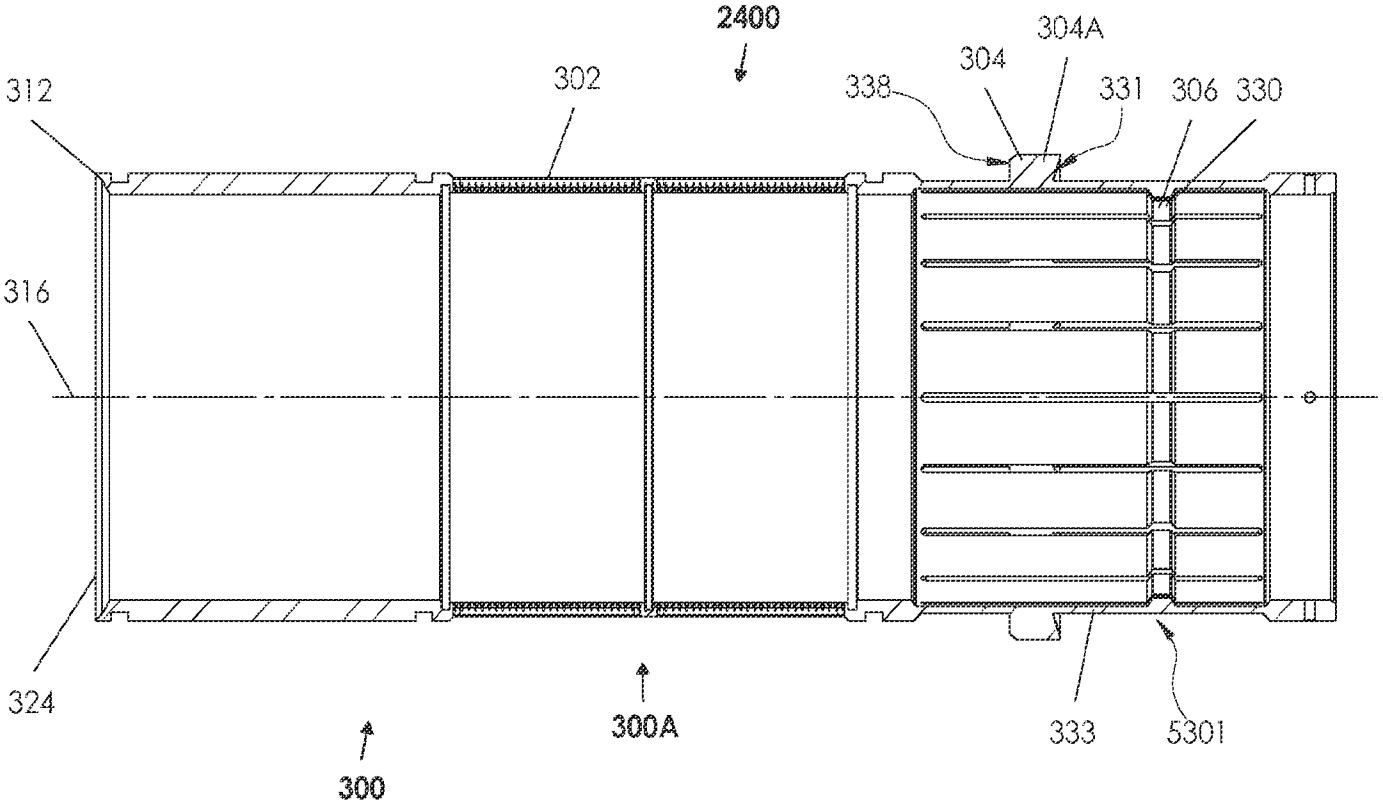
FIG. 5 is a cross-sectional view of an embodiment of a filter medium-defining counterpart of the flow control apparatus of FIG. 2.
Figure 6:
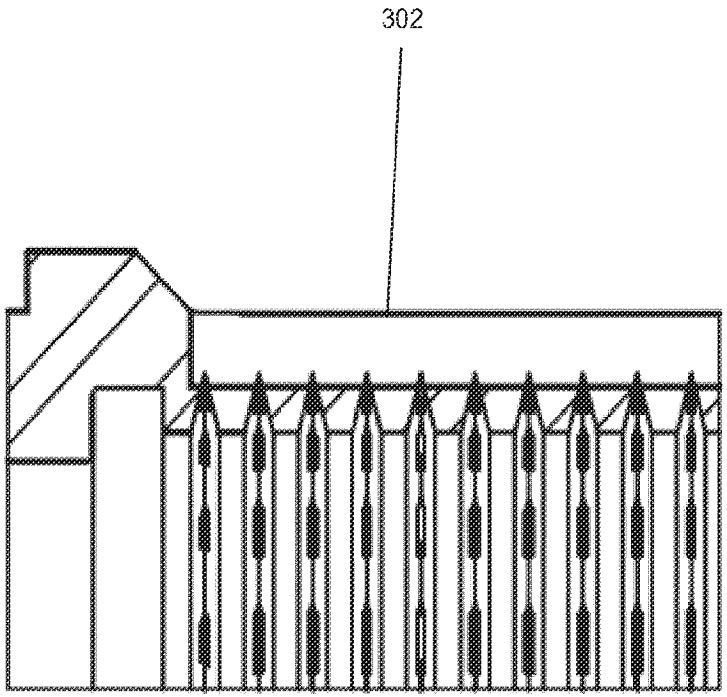
FIG. 6 is an enlarged view of the portion of the filter medium-defining counterpart of FIG. 5, the portion identified by window AE shown in FIG. 5.

In some embodiments, for example, an uphole end of the sliding sleeve 301 defines a knife edge 324, as depicted in FIG. 5. The knife edge 324 is configured to clean the housing passage 224, for example, clean the housing passage 224 of sand after a stimulation process has been conducted. While the sliding sleeve 301 is translating with the sliding sleeve 401 during the closing displacement, for changing the configuration of the flow control apparatus 200 from the open configuration to the closed configuration, the knife edge 324 is disposed for effecting such cleaning of the housing passage 224.

The housing 202 defines a stop 218, as depicted in FIG. 2, FIG. 17, and FIG. 27, for limiting (e.g. preventing) displacement of the sliding sleeve 401, relative to the flow communicator 210, in the second direction, and thereby establishing the closed configuration of the flow control apparatus 200.

During the closing displacement, the retainable profile engager 304 becomes aligned with the filter medium-defining counterpart-retaining profile-defined recess 220, as depicted in FIGS. 17 to 20. Owing to the bias of the coupling-stimulating profile engager 331, the retainable profile engager 304 is urged into disposition within the filter medium-defining counterpart-retaining profile-defined recess 220, as depicted in FIGS. 18 and 19, such that the retention of the filtering medium 302, relative to the flow communicator 210, is effected by the filter medium-positioning system 2511. By virtue of the retention of the filter medium 302, the sliding sleeve 301 becomes retained, relative to the housing 202, and is prevented from displacement, relative to the flow communicator 210, in both of the first direction and the second direction (e.g. the uphole direction).

The housing 202, the flow controller 250, and the flow communicator 210 are further co-operatively configured such that, while the closing displacement is being effected, in response to alignment of the retainable profile engager 304 with the filter medium-defining counterpart-retaining profile-defined recess 220:

(i) the sliding sleeve 301 becomes retained relative to the flow communicator 210;

(ii) the filter medium 302 of the sliding sleeve 301 becomes disposed in flow communication (e.g. alignment) with the flow communicator 210 (for enabling the obtaining of production configuration, as described below);

(iii) the coupling between the sliding sleeve 301 and the sliding sleeve 401 is defeated such that the flow controller 250 becomes disposed in a second uncoupled configuration, with effect that the sliding sleeve 401 becomes displaceable relative to the sliding sleeve 301; and (iv) the sliding sleeve 401 is displaced, relative to the retained sliding sleeve 301, in the second direction.

In some embodiments, for example, the defeating of the coupling between the sliding sleeve 301 and the sliding sleeve 401 includes a deflection of the shroud-defining counterpart engager 330 relative to the open configuration profile feature 406. In some embodiments, for example, the deflection of the shroud-defining counterpart engager 330 relative to the open configuration profile feature 406 is effected by deflection of the resilient portion 333 of the sliding sleeve 301. In this respect, the coupling between the sliding sleeve 301 and the sliding sleeve 401, effected by the coupling system 5300, is defeated.

After the sliding sleeve 301 and the sliding sleeve 401 have become uncoupled and disposed in the second uncoupled configuration, as above-described, in response to the further displacement of the sliding sleeve 401, relative to the sliding sleeve 301, in the second direction (e.g. the uphole direction), the sliding sleeve 301 and the sliding sleeve 401 become coupled, once again, in a third coupled configuration. The third coupled configuration is established in response to disposition of the shroud-defining counterpart engager 330 within the closed configuration profile feature 408 (i.e. the recess 408), as depicted in FIG. 18. In this respect, the third coupled configuration is established by the coupling system 5300.

In this respect, in some embodiments, for example, while: (i) the flow controller 250 is disposed in the second uncoupled configuration, and the sliding sleeve 301 is retained relative to the flow communicator 210 such that displacement of the sliding sleeve 301, relative to the flow communicator 210, is being prevented, (ii) the closing displacement of the sliding sleeve 401, relative to the flow communicator 210, continues to be being urged (e.g. by the shifting tool) in the second direction (e.g. the uphole direction):

the sliding sleeve 401 is displaced, relative to the sliding sleeve 301, in the second direction with effect that the coupling-stimulating profile 234 (of the filter medium-defining counterpart-engaging profile 230 defined on the passage-defining surface of the housing 202) becomes aligned with the coupling-stimulating profile engager 331 (that is extending from the sliding sleeve 301), such that the coupling-stimulating profile 234 urges displacement of the coupling-stimulating profile engager 331, with effect that the shroud-defining counterpart engager 330 become disposed within the closed configuration profile feature 408 of the filter medium-defining counterpart-coupling profile 402, such that the sliding sleeve 301 becomes releasably coupled to the sliding sleeve 401, and such that the third coupled configuration is obtained.

The stop 218 is provided for becoming disposed in abutting engagement with an end surface 414 of the sliding sleeve 401 for limiting (e.g. preventing) displacement of the sliding sleeve 401, relative to the flow communicator 210, in the second direction, upon the third coupled configuration having been obtained. In this respect, the sliding sleeve 301, the sliding sleeve 401, and the stop 218 are co-operatively configured such that the abutting engagement of the sliding sleeve 401 with the stop 218 is effected upon the establishment of the third coupled configuration, as depicted in FIG. 17. The abutting engagement of the sliding sleeve 401 with the stop 218 defines the establishment of the closed configuration of the flow control apparatus 200. In this position, the sliding sleeve 401 is disposed relative to the sliding sleeve 301 such that the occluding of the filter medium 302 is being effected by the shroud 418, in a manner similar to that described above with respect to the installation configuration and with respect to the open configuration. As well, the combination of: (i) the disposition of the sliding sleeve 401 in abutting relationship with the stop 218 (ii) the coupling of the sliding sleeve 301 and the sliding sleeve 401 in the third coupled configuration, and (iii) the retention of the sliding sleeve 301 relative to the housing 202 by the disposition of the retainable profile engager 304 within the filter medium-defining counterpart-retaining profile 236, is with effect that an inadvertent change in the configuration of the flow controller 250 is prevented.

In this respect, during the change in configuration of the flow control apparatus 200 from the open configuration to the closed configuration, in addition to effecting closing of the flow communicator 210, the filter medium 302 of the sliding sleeve 301 becomes retained, relative to the housing 202, and disposed in alignment with the flow communicator 210, for effecting filtering of oversize solids from hydrocarbon material being produced through the flow communicator 210, once the sliding sleeve 401 is moved out of the way of the flow communicator 210.

With the flow control apparatus 200 disposed in the closed configuration after the stimulation operation, as depicted in FIGS. 17 to 20, the subterranean formation is provided an opportunity to heal. As well, another stimulation operation can be carried out in another zone via another flow communication station, without incurring losses of treatment material through a previously treated zone.

After sufficient time has elapsed for effecting the desired stimulation and allowing the subterranean formation 100 sufficient time to heal, and it is desirable to begin producing hydrocarbon material via the flow communicator 210, the flow control apparatus 200 is manipulated such that a change in configuration, from the closed configuration (see FIG. 17) to the production configuration (see FIG. 21), is obtained. In effecting a change in the configuration of the flow control apparatus 200 from the closed configuration to the production configuration, the disposition of the flow controller 250, relative to the flow communicator 210, is changed, with effect that the flow controller 250 and the flow communicator 210 become co-operatively disposed such that flow communication is effected between the subterranean formation 100 and the housing passage 224 via the flow communicator, and the filter medium is disposed between the flow communicator 210 and the housing passage 224, such that a screened flow communicator is obtained for removing oversize solids from material being flowed, via the screened flow communicator, from the subterranean formation 100 and to the housing passage 224. An example embodiment of the relative disposition of the sliding sleeve 301 and the sliding sleeve 401, in the production configuration, is depicted in FIG. 26.

In some embodiments, for example, the flow communicator 210 and the flow controller 250 are co-operatively configured such that, while the flow control apparatus 200 is disposed in the production configuration, the filter medium 302 is occluding at least a screened portion of the flow communicator 210, and there is an absence of occlusion, of the at least a screened portion of the flow communicator 210, by the sliding sleeve 401. In some embodiment, for example, the at least a screened portion of the flow communicator 210 defines at least 25% of the available cross-sectional flow area of the flow communicator 210, such as, for example, at least 50% of the available cross-sectional flow area of the flow communicator 210, such as, for example, at least 75% of the available cross-sectional flow area of the flow communicator 210. In some embodiments, for example, the filter medium 302 is occluding the entirety of the flow communicator 210, such that a fully screened flow communicator is defined, and there is an absence of occlusion of the fully screened flow communicator by the sliding sleeve 401.

To effect a change in the configuration of the flow control apparatus 200 from the closed configuration to the production configuration, the sliding sleeve 401 is forced to undergo a second opening displacement, whereby the sliding sleeve 401 is displaced, relative to the flow communicator 210, in the first direction (e.g. the downhole direction). In some embodiments, for example, the second opening displacement is effectible with a shifting tool (such as, for example, the same shifting tool used to effect the first opening displacement and the closing displacement).

In the closed configuration, the sliding sleeve 301 is releasably coupled to the sliding sleeve 401, by the co-operative disposition between the shroud-defining counterpart engager 330 and the closed configuration profile 408 (e.g. the recess 408). In response to a force that is applied to the sliding sleeve 401 in the first direction (e.g. by the shifting tool), the releasable coupling of the sliding sleeve 301 to the sliding sleeve 401 is defeated such that the sliding sleeve 401 becomes uncoupled relative to the filter medium-defining counterpart and, therefore, displaceable relative to the sliding sleeve 301. In this respect, the defeating of the releasable coupling is with effect that the flow controller becomes disposed in a third uncoupled configuration. In some embodiments, for example, the defeating of the coupling between the sliding sleeve 301 and the sliding sleeve 401 includes a deflection of the engager 330 relative to the closed configuration profile 408. In some embodiments, for example, the deflection of the engager 330 relative to the profile 408 is effected by deflection of the resilient portion 333 of the sliding sleeve 301. In this respect, the releasable coupling in the third coupled configuration, being effected by the coupling system 5300, is defeated.

While the force being applied in the first direction by the shifting tool is sufficient to defeat the releasable coupling effected by the coupling system 5300, the force is insufficient to effect release of the sliding sleeve 301 from the retention relative to the housing 202 (being effected by the filter medium-positioning system 2511), such that the sliding sleeve 301 remains retained relative to the housing 202. In this respect, the housing 202, the flow communicator 210, and the flow controller 250 are co-operatively configured such that, while the flow control apparatus 200 is disposed in the closed configuration, in response to application of a force to the sliding sleeve 401 in the first direction: (i) the releasable coupling of the sliding sleeve 301 and sliding sleeve 401 is defeated; and (ii) there is an absence of release of the sliding sleeve 301 from the retention relative to the housing 202.

In response to further urging of the second opening displacement (for example, by the shifting tool) of the sliding sleeve 401, relative to the flow communicator 210, in the first direction (e.g. the downhole direction), the sliding sleeve 401 is displaced, relative to the sliding sleeve 301, in the first direction. This results in the flow communicator 210 becoming disposed in the screened condition (as the filter medium 302 continues to remain disposed in flow communication with the flow communicator 210, as the sliding sleeve 301 does not translate with the sliding sleeve 401, owing to the retention of the sliding sleeve 301 relative to the housing 202, as depicted in FIG. 22), and production of hydrocarbon material from the subterranean formation 100 and into the wellbore 102, via the screened flow communicator 210, is, therefore, effectible (see FIGS. 21 and 22). Co-operatively, the displacement of the sliding sleeve 401, relative to the sliding sleeve 301, effects the displacement of shroud 418 relative to the filter medium 302 (which is disposed in alignment with the flow communicator 210) such that the shroud 418 is no longer blocking flow communication via the filter medium 302, and such that flow of hydrocarbon material can be effected from the subterranean formation 100 to the housing passage 224 via the combination of the flow communicator 210 and the filter medium 302.

In some embodiments, for example, the housing 202 and the flow controller 250 are further co-operatively configured such that, while the flow controller 250 is disposed in the third uncoupled configuration, and the second opening displacement of the sliding sleeve 401, relative to the sliding sleeve 301, is being urged (for example, by a shifting tool) in the first direction (e.g. the downhole direction) with effect that the sliding sleeve 401 is being displaced relative to the sliding sleeve 301 in the first direction, in response to disposition of the end surface 415 of the sliding sleeve 401 in an abutting engagement with the stop 216, displacement of the sliding sleeve 401, relative to the stop 216 (and, also, the flow communicator 210), in the first direction (e.g. the downhole direction) becomes prevented, and thereby establishing the production configuration of the flow control apparatus 200. In some embodiments, for example, in parallel, during the second opening displacement, the sliding sleeve 301 and the sliding sleeve 401 become coupled, once again, in a fourth coupled configuration. The fourth coupled configuration is established in response to disposition of the shroud-defining counterpart engager 330 within the production configuration profile feature 410 (i.e. the recess 410), as depicted in FIG. 21. In the fourth coupled configuration, inadvertent displacement of the sliding sleeve 401, relative to the sliding sleeve 301, may be prevented, thereby mitigating re-closing of the flow communicator 210. In those embodiments where the housing 202 includes the collet retainer, in some of these embodiments, while the flow control apparatus 200 is disposed in the production configuration, with the sliding sleeve 401 disposed in abutting engagement with the stop 216, the sliding sleeve 401 is releasably retained by the collet retainer to further mitigate inadvertent displacement of the sliding sleeve 401 relative to the sliding sleeve 301, which could occlude the flow communicator 210 and thereby compromise production. Co-operatively, in those embodiments where the sliding sleeve 301 and the sliding sleeve 401 becomes coupled in the fourth coupled configuration during the second opening displacement, in some of these embodiments, for example, the sliding sleeve 301 also becomes releasably retained by the collet retainer, by virtue of its coupling to the sliding sleeve 401.

As described herein, and as depicted in FIG. 2, the sliding sleeve 301 includes the occluding portion 310, and the closing of the flow communicator 210 is effected by the occluding portion 310. In some embodiments, while the flow control apparatus 200 is in the installation configuration, as depicted in FIG. 2, the occluding portion 310 is disposed relative to the flow communicator 210 for effecting disposition of the flow communicator 210 in the closed condition. In some embodiments, for example, while the flow control apparatus 200 is in the installation configuration, the sliding sleeve 301 and the sliding sleeve 401 are co-operatively disposed such that the shroud 418 shields the filter medium 302 from material within the housing passage 224, and the flow communicator 210 and the flow controller 250 are co-operatively disposed such that the housing 202 shields the filter medium 302 from the external environment, such as the subterranean formation 100.

Other configurations of the sliding sleeve 301 and the sliding sleeve 401 are possible, where the sliding sleeve 301 does not include an occluding portion 310.

Figure 28:
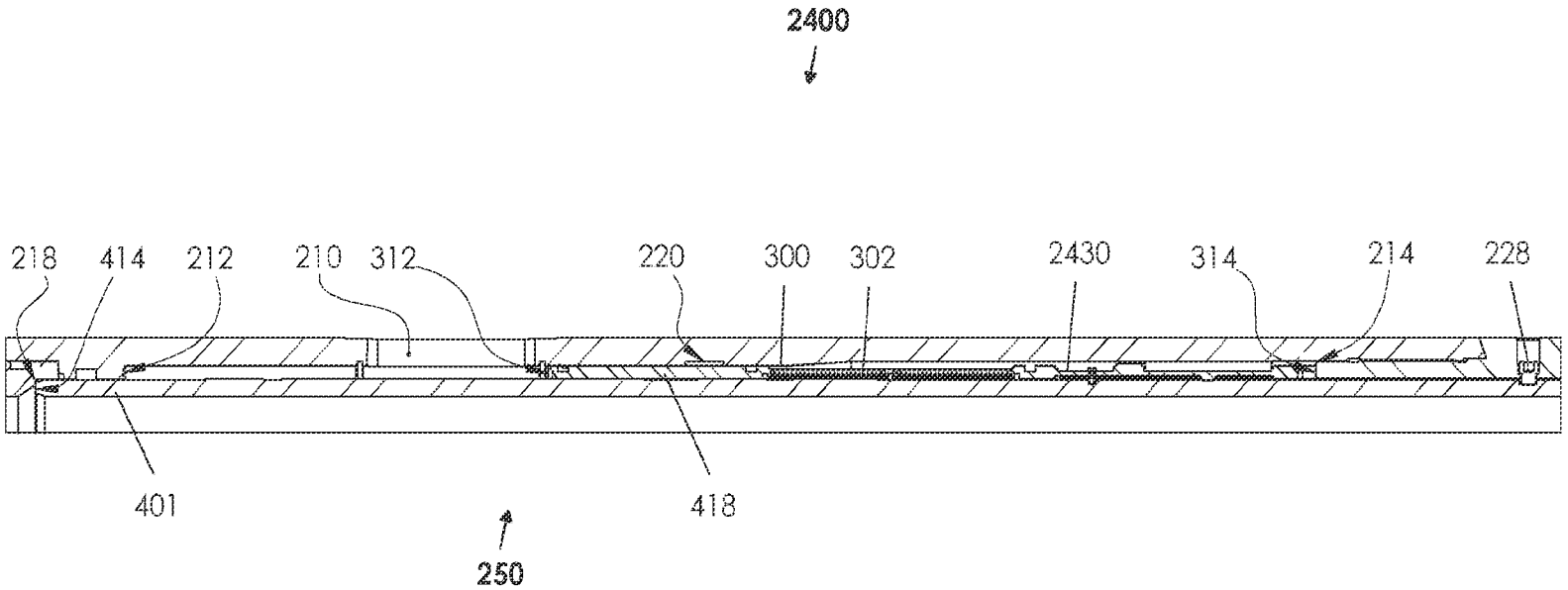
FIG. 28 is a cross-sectional view of another embodiment of a flow control apparatus for use within the system of FIG. 1, illustrating the apparatus in an installation configuration.
Figure 29:
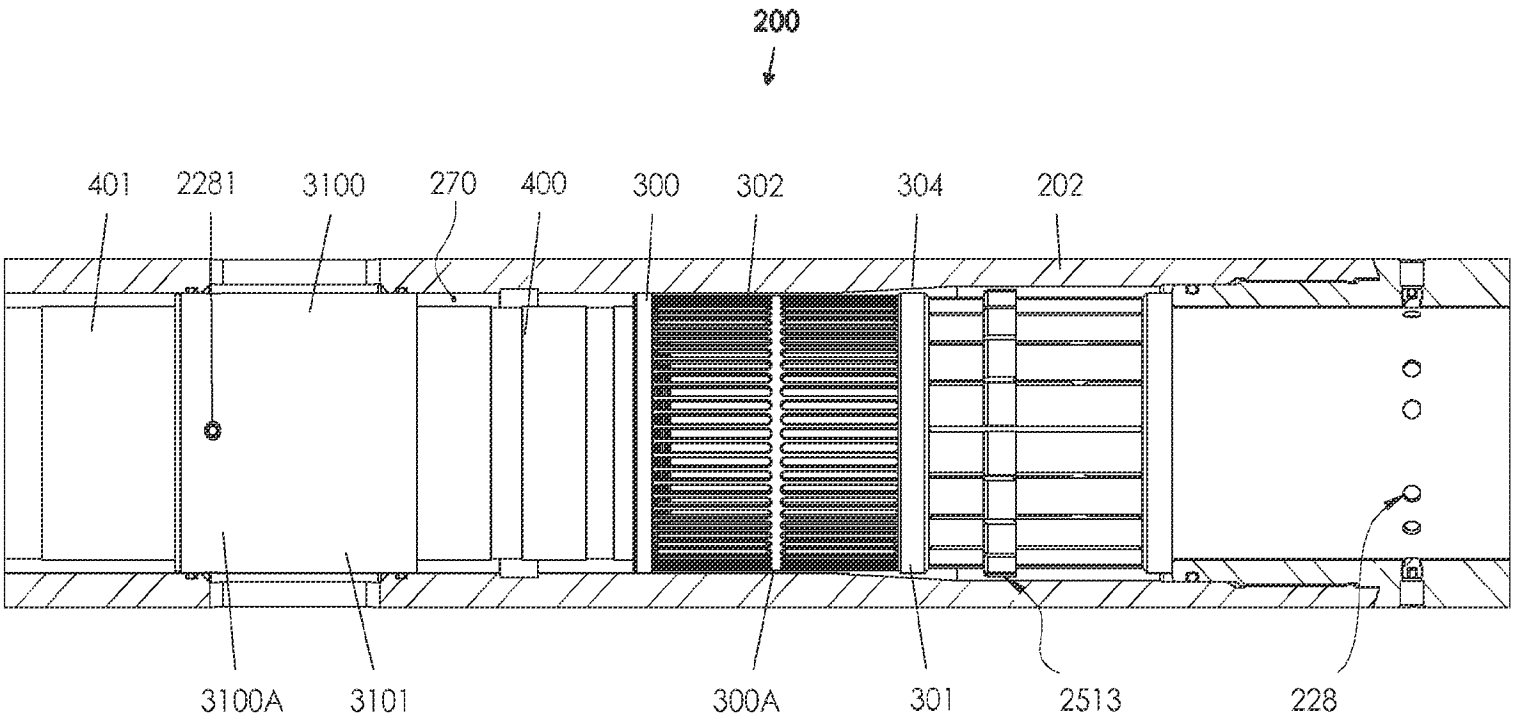
FIG. 29 is a schematic, cross-sectional view, in perspective, of another embodiment of a flow control apparatus for use within the system of FIG. 1, illustrating the apparatus in an installation configuration.
Figure 30A:
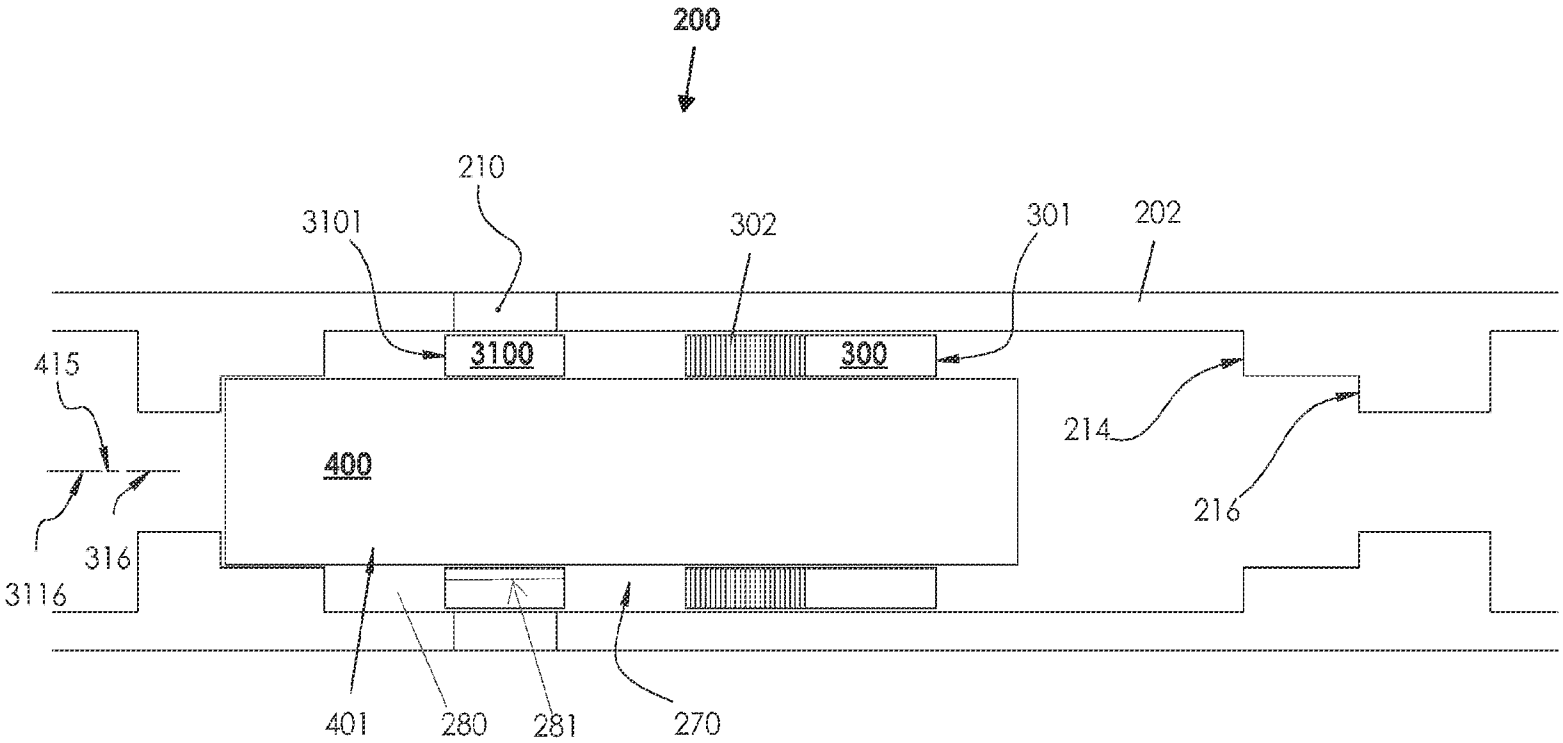
FIGS. 30A, 30B, 30C, and 30D are schematic illustrations of the flow control apparatus of FIG. 29 in installation, open, closed, and production configurations, respectively.
Figure 30B:
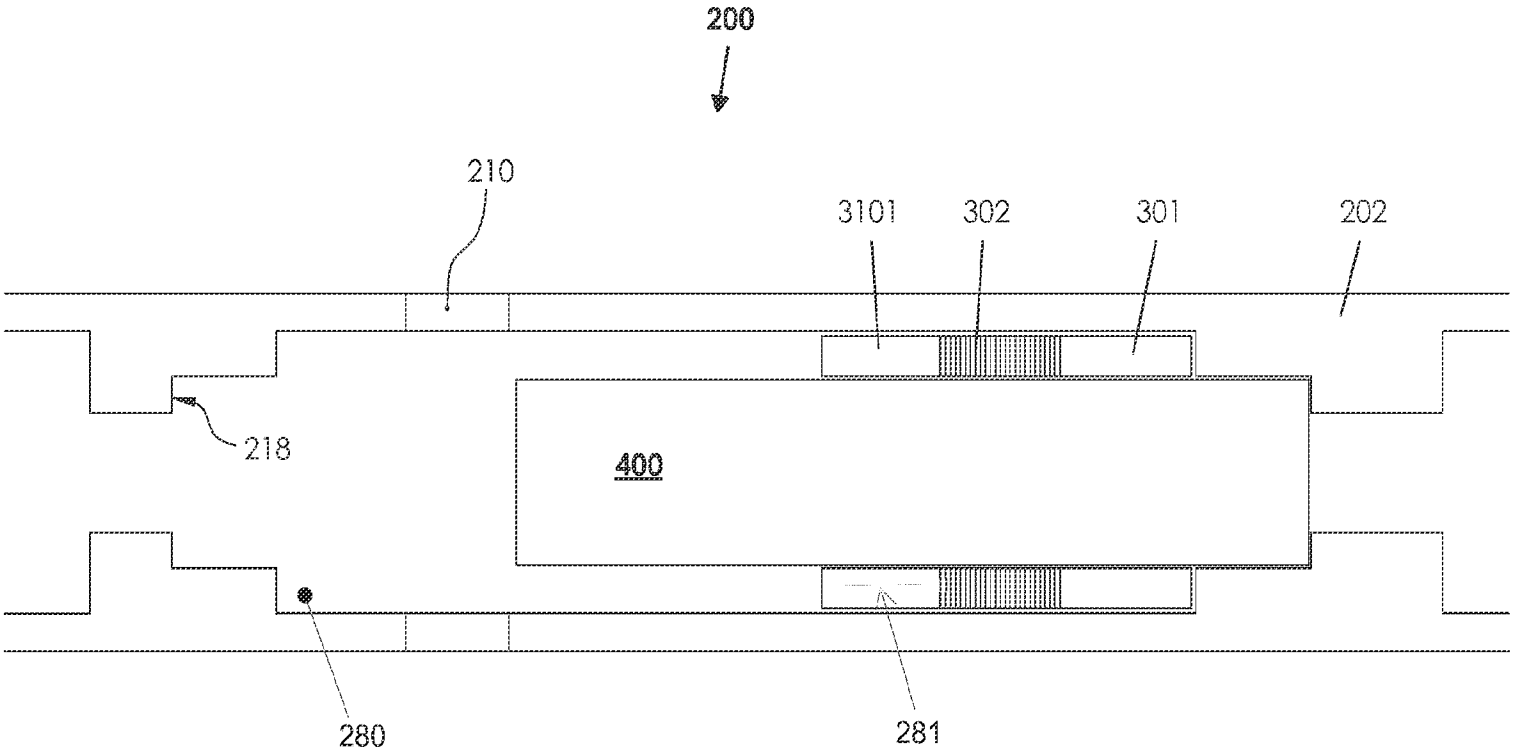
Figure 30C:
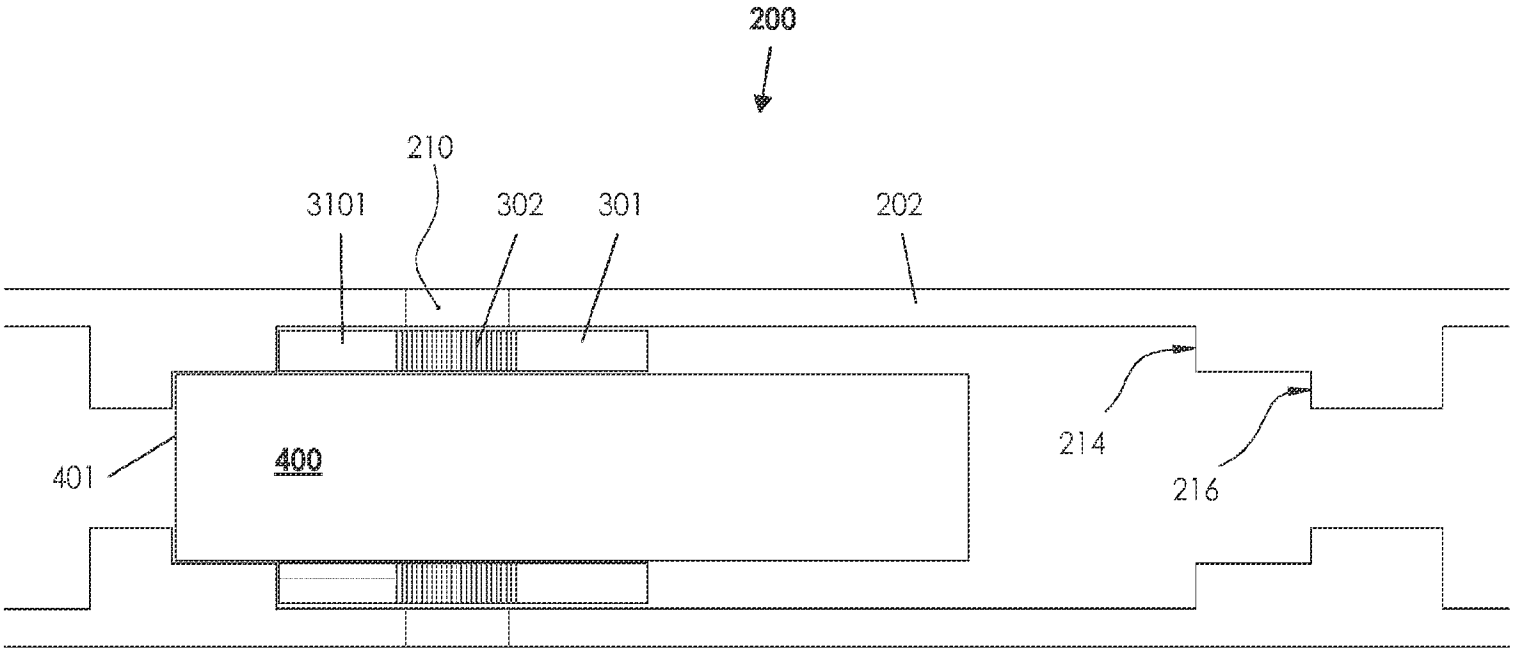
Figure 30D:
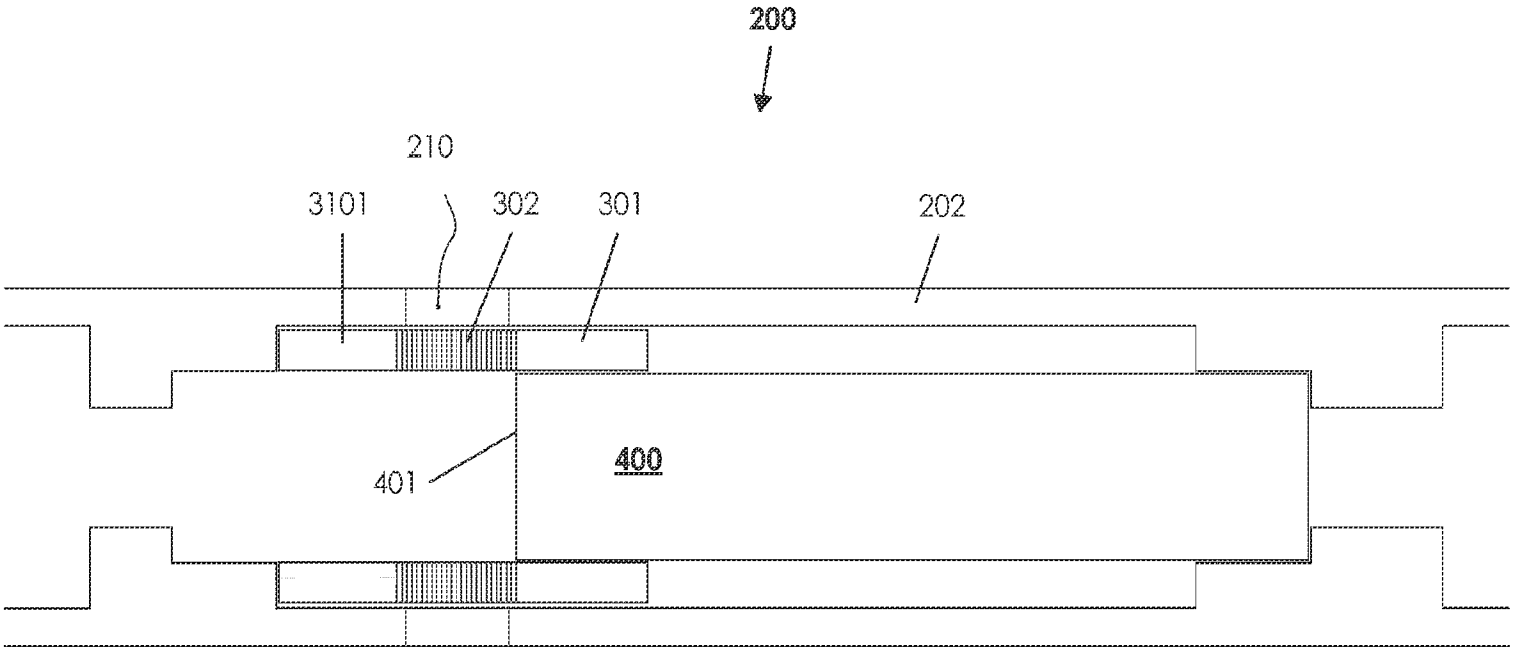
Figure 31:
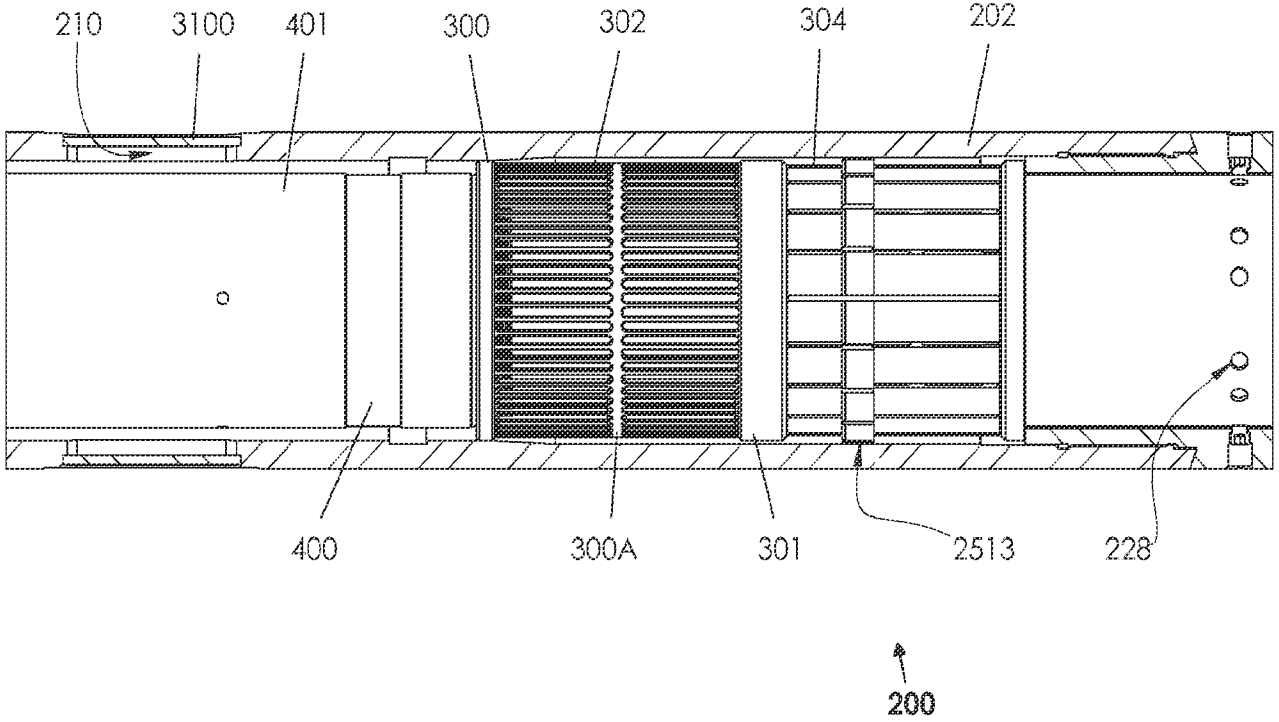
FIG. 31 is a schematic, cross-sectional view, in perspective, of another embodiment of a flow control apparatus for use within the system of FIG. 1, illustrating the apparatus in an installation configuration.
Figure 32:
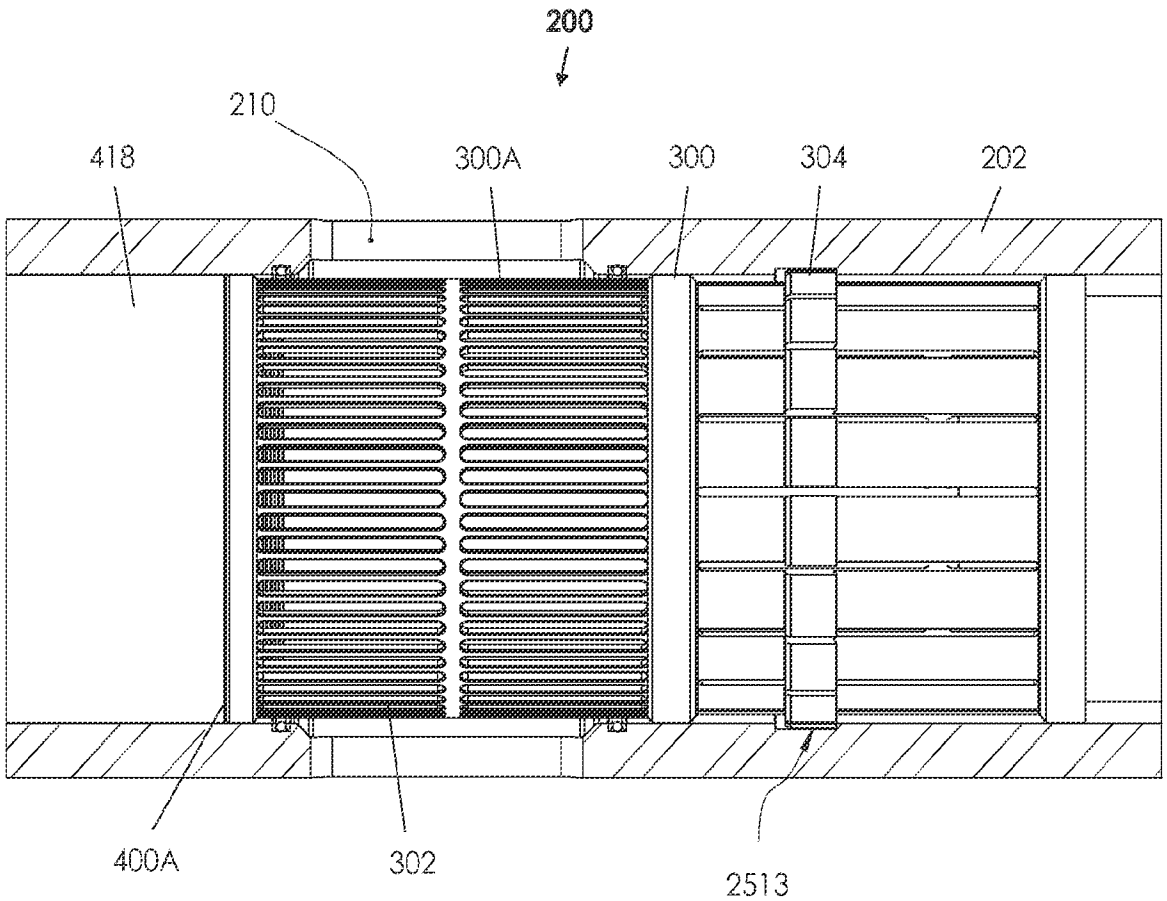
FIG. 32 is a schematic, cross-sectional view, in perspective, of another embodiment of the flow control apparatus of FIG. 31, illustrating the apparatus in an installation configuration.

FIG. 28 is a cross-sectional view of another embodiment of a flow control apparatus 2400 for use within the system 100 of FIG. 1, illustrating the apparatus 200 in an installation configuration. As depicted in FIG. 28, the flow control apparatus 2400 has a flow controller 250 that includes a filter medium-defining counterpart 2430 and a sliding sleeve 401 as described herein. The flow control apparatus 2400 is generally similar to flow control apparatus 200, except the filter medium-defining counterpart 2430 does not include a flow modulator that corresponds to the occluding portion 310 of the sliding sleeve 301. As depicted in FIG. 28, while the apparatus 2400 is in the installation configuration, the closing of the flow communicator 210 is effected by occlusion of the flow communicator 210 by the sliding sleeve 401.

Referring to FIGS. 29 30A, 20B, 30C, and 30D, in those embodiments where the flow controller 250 includes a filter medium-defining counterpart 300 and the shroud-defining counterpart 400, in some of these embodiments, for example, the flow controller 250 further includes a flow communicator-occluding counterpart 3100, and the flow communicator-occluding counterpart 3100 includes a flow regulator 3100A, and the flow regulator 3100A includes the occluding portion 310. In this respect, unlike the embodiments illustrated in FIGS. 2 to 27, the flow regulator 300A of the filter medium-defining counterpart 300 does not include the occluding portion 310, and the occluding portion 310 is disposed on a part (i.e. the flow communicator-occluding counterpart 3100) that is separate from the filter medium-defining counterpart 300.

In some of these embodiments, for example, each one of the filter medium-defining counterpart 300, the flow communicator-occluding counterpart 3100, and the shroud-defining counterpart 400, independently, is in the form of a sliding sleeve. The sliding sleeve 401 of the shroud-defining counterpart 400 is nested within both of the sliding sleeve 301 of the filter medium-defining counterpart 300 and the sliding sleeve 3101 of the filter medium-defining counterpart 300. In some embodiments, for example, the sliding sleeves 301, 3100, and 401 are concentric. In some embodiments, for example, the housing 202 and the sliding sleeves 301, 3100, and 401 are concentric. In some embodiments, for example, the sliding sleeve 301 includes a central longitudinal axis 316, the sliding sleeve 3101 includes a central longitudinal axis 3116, and the sliding sleeve 401 includes a central longitudinal axis 415, and in some of these embodiments, for example, the axes 316, 3116, and 415 are coincident with each other. In this respect, in some embodiments, to accommodate the sleeves 301, 3101, 401, the housing 202 has a cylindrical, or generally cylindrical shape, having a circular, or generally circular axial cross-section, such that the flow control apparatus 200 has a cylindrical, or generally cylindrical shape. Also in this respect, the shroud 418 is defined by a circumferential portion of the shroud-defining counterpart 400.

In some of these embodiments, for example, while the apparatus 200 is disposed in the installation configuration, the occluding portion 310, of the sliding sleeve 3101, effects occluding of the flow communicator 210, such that the flow communicator 210 is disposed in the closed condition. As well, the sliding sleeve 3101 and the shroud-defining counterpart 400 are coupled together by one or more frangible interlocking members 2281 (e.g. one or more shear pins). Such coupling relationship enables translation of the sliding sleeve 3101 with the shroud-defining counterpart 400, in response to application of a force to the shroud-defining counterpart 400 via a shifting tool (such as, for example, a force from fluid within the wellbore string passage that is transmitted to the shroud-defining counterpart 400 by the shifting tool), as described above.

Also, while the apparatus 200 is disposed in the installation configuration, the sliding sleeve 301 is spaced apart from the sliding sleeve 3101 and positioned for becoming disposed in abutting engagement with the sliding sleeve 3101 in response to displacement of the sliding sleeve 3101 in a first direction (e.g. downhole direction) relative to the flow communicator 210. As well, the sliding sleeve 301 is releasably coupled to the sliding sleeve 401 with one or more frangible interlocking members 2281 (such as, for example, one or more shear pins).

In this respect, the combination of the releasable coupling of the sliding sleeve 401 to the housing 202 with the one or more frangible interlocking members 228, the releasable coupling of the sliding sleeve 3101 to the sliding sleeve 401 with the one or more frangible interlocking members 2600, and the releasable coupling of the sliding sleeve 301 to the sliding sleeve 401 with the one or more frangible interlocking members 2600 effects releasable retention of the flow controller 250 to the housing. In some of these embodiments, for example, the releasable retention of the flow controller 250 is for preventing inadvertent displacement of the flow controller 250 while the apparatus is being run in hole within the wellbore 102. The releasable retention is configured such that mechanical fracture of the one or more frangible interlocking members 228 is effectible in response to application of a sufficient force to the sliding sleeve 401 (such as, for example, by a shifting tool, see below), with effect that the sliding sleeve 401 becomes released from retention relative to the housing 202, and thereby effecting release of the flow controller 401 from retention relative to the housing 202.

In some embodiments, for example, the direction of the applied force is in the first direction (e.g. the downhole direction), such that, after the release from the retention, continued application of force in the first direction effects a change in configuration of the flow control apparatus 200 from the installation configuration to the open configuration (i.e. the flow communicator 210 becomes disposed in the open condition). In this respect, after the release from the retention, continued application of force in the first direction effects an opening displacement of the sliding sleeve 3101, relative to the flow communicator 210, in translation with the sliding sleeve 401, with effect that the flow communicator 210 becomes disposed in the open condition (and with effect that the apparatus 200 becomes disposed in the open configuration), and the sliding sleeve 3101 becomes disposed in an abutting relationship with the sliding sleeve 301 and urges the sliding sleeve 301 into abutting engagement with the stop 214.

In this respect, in some embodiments, for example, the stop 214, the flow controller 250, and the flow communicator 210 are further co-operatively configured such that, while the flow control apparatus 200 is disposed in the installation condition, in response to a displacement of the sliding sleeve 301, relative to the flow communicator 210, in the first direction (e.g. the downhole direction), the sliding sleeve 3101 becomes disposed in abutting engagement with the sliding sleeve 301, and while the sliding sleeve 3101 is disposed in abutting engagement with the sliding sleeve 301, in response to a continuing displacement of the sliding sleeve 301, relative to the flow communicator 210, in the first direction (e.g. the downhole direction):

(i) the sliding sleeve 301 becomes disposed in abutting engagement with the stop 214;

(ii) displacement of the sliding sleeve 301, relative to the stop 214, in the first direction (e.g. the downhole direction) becomes prevented;

(iii) the coupling between the sliding sleeve 301 and the sliding sleeve 401 is defeated;

(iv) displacement of the sliding sleeve 3101, relative to the sliding sleeve 301, in the first direction (e.g. the downhole direction) becomes prevented;

(v) the coupling between the sliding sleeve 3101 and the sliding sleeve 401 is defeated; and (vi) the sliding sleeve 401 is disposed in an uncoupled condition, such that the sliding sleeve 401 is displaceable, relative to both of the sliding sleeve 301 and the sliding sleeve 3101, in the first direction (e.g. the downhole direction)

In some embodiments, for example, the defeating of the coupling between the sliding sleeve 3101 and the sliding sleeve 401 includes fracturing of the one or more frangible interlocking members 2281. In some embodiments, for example, the defeating of the coupling between the sliding sleeve 301 and the sliding sleeve 401 includes fracturing of the one or more frangible interlocking members 2281.

In some embodiments, for example, while the flow control apparatus 200 is disposed in the installation configuration, a viscous fluid (e.g. grease) is disposed in the space 270, between the sliding sleeve 3101 and the sliding sleeve 301, and through which the sliding sleeve 3101 traverses during the opening displacement of the sliding sleeve 401. In response to the opening displacement of the sliding sleeve 3101, the viscous fluid is urged remotely from the space 270 to space 280 via one or more channels 281 extending through the sliding sleeve 3101. In this respect, interference to the translation of the sliding sleeve 3101 with the opening sleeve 401, during the opening displacement, is mitigated.

After the sliding sleeve 3101 and the sliding sleeve 401 have become uncoupled, in response to the further displacement of the sliding sleeve 401, relative to the sliding sleeve 301, in the first direction (e.g. the downhole direction), the sliding sleeve 301 and the sliding sleeve 401 become releasably coupled via the coupling system 5300, as described above. By virtue of the coupled configuration, the sliding sleeve 301 becomes translatable with the sliding sleeve 401 while the sliding sleeve 401 is being displaced, relative to the flow communicator 210, in the second direction (e.g. the uphole direction), as is described below. As well, by virtue of its abutting engagement to the sliding sleeve 301, the sliding sleeve 3101 also becomes translatable with the sliding sleeve 401 while the sliding sleeve 401 is being displaced, relative to the flow communicator 210, in the second direction (e.g. the uphole direction)

In this respect, in some embodiments, for example, while: (i) sliding sleeve 401 is disposed in the uncoupled condition, (ii) the sliding sleeve 301 is disposed in abutting engagement with the stop 214 such that displacement of the sliding sleeve 301, relative to the stop 214, in the first direction (e.g. the downhole direction) is being prevented, (iii) the displacement of the sliding sleeve 401, relative to the flow communicator 210, continues being urged (e.g. by the shifting tool) in the first direction (e.g. the downhole direction):

the sliding sleeve 401 is displaced, relative to the sliding sleeve 301, in the first direction with effect that the sliding sleeve 301 and the sliding sleeve 401 become releasably coupled via the coupling system 5300, as described above.

The stop 216 is provided for becoming disposed in abutting engagement with the sliding sleeve 401 for limiting (e.g. preventing) displacement of the sliding sleeve 401, relative to the flow communicator 210, in the first direction, upon the coupling of the sliding sleeves 301, 401 having been established. In this respect, the sliding sleeve 301, the sliding sleeve 401, and the stop 216 are co-operatively configured such that the abutting engagement of the sliding sleeve 401 with the stop 216 is effected upon the establishment of the releasable coupling of the sliding sleeve 301 and the sliding sleeve 401 via the coupling system 5300.

In some embodiments, for example, while the flow control apparatus 200 is disposed in the open configuration, there is an absence of alignment between any portion of the filter medium 302 and the flow communicator 210.

In some embodiments, for example, while the flow control apparatus 200 is disposed in the open configuration, the occluding of the filter medium 302 is being effected by the shroud 418, in a manner similar to that described above with respect to the installation configuration. In some embodiments, for example, while the flow control apparatus 200 is disposed in the open configuration, the sliding sleeve 301 and sliding sleeve 401 are co-operatively disposed such that the shroud 418 shields the filter medium 302 from material within the housing passage 224. In some embodiments, for example, the shielding is effected by occlusion of the filter medium 302 by the sliding sleeve 401, such as the shroud 418.

In some embodiments, for example, while the flow control apparatus 200 is disposed in the open configuration, the flow communicator 210 and the flow controller 250 are co operatively disposed such that the housing 202 shields the filter medium 302 from the external environment, such as the subterranean formation 100. In some embodiments, for example, the shielding is effected by occlusion of the filter medium 302 by the housing 202.

In some embodiments, for example, while the flow control apparatus 200 is disposed in the open configuration, sliding sleeve 401 is retained to the housing 202 with a collet retainer, in a similar way to that described in U.S. patent application Ser. No. 14/830,531, which is hereby incorporated by reference in its entirety. In parallel, by virtue of the releasable coupling of the sliding sleeve 301 to the sliding sleeve 401, the sliding sleeve 301 is also retained to the housing 202.

While the sliding sleeve 401 is disposed in an abutting engagement with the stop 216, the flow communicator 210 is disposed in the open condition, and the flow control apparatus 200 is disposed in the open configuration. Accordingly, the subterranean formation 100 may now be stimulated (for production of hydrocarbon material) by flowing treatment material from the surface 10 to the subterranean formation 100 via the flow communicator 210.

After the stimulation, it is desirable to effect closing of the flow communicator 210 and, in this respect, effect a change in configuration of the flow control apparatus 200 from the open configuration to the closed configuration. In effecting a change in the configuration of the flow control apparatus 200 from the open configuration to the closed configuration, the disposition of the flow controller 250, relative to the flow communicator 210, is changed, with effect that the condition of the flow communicator 210 is changed from the open condition to the closed condition. In this respect, while the flow control apparatus 200 is disposed in the open configuration, this change in disposition of the flow controller 250, relative to the flow communicator 210, is effected in response to a closing displacement of the flow controller 250, relative to the flow communicator 210, in the second direction (e.g. the uphole direction), effected, for example, with a shifting tool via engagement of the shifting tool to the sliding sleeve 401.

Because the sliding sleeve 3101 is disposed in abutting engagement with the sliding sleeve 301, the sliding sleeve 3101 and the sliding sleeve 301 behave like a single unit during the transition of the flow control apparatus 200 from the open configuration to the closed configuration, and also during the transition of the flow control apparatus 200 from the closed configuration to the production configuration. In this configuration, the sliding sleeve 3101 and the sliding sleeve 301 are co-operatively disposed for functioning as a single unit, in a manner equivalent to the sliding sleeve 301 of the embodiment illustrated in FIGS. 2 to 27, with effect that the transition of the flow control apparatus 200 from the open configuration to the closed configuration is effectible in a manner equivalent to the corresponding transition of the embodiment illustrated in FIGS. 2 to 27 (with effect, amongst other things, the sliding sleeves 3101 and 301 become retained relative to the housing 202 by the filter medium-positioning system 2511, for effecting filtering of solids, from hydrocarbon material being produced from the subterranean formation 100, by the filtering medium 302, while the apparatus is disposed in the production configuration), and also with effect that the transition of the flow control apparatus 200 from the closed configuration to the production configuration is effectible in a manner equivalent to the corresponding transition of the embodiment illustrated in FIGS. 2 to 27.

Referring to FIGS. 31, 32, 33A, 33B, 33C, and 33D, in those embodiments where the flow controller 250 includes a filter medium-defining counterpart 300, the flow communicator-occluding counterpart 3100, and the shroud-defining counterpart 400, in some of these embodiments, for example, each one of the filter medium-defining counterpart 300 and the shroud-defining counterpart 400, independently, is in the form of a sliding sleeve, and the flow communicator-occluding counterpart 3100 is functional for occluding the flow communicator 210, with effect that the flow communicator 210 is disposed in the closed condition, and, while occluding the flow communicator 210, and comprises degradable material (e.g. aluminum) that, in response to communication with a degradation promotion agent (e.g. acid), degrades, with effect that the flow communicator 210 becomes disposed in the open condition.

The sliding sleeve 401 of the shroud-defining counterpart 400 is nested within the sliding sleeve 301 of the filter medium-defining counterpart 300. In some embodiments, for example, the sliding sleeves 301, 401 are concentric. In some embodiments, for example, the housing 202 and the sliding sleeves 301, 401 are concentric. In some embodiments, for example, the sliding sleeve 301 includes a central longitudinal axis 316, and the sliding sleeve 401 includes a central longitudinal axis 416, and in some of these embodiments, for example, the axes 316 and 415 are coincident with each other. In this respect, in some embodiments, to accommodate the sleeves 301, 401, the housing 202 has a cylindrical, or generally cylindrical shape, having a circular, or generally circular axial cross-section, such that the flow control apparatus 200 has a cylindrical, or generally cylindrical shape. Also in this respect, the shroud 418 is defined by a circumferential portion of the shroud-defining counterpart 400.

In some embodiments, for example, with respect to the degradable material of the flow communicator-occluding counterpart 3100, the degradation of the degradable material is effected by, for example, at least one of dissolution, chemical reaction, or disintegration. In some embodiments, for example, the degradable material is degradable in response to contact with wellbore fluids.

Figure 33A:
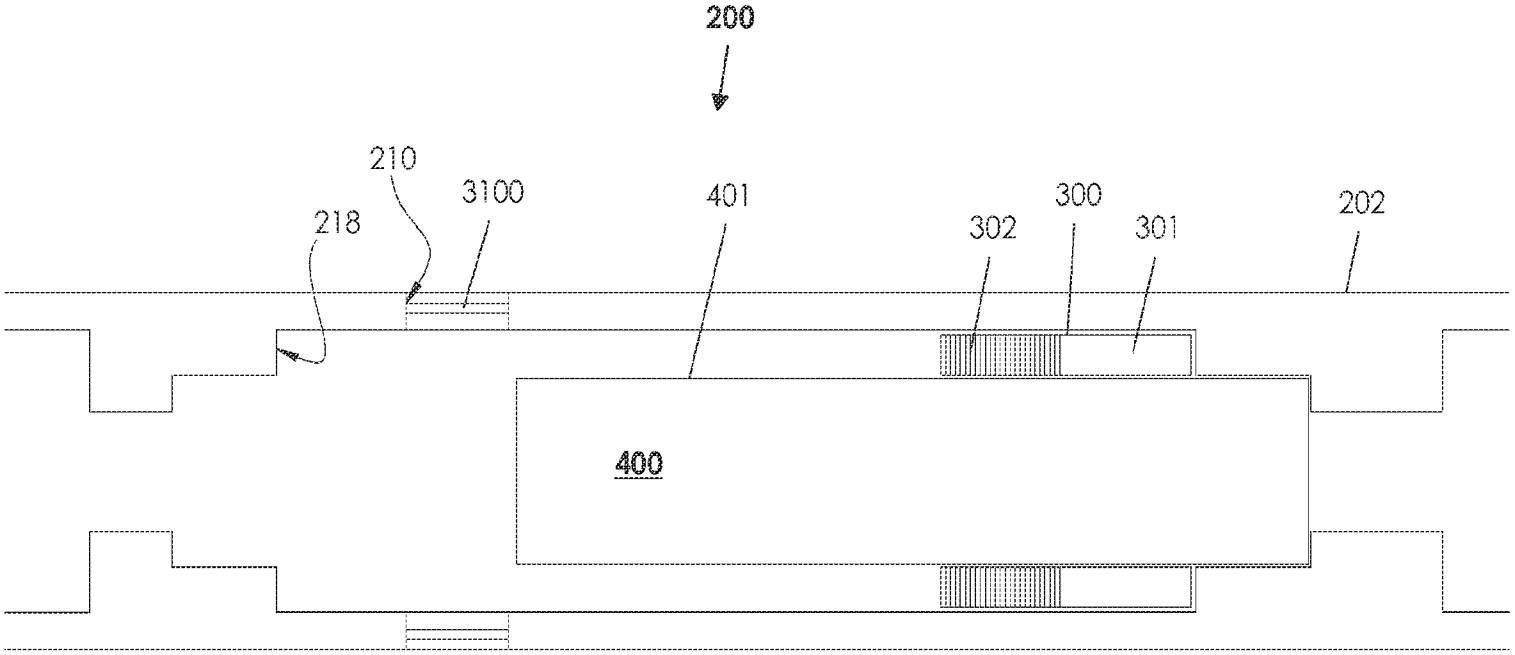
FIGS. 33A, 33B, 33C, and 33D are schematic illustrations of the flow control apparatus of FIG. 31 in installation, open, closed, and production configurations, respectively.
Figure 33B:
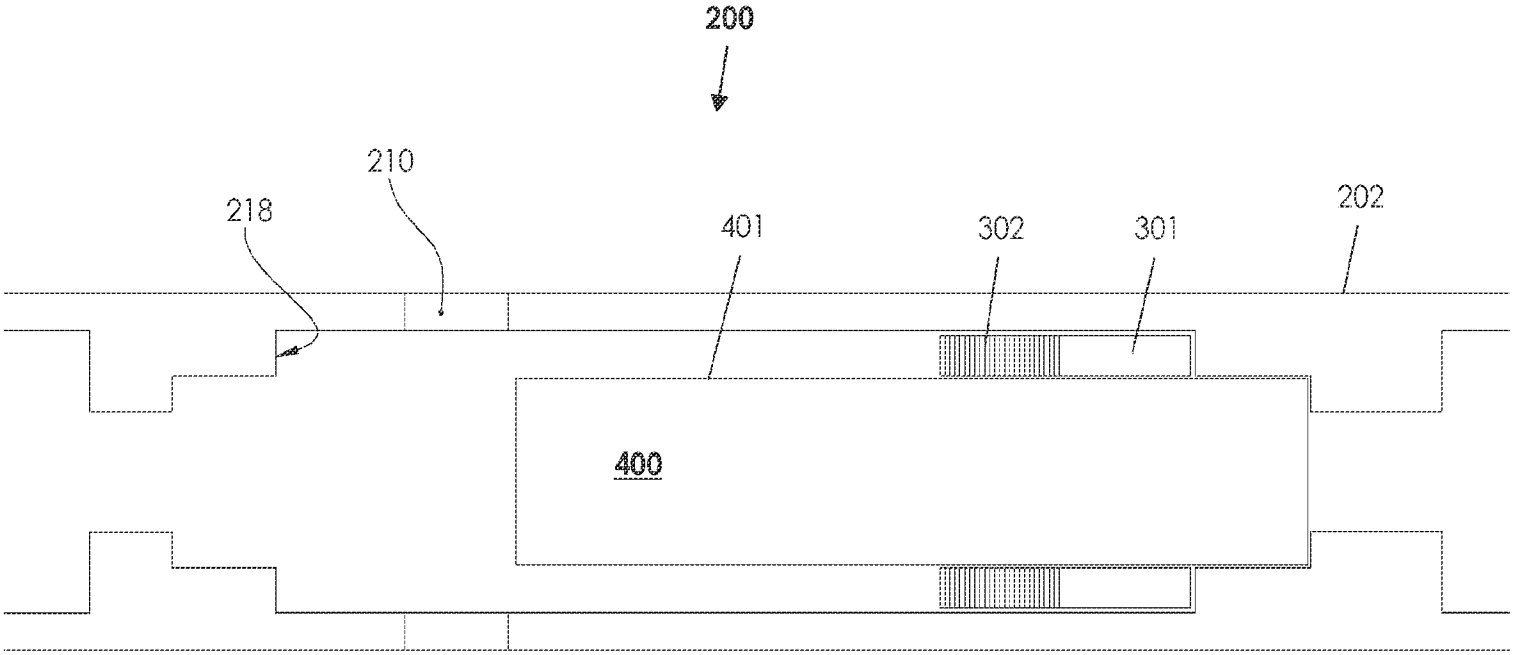
Figure 33C:
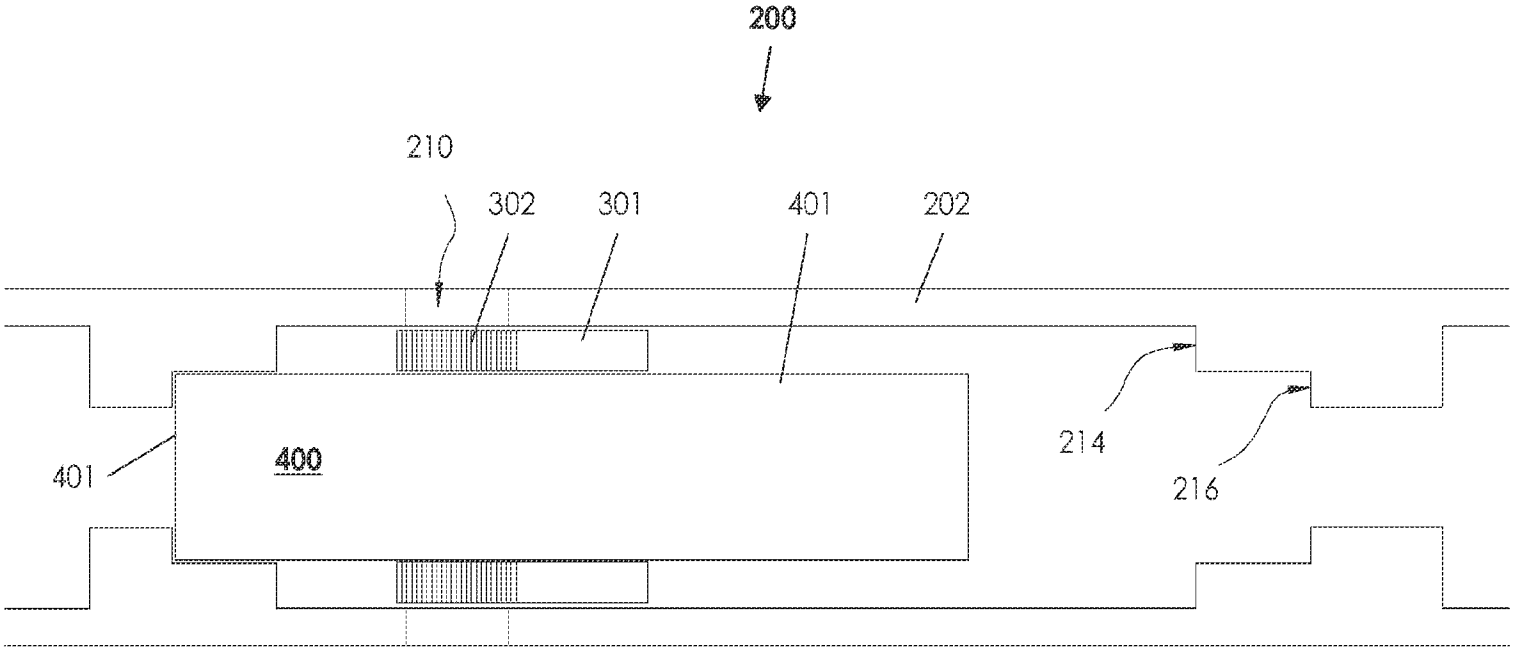
Figure 33D:
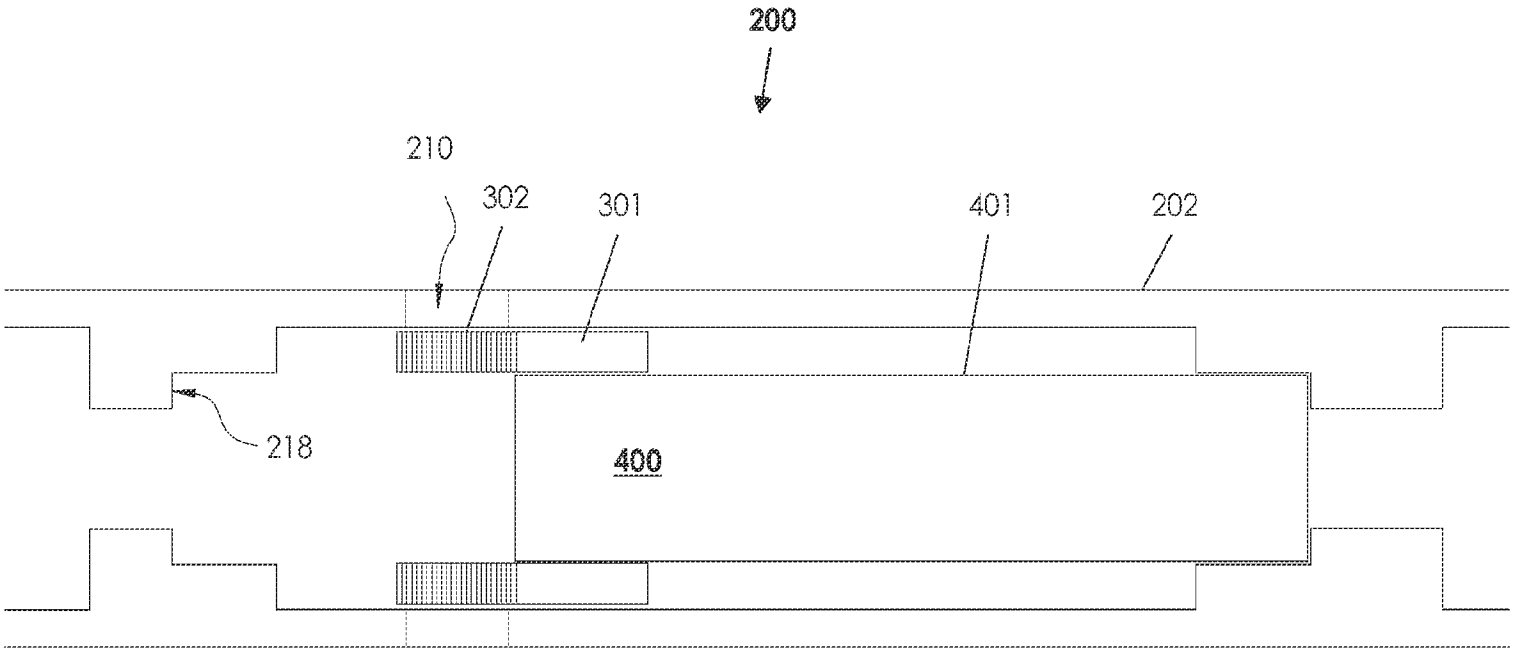

Referring to FIG. 33A, in some embodiments, for example, while the apparatus 200 is disposed in the installation configuration, the flow communicator-occluding counterpart 3100 is occluding the flow communicator 210 such that the flow communicator 210 is disposed in the closed condition. In some embodiments, for example, the flow communicator 210 includes a plurality of ports, and, correspondingly, the flow communicator-occluding counterpart 3100 includes a plurality of degradable material-comprising plugs 3102, and for each one of the ports, independently, a respective one of the plugs 3102 is disposed within the port, with effect that the port is occluded by the plug 3102, and with effect that the flow communicator 210 is disposed in the closed condition.

Also while the apparatus 200 is disposed in the installation condition, in some embodiments, for example, while the flow control apparatus 200 is disposed in the open configuration, there is an absence of alignment between any portion of the filter medium 302 and the flow communicator 210.

In some embodiments, for example, while the flow control apparatus 200 is disposed in the installation configuration, the occluding of the filter medium 302 is being effected by the shroud 418. In some embodiments, for example, while the flow control apparatus 200 is disposed in the open configuration, the sliding sleeve 301 and sliding sleeve 401 are co-operatively disposed such that the shroud 418 shields the filter medium 302 from material within the housing passage 224. In some embodiments, for example, the shielding is effected by occlusion of the filter medium 302 by the sliding sleeve 401, such as the shroud 418.

In some embodiments, for example, while the flow control apparatus 200 is disposed in the installation configuration, the flow communicator 210 and the flow controller 250 are co-operatively disposed such that the housing 202 shields the filter medium 302 from the external environment, such as the subterranean formation 100. In some embodiments, for example, the shielding is effected by occlusion of the filter medium 302 by the housing 202.

In some embodiments, for example, while the flow control apparatus 200 is disposed in the installation configuration, sliding sleeve 401 is retained to the housing 202 with a collet retainer, in a similar way to that described in U.S. patent application Ser. No. 14/830,531, which is hereby incorporated by reference in its entirety. In parallel, by virtue of the releasable coupling of the sliding sleeve 301 to the sliding sleeve 401, the sliding sleeve 301 is also retained to the housing 202.

Also while the apparatus 200 is disposed in the installation configuration, in some embodiments, for example, the sliding sleeve 301 is releasably coupled to the sliding sleeve 401 via the coupling system 5300, such that the sleeve 301 is translatable with the sleeve 401 (such as, for example, while the sleeve 401 is being displaced by a shifting tool). In this respect, while the apparatus 200 is disposed in the installation configuration, the sliding sleeves 301, 401 are disposed in a configuration equivalent to that of the sliding sleeves 301, 401 of the embodiment illustrated in FIGS. 1 to 27, when disposed in the second coupled configuration (i.e. with the flow control apparatus of FIGS. 1 to 27 disposed in the open configuration), with the exception that there is an absence of an occluding portion 310 in the sliding sleeve 301.

Also while the apparatus 200 is disposed in the installation configuration, in some embodiments, for example, the sliding sleeve 301 is releasably retained relative to the housing 202 by one or more frangible interlocking members 228 (e.g. one or more shear pins), Co-operatively, the releasable coupling of the sliding sleeve 301 to the sliding sleeve 401 effects releasable retention of the sliding sleeve 301 to the housing 202 by the one or more frangible interlocking members 228 via the sliding sleeve 401. In some of these embodiments, the releasable retention is for preventing inadvertent displacement of the combination of the sliding sleeves 301 and 401 while the apparatus is being run in hole within the wellbore 102. The releasable retention is configured such that mechanical fracture of the one or more frangible interlocking members 228 is effectible in response to application of a sufficient force to the sliding sleeve 401 (such as, for example, by a shifting tool), with effect that the sliding sleeve 401 becomes released from retention relative to the housing 202. In some embodiments, for example, the direction of the applied force is in the second direction (e.g. the uphole direction), such that, after the release from the retention, continued application of force in the second direction effects a change in configuration of the flow control apparatus 200 from the open configuration to the closed configuration.

To effect a change in configuration of the apparatus 200 from the installation configuration to the open configuration (see FIG. 33B), a degradation promotion agent is supplied downhole, via the wellbore 102 such that the degradation promotion agent becomes disposed in communication with the flow communicator-occluding counterpart 3100 such that degradation of the degradable material of the flow communicator-occluding counterpart 3100 is effected, with effect that the flow communicator 210 becomes disposed in the open condition. By virtue of the flow communicator 210 becoming disposed in the open condition, transitioning of the apparatus 200 to the open configuration is effected. In transitioning to the open configuration, the co-operative positioning of the sliding sleeves 301, 401, relative to the flow communicator 210, is maintained.

While the flow control apparatus 200 is disposed in the open configuration, the subterranean formation 100 can be stimulated (for production of hydrocarbon material) by flowing treatment material from the surface 10 to the subterranean formation 100 via the flow communicator 210.

After the stimulation, it is desirable to effect closing of the flow communicator 210 and, in this respect, transition the flow control apparatus 200 from the open configuration to the closed configuration (see FIG. 33C), and then from the closed configuration to the production configuration (see FIG. 33D), as described above with respect to the other embodiments. Because the sliding sleeves 301, 401 are disposed in a configuration equivalent to that of the sliding sleeves 301, 401 of the embodiment illustrated in FIGS. 1 to 27, when disposed in the second coupled configuration (i.e. and with the flow control apparatus of FIGS. 1 to 27 disposed in the open configuration), with the exception that there is an absence of an occluding portion 310 in the sliding sleeve 301, the transition of the flow control apparatus 200 from the open configuration to the closed configuration is effectible in a manner equivalent to the corresponding transition of the embodiment illustrated in FIGS. 1 to 27 (with effect, amongst other things, that the sliding sleeve 301 becomes retained relative to the housing 202 by the filter medium-positioning system 2511, for effecting filtering of solids, from hydrocarbon material being produced from the subterranean formation 100, by the filtering medium 302, while the apparatus is disposed in the production configuration), and also the transition of the flow control apparatus 200 from the closed configuration to the production configuration is effectible in a manner equivalent to the corresponding transition of the embodiment illustrated in FIGS. 1 to 27.

Figure 34:
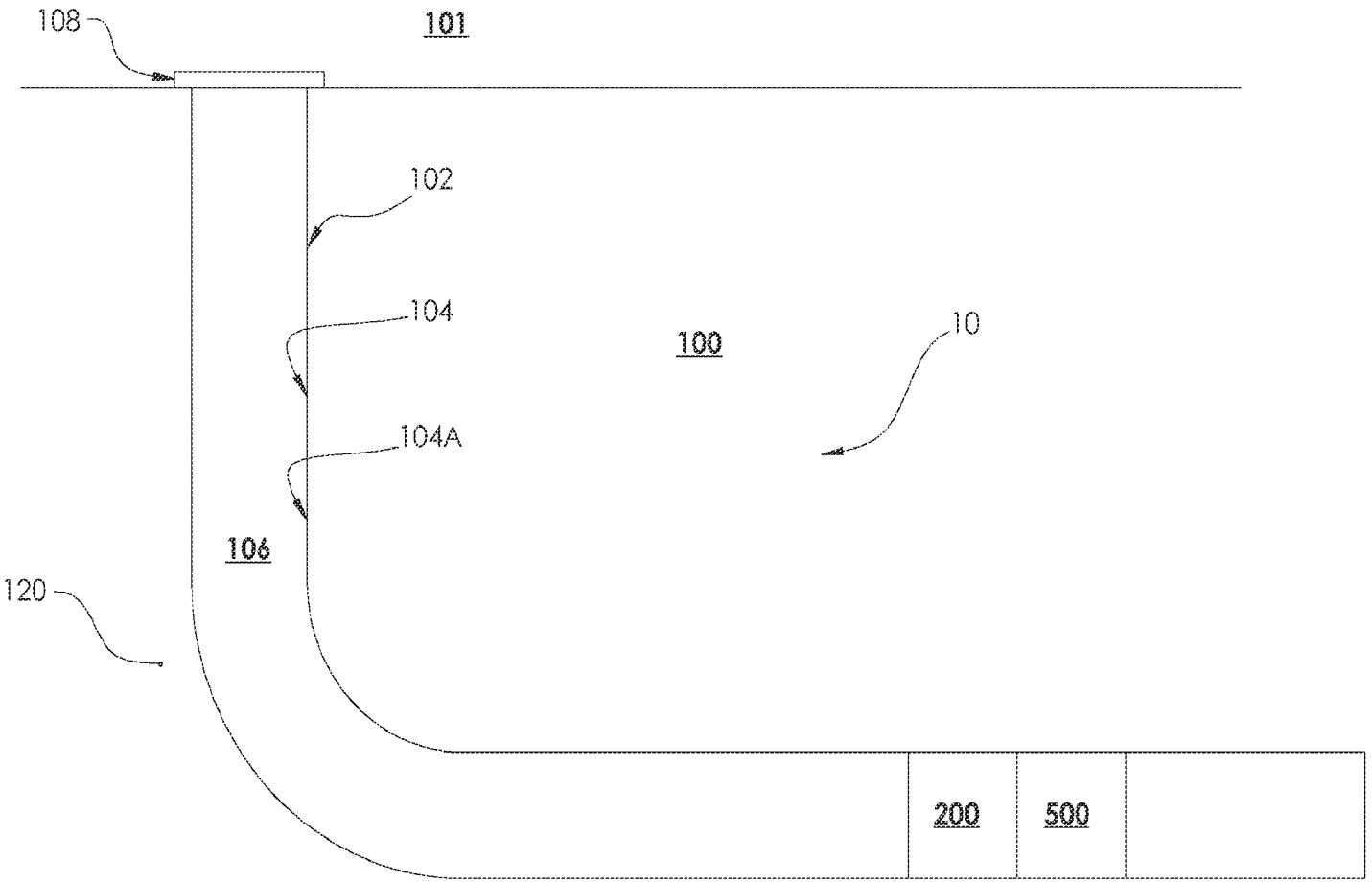
FIG. 34 is a schematic of another embodiment of a system for effecting production of hydrocarbon material from a subterranean formation, within which the flow control apparatus of the present disclosure is integrated.

Referring to FIG. 34, in some embodiments, for example, the flow control apparatus 200 is integrated within a wellbore string 104 and adjacent to, or at least in close proximity to, a flow control apparatus 500. The flow control apparatus is configured for selectively effecting flow communication between the wellbore string passage 106 and the subterranean formation 100, for injecting treatment material into the subterranean formation 100, for the purpose of stimulating production of hydrocarbon material from the subterranean formation 100. In this respect, after the injection of the treatment material, production is effected via the flow communicator 210 of the flow control apparatus 200 while the flow control apparatus 200 is disposed in the production configuration. In this respect, in some embodiments, for example, the flow control apparatus 200 functions exclusively for the purpose of receiving production of hydrocarbon material from the subterranean formation, without additionally being used for the purpose of injecting the treatment material.

Although the embodiments have been described in detail, it should be understood that various changes, substitutions and alterations can be made herein. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be examples only. The invention is defined by the appended claims.

What is claimed is:

1. A valve assembly comprising:

a valve housing including a housing passage and a housing port defined through the valve housing for establishing fluid communication between an external environment to the valve housing and the housing passage;

a flow controller provided within the housing passage and adapted to control fluid flow, via the housing port, between the housing passage and the external environment, the flow controller comprising:

an outer sleeve slidably mounted to the valve housing within the housing passage and having an outer sleeve body defining an outer sleeve passage therethrough, the outer sleeve comprising a sleeve port defined through a thickness of the outer sleeve body; and an inner sleeve slidably mounted to the outer sleeve within the outer sleeve passage and having an inner sleeve body shiftable within the outer sleeve passage to selectively occlude the sleeve port;

an occluding portion coupled to the valve housing and comprising a degradable material adapted to occlude the housing port and prevent fluid communication between the external environment and the housing passage, the degradable material being responsive to communication with a degradation promotion agent to degrade and allow fluid communication between the external environment and the housing passage;

wherein the valve assembly is configurable between:

an installation configuration, where the occluding portion occludes the housing port to prevent fluid communication between the external environment and the housing passage;

an open configuration, where, following the degradation of the degradable material, the outer sleeve and the inner sleeve are spaced from the housing port to enable fluid communication between the external environment and the housing passage.

2. The valve assembly of claim 1, further configurable in a closed configuration, where, following the degradation of the degradable material, the outer sleeve is adapted to shift along the housing passage to position a portion of the outer sleeve adjacent the sleeve port in alignment with the housing port to prevent fluid communication between the external environment and the housing passage, and where the inner sleeve body is positioned to occlude the sleeve port from within the outer sleeve passage.

3. The valve assembly of claim 1, further configurable in a production configuration, where, following the degradation of the degradable material, the outer sleeve is adapted to shift along the housing passage to position the sleeve port in alignment with the housing port to establish fluid communication between the outer sleeve passage and the external environment, the outer sleeve passage communicating with the housing passage.

4. The valve assembly of claim 1, wherein, when in the open configuration, the inner sleeve body is positioned to occlude the sleeve port from within the outer sleeve passage.

5. The valve assembly of claim 1, wherein the degradable material is adapted to degrade via chemical conversion or dissolution.

6. The valve assembly of claim 1, wherein the outer sleeve comprises a flow modulator configured to modulate flow characteristics of material flowing between the external environment and the housing passage via the sleeve port.

7. The valve assembly of claim 6, wherein the flow modulator includes a filter medium configured to prevent, or substantially prevent, passage of oversize material from the external environment to the housing passage via the sleeve port.

8. The valve assembly of claim 7, wherein, when in the installation configuration, the inner sleeve body is positioned to occlude the sleeve port from within the outer sleeve passage to shield the filter medium from material within the housing passage.

9. The valve assembly of claim 1, wherein, when in the installation configuration, the outer sleeve is releasable secured to the valve housing with one or more frangible components;

the sleeve port is spaced from the housing port; and the inner sleeve body is positioned to occlude the sleeve port from within the outer sleeve passage.

10. The valve assembly of claim 1, wherein the outer sleeve and the occluding portion are independent from one another such that the occluding portion remains coupled to the valve housing to have the degradable material occlude the housing port during shifting of the outer sleeve along the housing passage.

11. A valve assembly comprising:

a valve housing including a housing passage and a housing port defined through the valve housing for establishing fluid communication between an external environment to the valve housing and the housing passage;

a flow controller provided within the housing passage and adapted to control fluid flow, via the housing port, between the housing passage and the external environment, the flow controller comprising:

an outer sleeve slidably mounted to the valve housing within the housing passage and having an outer sleeve body defining an outer sleeve passage therethrough, the outer sleeve comprising a sleeve port defined through a thickness of the outer sleeve body; and an inner sleeve slidably mounted to the outer sleeve within the outer sleeve passage and having an inner sleeve body shiftable within the outer sleeve passage to selectively occlude the sleeve port; and an occluding sleeve slidably mounted to the valve housing within the housing passage and adapted to selectively occlude the housing port to control fluid communication between the housing passage and the external environment, the occluding sleeve comprising a channel extending longitudinally therethrough, the outer sleeve and the occluding sleeve being adapted to define an annular space therebetween, wherein viscous fluid is disposed within the annular space, and the channel of the occluding sleeve is adapted to establish fluid communication between the annular space and a remote housing passage portion disposed remotely relative to the annular space, the valve assembly being configurable between:

an installation configuration, where the occluding sleeve is positioned to occlude the housing port and is operatively coupled to the inner sleeve such that shifting the inner sleeve within the housing passage engages the occluding sleeve in displacement along the housing passage;

an open configuration, where the inner sleeve and the occluding sleeve have shifted in a first direction to have the occluding sleeve engage the annular space and urge the viscous fluid through the channel of the occluding sleeve and into the remote housing passage portion.

12. The valve assembly of claim 11, wherein the valve housing comprises a first shoulder extending radially into the housing passage and adapted to block movement of the outer sleeve in the first direction, and wherein, upon shifting the inner sleeve and the occluding sleeve in the first direction to operate the valve assembly in the open configuration, the occluding sleeve abuts against and urges the outer sleeve in the first direction to engage the first shoulder.

13. The valve assembly of claim 12, wherein the valve housing comprises a second shoulder extending radially into the housing passage and adapted to block movement of the inner sleeve in the first direction, and wherein, upon having the occluding sleeve abut against the outer sleeve and having the outer sleeve engage the first shoulder, the inner sleeve is adapted to shift further in the first direction to engage the second shoulder and become uncoupled from the occluding sleeve.

14. The valve assembly of claim 13, further comprising a coupling system configured to enable the inner sleeve and the outer sleeve to be disposed in a releasably connected configuration upon the outer sleeve engaging the first shoulder and the inner sleeve engaging the second shoulder, and wherein, when in the releasably connected configuration, shifting the inner sleeve along the housing passage engages the outer sleeve in displacement along the housing passage.

15. The valve assembly of claim 14, further configurable in a closed configuration, where, upon disposing the inner sleeve and the outer sleeve in the releasably connected configuration, the inner sleeve and the outer sleeve are adapted to shift along the housing passage in a second direction to position a portion of the outer sleeve in alignment with the housing port to prevent fluid communication between the external environment and the housing passage.

16. The valve assembly of claim 14, further configurable in a production configuration, where, upon disposing the inner sleeve and the outer sleeve in the releasably connected configuration, the inner sleeve and the outer sleeve are adapted to shift along the housing passage in a second direction to position the sleeve port in alignment with the housing port to establish fluid communication between the housing passage and the external environment via the sleeve port.

17. The valve assembly of claim 11, further configurable in a closed configuration, where the outer sleeve is adapted to shift along the housing passage to position a portion of the outer sleeve in alignment with the housing port to prevent fluid communication between the external environment and the housing passage, and where the inner sleeve body is positioned to occlude the sleeve port from within the outer sleeve passage.

18. The valve assembly of claim 11, further configurable in a production configuration, where the outer sleeve is adapted to shift along the housing passage to position the sleeve port in alignment with the housing port to establish fluid communication between the housing passage and the external environment via the sleeve port.

19. A flow control apparatus comprising:

a housing including a housing passage and a flow communicator for effecting flow communication between an environment external to the housing and the housing passage;

a flow controller, for controlling flow communication, via the flow communicator, between the housing passage and the external environment, including:

flow communicator occluding counterpart including an occluding portion;

a filter medium-defining counterpart including a filter medium;

a driving counterpart;

wherein:

the occluding portion is occluding the flow communicator such that the flow communicator is disposed in the closed condition;

viscous fluid is disposed within a space defined between the flow communicator occluding counterpart and the filter medium-defining counterpart the flow communicator occluding counterpart is displaceable with the driving counterpart in a first direction;

the flow communicator occluding counterpart includes a viscous-conducting passage effecting flow communication between the space and a housing passage portion disposed remotely relative to the space;

in response to displacement of the driving counterpart relative to the flow communicator:

(i) the flow communicator occluding counterpart is displaced with the driving counterpart such that displacement of the viscous fluid is urged remotely from the space via the viscous fluid-conducting passage; and (ii) the driving counterpart becomes disposed relative to the filter medium-defining counterpart such that the filter medium-defining counterpart is displaceable, relative to the flow communicator, in a second direction that is opposite to the first direction; and while the displaceability of the filter medium-defining counterpart with the driving counterpart is established, in response to displacement of the driving counterpart, relative to the flow communicator, in the second direction, the filter medium of the filter medium-defining counterpart becomes disposed in alignment with the flow communicator.

* * * * *